US007043175B2

(12) United States Patent
Komoto et al.

(10) Patent No.: US 7,043,175 B2
(45) **Date of Patent: *May 9, 2006**

(54) IMAGE FORMING METHOD AND APPARATUS

(75) Inventors: Keiji Komoto, Numazu (JP); Tsuyoshi Takiguchi, Shizuoka-ken (JP); Tatsuhiko Chiba, Kamakura (JP); Michihisa Magome, Shizuoka-ken (JP); Akira Hashimoto, Shizuoka-ken (JP); Takeshi Kaburagi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

This patent is subject to a terminal disclaimer.

(21) Appl. No.: 09/987,490

(22) Filed: Nov. 15, 2001

(65) Prior Publication Data

US 2002/0115011 A1 Aug. 22, 2002

(30) Foreign Application Priority Data

Nov. 15, 2000 (JP) ..... 2000-348146

(51) Int. Cl.
*G03G 15/00* (2006.01)
*G03G 15/02* (2006.01)

(52) U.S. Cl. ..... 399/159; 399/149; 399/174; 399/176; 399/270; 430/67; 430/106.2; 430/122; 430/125; 430/902

(58) Field of Classification Search ..... 430/125, 430/126, 110.3, 106.1, 122, 111.41, 106.2, 430/902, 108.6, 67; 399/149, 150, 159, 176, 399/175, 267, 270, 274, 308, 356, 174

See application file for complete search history.

(56) References Cited

U.S. PATENT DOCUMENTS 4,292,387 A 9/1981 Kanbe et al. ..... 430/102
4,451,547 A 5/1984 Hirai et al. ..... 430/128

(Continued)

FOREIGN PATENT DOCUMENTS

EP 0621512 10/1994
EP 0822456 2/1998

(Continued)

OTHER PUBLICATIONS

"Trademark Electronic Search System" (TESS) for Word Mark Coulter, Jan. 16, 2004.*
Patent Abstracts of Japan, vol. 009, No. 320 (P–413) Dec. 1985 for JP 60–147756.
Database WPI, Section Ch, Week 198736, Derwent Publications, XP–002256369, Aug. 1987 for JP 62–175776.

*Primary Examiner*—Janis L. Dote
(74) *Attorney, Agent, or Firm*—Fitzpatrick, Cella, Harper & Scinto

(57) ABSTRACT

In an image forming system, an image-bearing member having a photoconductor layer comprising an Si-based non-single crystal material is charged at a relatively low potential of 250 to 600 volts by a contact charging member in the presence of electroconductive fine powder. An electrostatic latent image formed on the image-bearing member is developed with a magnetic toner which includes magnetic toner particles comprising at least a binder resin and a magnetic iron oxide, and inorganic fine powder and electroconductive fine powder present at the surface of the magnetic toner particles. The magnetic toner has a weight-average particle size of 3–10 μm and an average circularity of 0.950 to 0.995, and contains 0.05 to 3.00% of isolated iron-containing particles.

15 Claims, 7 Drawing Sheets

U.S. PATENT DOCUMENTS

| | | | | | |
|---|---|---|---|---|---|
| 4,530,895 | A | | 7/1985 | Imamura et al. | |
| 4,559,289 | A | | 12/1985 | Sunagawa et al. | 430/66 |
| 4,620,987 | A | | 11/1986 | Yamashita et al. | 427/131 |
| 4,804,609 | A | | 2/1989 | Imanaka et al. | |
| 4,851,960 | A | | 7/1989 | Nakamura et al. | 361/225 |
| 5,432,037 | A | | 7/1995 | Nishikiori et al. | 430/126 |
| 5,637,432 | A | | 6/1997 | Okado et al. | |
| 5,729,800 | A | * | 3/1998 | Ohba et al. | 399/159 |
| 5,804,309 | A | * | 9/1998 | Itoh et al. | 428/375 |
| 5,840,755 | A | | 11/1998 | Liedtke | |
| 5,998,008 | A | * | 12/1999 | Shimamura et al. | 428/323 |
| 6,026,260 | A | * | 2/2000 | Aita et al. | 399/175 |
| 6,035,171 | A | * | 3/2000 | Takaya et al. | 399/281 |
| 6,040,103 | A | * | 3/2000 | Ohno et al. | 430/108.8 |
| 6,052,549 | A | * | 4/2000 | Shimura et al. | 399/176 |
| 6,081,681 | A | | 6/2000 | Nagase et al. | 399/174 |
| 6,094,550 | A | * | 7/2000 | Kido et al. | 399/103 |
| 6,128,456 | A | | 10/2000 | Chigono et al. | 399/176 |
| 6,316,156 | B1 | | 11/2001 | Takiguchi et al. | 430/109.4 |
| 6,432,599 | B1 | * | 8/2002 | Yuasa et al. | 430/108.4 |
| 6,447,969 | B1 | * | 9/2002 | Ito et al. | 430/106.2 |
| 6,459,878 | B1 | * | 10/2002 | Tomoyuki et al. | 399/331 |
| 6,485,878 | B1 | * | 11/2002 | Nagase et al. | 430/124 |
| 6,576,387 | B1 | * | 6/2003 | Hashizume et al. | 430/66 |
| 6,596,452 | B1 | * | 7/2003 | Magome et al. | 430/106.2 |
| 2002/0115012 | A1 | * | 8/2002 | Hashizume et al. | 430/106.1 |

FOREIGN PATENT DOCUMENTS

| | | | | |
|---|---|---|---|---|
| EP | 0851307 | A | | 7/1998 |
| EP | 0881544 | | | 12/1998 |
| EP | 989470 | A2 | * | 3/2000 |
| EP | 1058157 | | | 12/2000 |
| EP | 1128225 | A2 | * | 8/2001 |
| JP | 086341 | | | 7/1979 |
| JP | 18656 | | | 2/1980 |
| JP | 142540 | | | 11/1981 |
| JP | 151952 | | | 9/1982 |
| JP | 168458 | | | 9/1984 |
| JP | 200254 | | | 11/1984 |
| JP | 200256 | | | 11/1984 |
| JP | 200257 | | | 11/1984 |
| JP | 224102 | | | 12/1984 |
| JP | 3181 | | | 1/1985 |
| JP | 12554 | | | 1/1985 |
| JP | 69660 | | | 4/1985 |
| JP | 141452 | | | 6/1986 |
| JP | 249059 | | | 11/1986 |
| JP | 275864 | | | 12/1986 |
| JP | 258472 | | | 11/1987 |
| JP | 149669 | | | 6/1988 |
| JP | 250660 | | | 10/1988 |
| JP | 111962 | | | 4/1990 |
| JP | 120865 | | | 5/1990 |
| JP | 9860 | | | 1/1992 |
| JP | 264453 | | | 9/1992 |
| JP | 66608 | | | 3/1993 |
| JP | 150539 | | | 6/1993 |
| JP | 346682 | | | 12/1993 |
| JP | 99442 | | | 10/1995 |
| JP | 239897 | | | 9/1998 |
| JP | 307421 | | | 11/1998 |
| JP | 307455 | | | 11/1998 |
| JP | 307456 | | | 11/1998 |
| JP | 307457 | | | 11/1998 |
| JP | 307458 | | | 11/1998 |

* cited by examiner

"PRIOR ART"

IMAGE FORMING METHOD AND APPARATUS

FIELD OF THE INVENTION AND RELATED ART

The present invention relates to an image forming method and an image forming apparatus using a magnetic toner according to a recording method, such as electrophotography and electrostatic recording.

Hitherto, various proposals have been made regarding image forming methods using a magnetic toner.

U.S. Pat. No. 3,908,258 has proposed a developing method using an electroconductive magnetic toner, wherein an electroconductive magnetic toner is carried on an electroconductive sleeve containing a magnet therein and caused to contact an electrostatic image to effect the development. In this instance, in the developing region, an electroconductive path is formed of toner particles between an image-bearing member surface and the sleeve surface, and a charge is guided from the sleeve to the toner particles via the electroconductive path, whereby the resultant Coulomb force acting between the toner particles and the electrostatic images causes the toner particles to attach the electrostatic image to effect a development thereof. The developing method using an electroconductive magnetic toner is an excellent method capable of obviating problems involved in a conventional two-component developing method but, on the other hand, involves a difficulty in electrostatic transfer of the developed toner image from the image-bearing member to a recording material, such as plain paper because of the electroconductivity of the toner.

As a developing method using a high-resistivity magnetic toner which can be electrostatically transferred, there is a developing method utilizing dielectric polarization of toner particles. This method however involves an inherently slow developing speed and an insufficient developed image density.

As another developing method of using a high-resistivity magnetic toner, there is known a method wherein the magnetic toner particles are triboelectrically charged through friction between individual toner particles and between the toner particles and the developing sleeve and then caused to contact an electrostatic image on the image-bearing member to effect the development. This method involves a difficulty that insufficient triboelectric charge or charging failure is liable to occur due to a relatively low frequency of contact between the magnetic toner particles and the friction member and also due to exposure of the magnetic material at the magnetic toner particle surface.

JP-A 55-18656 has proposed a jumping developing method, wherein a thin layer of magnetic toner is applied and triboelectrically charged on a developing sleeve and is then brought to a proximity to an electrostatic image to develop the electrostatic image. This method is an excellent method in that it allows a sufficient triboelectrification by the application of a magnetic toner in a thin layer on a developing sleeve to increase the opportunity of contact between the developing sleeve and the toner.

However, such insulating magnetic toner particles are accompanied with a substantial amount of fine magnetic powder and also a portion of the magnetic powder exposed at the magnetic toner particle surface, which are liable to affect the flowability and triboelectric chargeability of the magnetic toner.

In the case of using a conventional magnetic toner containing magnetic powder, the magnetic powder exposed at the magnetic toner particle surface is considered to affect the toner performances. More specifically, due to the exposure at the magnetic toner particle surface of fine magnetic powder having a lower resistivity than a resin constituting the magnetic toner particles, the magnetic toner particles are liable to cause a lowering in chargeability, a lowering in flowability and separation of the magnetic powder due to friction or rubbing between individual magnetic toner particles and between the toner particles and a regulation member during a long term of uses, thus being liable to cause an image density lowering and image density irregularity called sleeve ghost.

A toner obtained through suspension polymerization (sometimes referred to as a "polymerization toner") is advantageous for high-quality image formation because of easiness of smaller particle size toner production and an improved flowability due to a sphericity of resultant toner particle shape.

The flowability and chargeability of polymerization toner particles are however lowered due to inclusion therein of magnetic powder (generally comprising a magnetic iron oxide). This is because magnetic powder is generally hydrophillic to be predominantly present at the toner particle surface, so that a surface property modification of the magnetic powder becomes important for solving the problem.

As for surface treatment of magnetic powder for improved dispersion thereof in a polymerization toner, many proposals have been made. For example, JP-A 59-200254, JP-A 59-200256, JP-A 59-200257 and JP-A 59-224102 have proposed treatment of magnetic powder with various silane coupling agents, and JP-A 63-250660 and JP-A 10-239897 have disclosed treatment of silicon-containing magnetic powder with silane coupling agents.

These treatments provide a somewhat improved dispersibility in the toner but are accompanied with a problem that it is difficult to uniformly hydrophobize magnetic powder surfaces, so that it is difficult to obviate the coalescence of magnetic powder particles and the occurrence of untreated magnetic powder particles, thus leaving a room for further improvement in dispersibility of magnetic powder in the toner particles.

Further, as a result of such a surface treatment, the exposure of magnetic iron oxide powder from the magnetic toner particle surfaces can be suppressed to some extent, but it is difficult to uniformly hydrophobize the magnetic iron oxide powder surface, so that the occurrence of coalescent magnetic iron oxide powder particles and yet-unhydrophobized magnetic iron oxide powder particles is inevitable, and the suppression of the surface exposure of magnetic iron oxide powder becomes insufficient.

Further, JP-B 60-3181 has proposed a magnetic toner containing a magnetic iron oxide hydrophobized by treatment with an alkyltrialkoxysilane. The use of the thus-treated magnetic iron oxide powder has actually provided a toner having improved electrophotographic performances in various respects. However, the magnetic iron oxide powder inherently has a relatively low surface activity so that coalescence of magnetic powder particles and insufficient hydrophobization are inevitable, thus leaving the necessity of further improvement for use in an image forming method operated under a severe condition as by inclusion of a contact charging step discussed hereinafter. The use of a larger amount of hydrophobizing agent or a hydrophobizing agent having a higher viscosity provides a higher hydrophobicity of the treated magnetic powder but also results in increased coalescence of magnetic powder particles, thus resulting in a rather inferior dispersibility. As a result, a toner produced by using such a treated magnetic iron oxide powder is caused to have non-uniform triboelectric chargeability, leading to inferior fog prevention and transferability.

As described above, a conventional polymerization toner using such a surface-treated magnetic powder has not succeeded in a good combination of hydrophobicity and dispersibility, and it is difficult to stably obtain high-definition images if such a polymerization toner is used in an image forming method including a contact charging step as described hereinafter.

JP-A 5-66608 and JP-A 4-9860 have disclosed hydrophobized inorganic fine powder or inorganic fine powder hydrophobized and then treated with silicone oil. Further, JP-A 61-249059, JP-A 4-264453 and JP-A 5-346682 have disclosed to add hydrophobized inorganic fine powder and silicone oil-treated inorganic fine powder in combination.

Further, many proposals have been made regarding addition of electroconductive fine powder as an external additive. For example, carbon black as electroconductive fine powder is widely known as an external additive to be attached to or fixed on toner particles for the purpose of, e.g., imparting electroconductivity to the toner, or suppressing excessive charge of the toner to provide a uniform triboelectric charge distribution. Further, JP-A 57-151952, JP-A 59-168458 and JP-A 60-69660 have disclosed to externally add electroconductive fine powder of tin oxide, zinc oxide and titanium oxide, respectively, to high-resistivity toner particles. JP-A 56-142540 has proposed a toner provided with both developing performance and transferability by adding electroconductive magnetic particles, such as iron oxide, iron powder or ferrite, to high-resistivity magnetic toner particles so as to promote charge induction to the magnetic toner. Further, JP-A 61-275864, JP-A 62-258472, JP-A 61-141452 and JP-A 02-120865 have disclosed the addition of graphite, magnetite, polypyrrole electroconductive fine powder and polyaniline electroconductive fine powder to the respective toners. Further, the addition of various species of electroconductive fine powder to the toner is known.

In recent years, a contact charging device has been proposed and commercialized as a charging device for a member to be charged such as a latent image-bearing member because of advantages, such as low ozone-generating characteristic and a lower power consumption, than the corona charging device.

A contact charging device is a device comprising an electroconductive charging member (which may also be called a contact charging member or a contact charger) in the form of a roller (charging roller), a fur brush, a magnetic brush or a blade, disposed in contact with a member-to-be-charged, such as an image-bearing member, so that the contact charging member is supplied with a prescribed charging bias voltage to charge the member-to-be-charged to prescribed polarity and potential.

The charging mechanism (or principle) during the contact charging may include (1) discharge (charging) mechanism and (2) direct injection charging mechanism, and may be classified depending on which of these mechanism is predominant.

(1) Discharge Charging Mechanism

This is a mechanism wherein a member is charged by a discharge phenomenon occurring at a minute gap between the member and a contact charging member. As a certain discharge threshold is present, it is necessary to apply to the contact charging member a voltage which is larger than a prescribed potential to be provided to the member-to-be-charged. Some discharge product occurs wile the amount thereof is remarkably less than in a corona charger, and active ions, such as ozone, occur though the amount thereof is small.

(2) Direct Injection Charging Mechanism

This is a mechanism wherein a member surface is charged with a charge which is directly injected into the member from a contact charging member. This mechanism may also be called direct charging, injection charging or charge-injection charging. More specifically, a charging member of a medium resistivity is caused to contact a member-to-be-charged to directly inject charges to the member-to-be-charged basically without relying on a discharge phenomenon. Accordingly, a member can be charged to a potential corresponding to an applied voltage to the charging member even if the applied voltage is below a discharge threshold. This mechanism is not accompanied with occurrence of active ions, such as ozone, so that difficulties caused by discharge products can be obviated. However, based on the direct injection charging mechanism, the charging performance is affected by the contactivity of the contact charging member onto the member-to-be-charged. Accordingly, it is preferred that the charging member is provided with a more frequent contact and more dense points of contact with the member-to-be-charged.

As a contact charging device, a roller charging scheme using an electroconductive roller as a contact charging member is preferred because of the stability of charging performance and is widely used. During the contact charging according to the conventional roller charging scheme, the above-mentioned discharge charging mechanism (1) is predominant. A charging roller has been formed of a conductive or medium-resistivity rubber or foam material optionally disposed in lamination to provide desired characteristics.

Such a charging roller is provided with elasticity so as to ensure a certain contact with a member-to-be-charged, thus causing a large frictional resistance. The charging roller is moved following the movement of the member-to-be-charged or with a small speed difference with the latter. Accordingly, even if the direct injection charging is intended, the lowering in charging performance, and charging irregularities due to insufficient contact, contact irregularity due to the roller shape and attachment onto the member-to-be-charged, are liable to be caused.

FIG. 1 is a graph illustrating examples of charging efficiencies for charging photosensitive members by several contact charging members. The abscissa represents a bias voltage applied to the contact charging member, and the ordinate represents a resultant charged potential provided to the photosensitive member. The charging performance in the case of roller charging is represented by a line A. Thus, the surface potential of the photosensitive member starts to increase at an applied voltage exceeding a discharge threshold of ca. −500 volts. Accordingly, in order to charge the photosensitive member to a charged potential of −500 volts, for example, it is a general practice to apply a DC voltage of −1000 volts, or a DC voltage of −500 volts in superposition of an AC voltage at a peak-to-peak voltage of, e.g., 1200 volts, so as to keep a potential difference exceeding the discharge threshold, thereby causing the charged photosensitive member potential to be converged to a prescribed charged potential.

To describe based on a specific example, in a case where a charging roller is abutted against an OPC photosensitive member having a 25 μm-thick photosensitive layer, the surface potential of the photosensitive member starts to increase in response to an applied voltage of ca. 640 volts or higher and thereafter increases linearly at a slope of 1. The threshold voltage may be defined as a discharge inclination voltage Vth.

Thus, in order to obtain a photosensitive member surface potential Vd required for electrophotography, it is necessary to apply a DC voltage of Vd+Vth exceeding the required potential to the charging roller. Such a charging scheme of applying only a DC voltage to a contact charging member may be termed a "DC charging scheme".

In the DC charging scheme, however, it has been difficult to charge the photosensitive member to a desired potential, since the resistivity of the contact charging member is liable to change in response to a change in environmental condition, and because of a change in Vth due to a surface layer thickness change caused by abrasion of the photosensitive member.

For this reason, in order to achieve a more uniform charging, it has been proposed to adopt an "AC charging scheme" wherein a voltage formed by superposing a DC voltage corresponding to a desired Vd with an AC voltage having a peak-to-peak voltage in excess of 2×Vth is applied to a contact charging member as described in JP-A 63-149669. According to this scheme, the charged potential of the photosensitive member is converged to Vd which is a central value of the superposed AC voltage due to the potential smoothing effect of the AC voltage, whereby the charged potential is not affected by the environmental change.

In the above-described contact charging scheme, the charging mechanism essentially relies on discharge from the contact charging member to the photosensitive member, so that a voltage exceeding a desired photosensitive member surface potential has to be applied to the contact charging member and a small amount of ozone is generated.

Further, in the AC-charging scheme for uniform charging, ozone generation is liable to be promoted, a vibration noise (AC charging noise) between the contact charging member and the photosensitive member due to AC voltage electric field is liable to caused, and the photosensitive member surface is liable to be deteriorated due to the discharge, thus posing a new problem.

Fur brush charging is a charging scheme, wherein a member (fur brush charger) comprising a brush of electroconductive fiber is used as a contact charging member, and the conductive fiber brush in contact with the photosensitive member is supplied with a prescribed charging bias voltage to charge the photosensitive member surface to prescribed polarity and potential. In the fur brush charging scheme, the above-mentioned discharge charging mechanism (1) may be predominant.

As the fur brush chargers, a fixed-type charger and a roller-type charger have been commercialized. The fixed-type charger is formed by bonding a pile of medium-resistivity fiber planted to or woven together with a substrate to an electrode. The roller-type charger is formed by winding such a pile about a core metal. A fiber density of ca. 100/mm$^2$ can be relatively easily obtained, but even at such a high fiber density, the contact characteristic is insufficient for realizing sufficiently uniform charging according to the direct injection charging. In order to effect a sufficiently uniform charging according to the direct injection charging, it is necessary to provide a large speed difference between the fur brush charger and the photosensitive member.

An example of the charging performance according to the fur brush charging scheme under DC voltage application is represented by a line B in FIG. 1. Accordingly, in the cases of fur brush charging using any of the fixed-type charger and the roller-type charger, a high charging bias voltage is applied to cause a discharge phenomenon to effect the charging.

In contrast to the above-mentioned charging schemes, in a magnetic brush scheme, a charging member (magnet brush charger) obtained by constraining electroconductive magnetic particles in the form of a magnetic brush under a magnetic field exerted by a magnet roll is used as a contact charging member, and the magnetic brush in contact with a photosensitive member is supplied with a prescribed charging bias voltage to charge the photosensitive member surface to prescribed polarity and potential. In the magnetic brush charging scheme, the above-mentioned direct injection charging scheme (2) is predominant.

Uniform direct injection charging becomes possible, e.g., by using magnetic particles of 5–50 μm in particle size and providing a sufficient speed difference with the photosensitive member. An example of the charging performance according to the magnetic brush scheme under DC voltage application is represented by a line C in FIG. 1, thus allowing a charged potential almost proportional to the applied bias voltage.

The magnetic brush charging scheme is however accompanied with difficulties that the device structure is liable to be complicated, and the magnetic particles constituting the magnetic brush are liable to be liberated from the magnetic brush to be attached to the photosensitive member.

Now, the application of such a contact charging scheme to a development and simultaneous cleaning method or a cleanerless image forming method, is considered.

The development and simultaneous cleaning method or the cleanerless image forming method does not use a cleaning member, so that the transfer residual toner particles remaining on the photosensitive member are caused to contact the contact charging system wherein the discharge charging mechanism is predominant. If an insulating toner is attached to or mixed into the contact charging member, the charging performance of the charging member is liable to be lowered.

In the charging scheme wherein the discharge charging mechanism is predominant, the lowering in charging performance is caused remarkably from a time when the toner layer attached to the contact charging member surface provides a level of resistance obstructing a discharge voltage. On the other hand, in the charging scheme wherein the direct injection charging mechanism is predominant, the lowering in charging performance is caused as a lowering in chargeability of the member-to-be-charged due to a lowering in opportunity of contact between the contact charging member surface and the member-to-be-charged due to the attachment or mixing of the transfer residual toner particles into the contact charging member.

The lowering in uniform chargeability of the photosensitive member (member-to-be-charged) results in a lowering in contrast and uniformity of latent image after imagewise exposure, and a lowering in image density and increased fog in the resultant images. Further, in the development and simultaneous cleaning method or the cleanerless image forming method, it is important to control the charging polarity and charge of the transfer residual toner particles on the photosensitive member and stably recover the transfer residual toner particles in the developing step, thereby preventing the recovered toner from obstructing the developing performance. For this purpose, the control of the charging polarity and the charge of the transfer residual toner particles are effected by the charging member.

This is more specifically described with respect to an ordinary laser beam printer as an example. In the case of a reversal development system using a charging member supplied with a negative voltage, a photosensitive member having a negative chargeability and a negatively charged toner, the toner image is transferred onto a recording medium in the transfer step by means of a transfer member applying a positive voltage. In this case, the transfer residual toner particles are caused to have various charges ranging from a positive polarity to a negative polarity depending on the properties (thickness, resistivity, dielectric constant, etc.) of the recording medium and the image area thereon.

However, even if the transfer residual toner is caused to have a positive charge in the transfer step, the charge thereof can be uniformized to a negative polarity by the negatively charged charging member for negatively charging the photosensitive member. As a result, in the case of a reversal development scheme, the negatively charged residual toner particles are allowed to remain on the light-part potential where the toner is to be attached, and some irregularly charged toner attached to the dark-part potential is attracted to the toner carrying member due to a developing electric field relationship during the reversal development so that the transfer residual toner at the dark-part potential is not allowed to remain thereat but can be recovered. Thus, by controlling the charging polarity of the transfer residual toner simultaneously with charging of the photosensitive member by means of the charging member, the development and simultaneous cleaning or cleanerless image forming method can be realized.

However, if the transfer residual toner particles are attached to or mixed to the contact charging member in an amount exceeding the toner charge polarity-controlling capacity of the contact charging member, the charging polarity of the transfer residual toner particles cannot be uniformized so that it becomes difficult to recover the toner particles in the developing step. Further, even if the transfer residual toner particles are recovered by a mechanical force of rubbing, they adversely affect the triboelectric chargeability of the toner on the toner-carrying member if the charge of the recovered transfer residual toner particles has not been uniformized.

Thus, in the development and simultaneous cleaning or cleanerless image forming method, the continuous image-forming performance and resultant image quality are closely associated with the charge-controllability and attachment-mixing characteristic of the transfer residual toner particles at the time of passing by the charging member.

Further, JP-B 7-99442 discloses to apply powder on a surface of a contact charging member contacting the member-to-be-charged so as to prevent charging irregularity and stabilize the uniform charging performance. This system however adopts an organization of moving a contact charging member (charging roller) following the movement of the member-to-be-charged (photosensitive member) wherein the charging principle generally relies on the discharge charging mechanism simultaneously as in the above-mentioned cases of using a charging roller while the amount of ozone adduct has been remarkably reduced than in the case of using a corona charger, such as scorotron. Particularly, as an AC-superposed DC voltage is used for accomplishing a stable charging uniformity, the amount of ozone adducts is increased thereby. As a result, in the case of a continuous use of the apparatus for a long period, the defect of image flow due to the ozone products is liable to occur. Further, in case where the above organization is adopted in the cleanerless image forming apparatus, the attachment of the powder onto the charging member is obstructed by mixing with transfer-residual toner particles, thus reducing the uniform charging effect.

Further, JP-A 5-150539 has disclosed an image forming method using a contact charging scheme wherein a developer comprising at least toner particles and electroconductive particles having an average particle size smaller than that of the toner particles is used, in order to prevent the charging obstruction due to accumulation and attachment onto the charging member surface of toner particles and silica fine particles which have not been fully removed by the action of a cleaning blade on continuation of image formation for a long period. The contact charging or proximity charging scheme used in the proposal is one relying on the discharge charging mechanism and not based on the direct injection charging mechanism so that the above problem accompanying the discharge mechanism accrues.

Further, in case where the above organization is applied to a cleanerless image forming apparatus, larger amounts of electroconductive particles and toner particles are caused to pass through the charging step and have to be recovered in the developing step. No consideration on these matters or influence of such particles when such particles are recovered on the developing performance of the developer has been paid in the proposal. Further, in a case where a contact charging scheme relying on the direct injection charging scheme is adopted, the electroconductive fine particles are not supplied in a sufficient quantity to the contact charging member, so that the charging failure is liable to occur due to the influence of the transfer residual toner particles.

Further, in the proximity charging scheme, it is difficult to uniformly charge the photosensitive member in the presence of large amounts of electroconductive fine particles and transfer residual toner particles, thus failing to achieve the effect of removing the pattern of transfer residual toner particles. As a result, the transfer residual toner particles interrupt the imagewise exposure pattern light to cause a toner particle pattern ghost. Further, in the case of instantaneous power failure or paper clogging during image formation, the interior of the image forming apparatus can be remarkably soiled by the developer.

In order to improve the charge control performance when the transfer residual toner particles are passed by the charging member in the development and simultaneous cleaning method, JP-A 11-15206 has proposed to use a toner comprising toner particles containing specific carbon black and a specific azo iron compound in mixture with inorganic fine powder. Further, it has been also proposed to use a toner having a specified shape factor and an improved transferability to reduce the amount of transfer residual toner particles, thereby improving the performance of the development and simultaneous cleaning image forming method. This image forming method however relies on a contact charging scheme based on the discharge charging scheme and not on the direct injection charging scheme, so that the system is not free from the above-mentioned problems involved in the discharge charging mechanism. Further, these proposals may be effective for suppressing the charging performance of the contact charging member due to transfer residual toner particles but cannot be expected to positively enhance the charging performance.

Further, among commercially available electrophotographic printers, there is a type of development and simultaneous cleaning image forming apparatus including a roller member abutted against the photosensitive member at a position between the transfer step and the charging step so as to supplement or control the performance of recovering transfer residual toner particles in the development step. Such an image forming apparatus may exhibit a good development and simultaneous cleaning performance and remarkably reduce the waste toner amount, but liable to result in an increased production cost and a difficulty against the size reduction.

JP-A 10-307456 has disclosed an image forming apparatus adapted to a development and simultaneous cleaning image forming method based on a direct injection charging mechanism and using a developer comprising toner particles and electroconductive charging promoter particles having particle sizes smaller than ½ of the toner particle size. According to this proposal, it becomes possible to provide a development and simultaneous cleaning image forming apparatus which is free from generation of discharge product, can remarkably reduce the amount of waste toner and is advantageous for producing inexpensively a small size apparatus. By using the apparatus, it is possible to provide good images free from defects accompanying charging failure, and interruption or scattering of imagewise exposure light. However, a further improvement is desired.

Further, JP-A 10-307421 has disclosed an image forming apparatus adapted to a development and simultaneous cleaning method, based on the direct injection charging mechanism and using a developer containing electroconductive particles having sizes in a range of 1/50–½ of the toner particle size so as to improve the transfer performance.

JP-A 10-307455 discloses the use of electroconductive fine particles having a particle size of 10 nm–50 μm so as to reduce the particle size to below one pixel size and obtain a better charging uniformity.

JP-A 10-307457 describes the use of electroconductive particles of at most about 5 μm, preferably 20 nm –5 μm, so as to bring a part of charging failure to a visually less recognizable state in view of visual characteristic of human eyes.

JP-A 10-307458 describes the use of electro-conductive fine powder having a particle size smaller than the toner particle size so as to prevent the obstruction of toner development and the leakage of the developing bias voltage via the electroconductive fine powder, thereby removing image defects. It is also disclosed that by setting the particle size of the electroconductive fine powder to be larger than 0.1 μm, the interruption of exposure light by the electroconductive fine powder embedded at the surface of the image-bearing member is prevented to realize excellent image formation by a development and simultaneous cleaning method based on the direct injection charging scheme.

JP-A 10-307456 has disclosed a development and simultaneous cleaning image forming apparatus capable of forming good images without causing charging failure or interruption of imagewise exposure light, wherein electroconductive fine powder is externally added to a toner so that the electroconductive powder is attached to the image-bearing member during the developing step and allowed to remain on the image-bearing member even after the transfer step to be present at a part of contact between a flexible contact charging member and the image-bearing member.

These proposals however have left a room for further improvement regarding the stability of performance during repetitive use for a long period and performance in the case of using smaller size magnetic toner particles in order to provide an enhanced resolution.

Further, as such members-to-be-charged, electrophotographic photosensitive members comprising an OPC (organic photoconductor) or an amorphous silicon (sometimes referred to as "a-Si") are known.

An OPC photosensitive member has a serious difficulty in wear resistance and durability, and a countermeasure thereto is urgently desired. Including the OPC photosensitive member, currently commercially available photosensitive members for use in image forming apparatus are not necessarily satisfactory in all respects of sensitivity, durability, image quality and anti-pollution characteristic, and the weak points of respective photosensitive members have been compensated by toner designing or process designing to provide commercially acceptable image forming apparatus on the market.

An a-Si photosensitive member has a high sensitivity over an entire visible wavelength region and is therefor compatible with a semiconductor laser and color image formation. Further, it has a high surface hardness as represented by a Vickers hardness of 1500–2000 kg-f/mm$^2$ and allows a long life as represented by $5\times10^5$ to $10^6$ or an even larger member of sheets. An a-Si Photosensitive member also has a heat resistance sufficient in practical use of image forming apparatus.

It is generally said that an a-Si photoconductor layer has a dark-part surface potential corresponding to its layer thickness. Currently commercialized photosensitive members include CdS-photosensitive members showing a dark-part surface potential of at least 500 volts, and Se-photosensitive member and OPC-photosensitive member showing dark-part surface potentials of at least 600–800 volts. In order to realize such a level of surface potential with an a-Si photoconductor layer, the layer thickness has to be increased.

In contrast thereto, in order to provide satisfactory productivity and production costs of a-Si photosensitive member and also satisfactory performances thereof, it has been proposed to form a photosensitive member having a smaller thickness of a-Si photoconductor layer, which however necessitates the selective use of a toner allowing a low developing potential. This is because a lower thickness of a-Si layer results in a lower surface potential then an OPC photosensitive member while it favors production cost and capacity and photosensitivity.

Accordingly, in order to use an a-Si photosensitive member commercially satisfactorily, it is necessary to use a toner having a high developing performance. It is also necessary to control the surface property of such a small-thickness a-Si layer for providing high image quality and high durability.

a-Si photosensitive members comprising a non-single crystal deposition film principally comprising silicon as represented by a-Si and containing, e.g., hydrogen and/or a halogen, such as fluorine or chlorine, for compensating for hydrogen or dangling bond's have been proposed as a high-performance, high-durability and non-polluting photosensitive member, and several embodiments thereof have been commercialized. More specifically, U.S. Pat. No. 4,265,991 and JP-A 54-86341 have disclosed an electrophotographic photosensitive member including a photoconductor layer principally comprising a-Si. JP-A 60-12554 has disclosed a photosensitive member including a photoconductor layer comprising amorphous silicon and a surface layer containing carbon and halogen atoms. JP-A 2-111962 has disclosed a photosensitive member including a photosensitive layer of a-Si:H or a-C:H and a surface-protecting lubrication layer. These publications are all directed to provision of a photosensitive member with improved water-repellency and wear resistance and do not relate to improvements in magnetic toner and electrophotography process in combination with such a-Si photosensitive members.

SUMMARY OF THE INVENTION

An object of the present invention is to provide an image forming system (i.e., method and apparatus) which includes the use of a magnetic toner showing a stabling uniform chargeability regardless of environmental conditions and an amorphous or non-single crystal silicon photosensitive member and can provide fog-free images at high image density, good transferability and good image reproducibility for a long period of use.

Another object of the present invention is to provide an image forming system capable of stably providing good images without including an independent cleaning means.

A further object of the present invention is to provide an image forming system capable of preventing the generation of discharge products, remarkably reducing the amount of waste toner and providing good images free from charging failure even in a long period of repetitive image formation without including an independent cleaning means, thus providing an inexpensive and small-sized image forming system.

According to the present invention, there is provided an image forming method, comprising:

a charging step of charging an image-bearing member by charging means comprising a charging member supplied with a voltage and abutted against the image-bearing member at a contact position;

a latent-image forming step of forming an electrostatic latent image on the charged image-bearing member, a developing step of transferring a magnetic toner carried on a toner-carrying member onto the electrostatic latent image to develop the latent image, thereby forming a magnetic toner image on the image-bearing member, and a transfer step of electrostatically transferring the magnetic toner image on the image-baring member onto a transfer material via or without via an intermediate transfer member, wherein the image-bearing member comprises an electroconductive support and a photoconductor layer comprising a silicon-based non-single crystal material and disposed on the electroconductive support, and is charged to a potential of 250 to 600 volts in terms of an absolute value via the charging member abutted against it, the magnetic toner includes magnetic toner particles comprising at least a binder resin and a magnetic iron oxide, and inorganic fine powder and electroconductive fine powder present at the surface of the magnetic toner particles, the magnetic toner has a weight-average particle size of 3–10 μm, the magnetic toner has an average circularity of 0.950 to 0.995, and the magnetic toner contains 0.05 to 3.00% of isolated iron-containing particles.

The present invention further provides an image forming apparatus, comprising: an image-bearing member, a charging means for charging the image-bearing member, an electrostatic latent-image forming means for forming an electrostatic latent image on the charged image-bearing member, a developing means including a toner-carrying member for transferring a magnetic toner carried on the toner-carrying member onto the electrostatic latent image to form a toner image thereon, and a transfer means for electrostatically transferring the toner image on the image-bearing member onto a transfer material, wherein the charging means comprises a charging member supplied with a voltage and abutted against the image-bearing member to form a contact nip with the image-bearing member, the image-bearing member comprises an electroconductive support and a photoconductor layer comprising a silicon-based non-single crystal material and disposed on the electroconductive support, and is charged to a potential of 250 to 600 volts in terms of an absolute value via the charging member abutted against it, the magnetic toner includes magnetic toner particles comprising at least a binder resin and a magnetic iron oxide, and inorganic fine powder and electroconductive fine powder present at the surface of the magnetic toner particles, the magnetic toner has a weight-average particle size of 3–10 μm, the magnetic toner has an average circularity of 0.950 to 0.995, and the magnetic toner contains 0.05 to 3.00% of isolated iron-containing particles.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
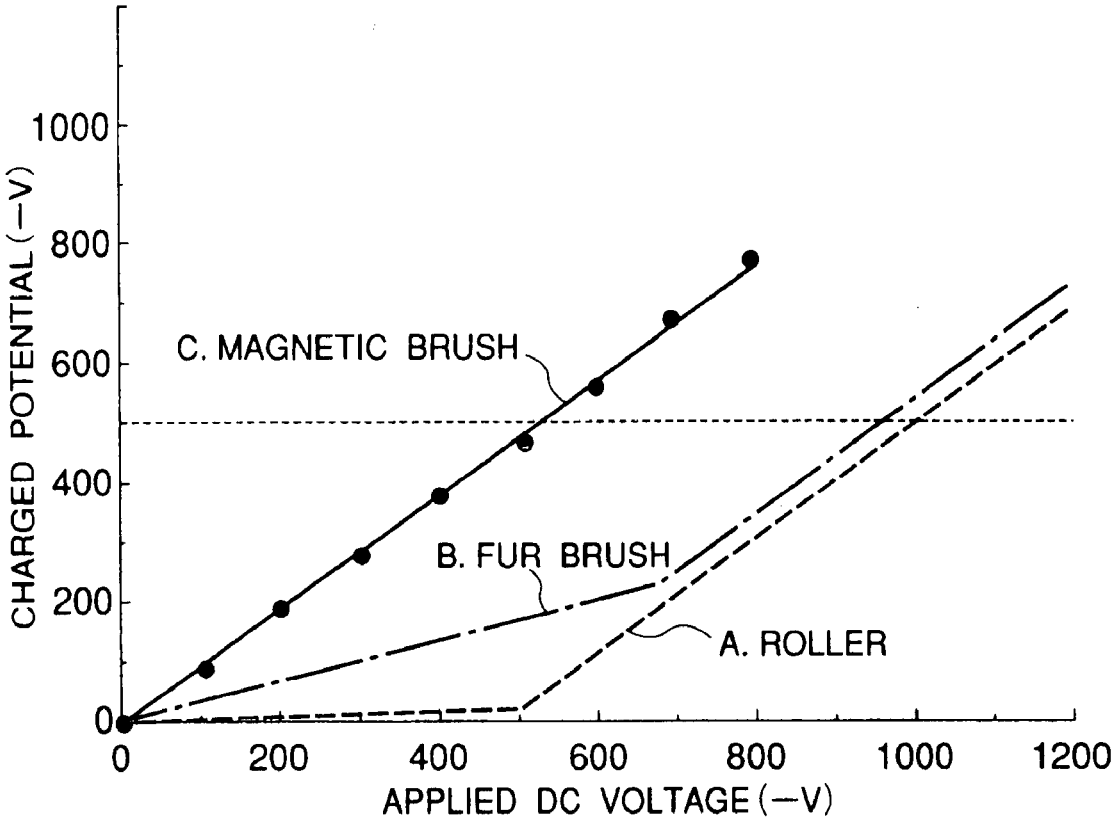
FIG. 1 is a graph showing charging performances of several contact charging means.

For the purpose of uniformizing and stabilizing the chargeability of an image-bearing member for a long period in the image forming system of the present invention, it is important to satisfy a specific percentage of iron-containing isolated particles in the magnetic toner, and a specific relationship of material and charged potential of the image-bearing member.

The iron-containing isolated particles (comprising iron or an iron compound) in the magnetic toner used in the present invention are originated from magnetic iron oxide particles used as magnetic powder in the magnetic toner and play an important role for uniformizing and stabilizing the chargeability of the image-bearing member together with electroconductive fine powder externally added to the magnetic toner particles. Isolated magnetic iron oxide particles exhibit a low resistivity and a weak chargeability and also a property of abrading a member contacting the particles because of a high hardness thereof. On the other hand, the image-bearing member has a photoconductor layer formed of a silicon-based non-single crystal material, so that it exhibits a high surface free energy and has a tendency of showing a strong interaction with inorganic (fine) particles. The magnetic iron oxide particles thus attached to the image-bearing member surface function to enhance the injection charging performance in the charging step, and abrade the image-bearing member at the contact nip between the charging member, thereby refreshing the image-bearing member surface to retain the charging uniformity for a long period.

If the image-bearing member is charged to a surface potential of 250 to 600 volts and the isolated magnetic iron oxide particles are contained in a percentage of 0.05 to 3.00% by number of the toner particles), the magnetic iron oxide particles and electroconductive fine powder are supplied at an appropriate rate from the magnetic toner to the surface of the photoconductor layer comprising a silicon (Si)-based non-single crystal material and removed at an appropriate rate from the photoconductor layer surface, so that the amounts of the magnetic iron oxide particles and electroconductive fine powder on the photoconductor layer surface are stabilized to further stabilize the injection charging performance in the charging step and suppress the abrasion irregularity on the image-bearing member surface leading to non-uniform chargeability.

Herein, the "non-single crystal material" constituting a surface or photoconductor layer of the image-bearing is principally in an amorphous state but can contain a minor proportion of microcrystalline or polycrystalline material unlike a single-crystal material as is understood from representative processes for production of such a photoconductor or surface layer described hereinafter. The term "silicon-based" means that the material comprises silicon as a principal element.

To describe more fully the composition of the magnetic toner used in the present invention, it is important that the magnetic toner includes magnetic toner particles comprising at least a binder resin and a magnetic iron oxide, and inorganic fine powder and electroconductive fine powder present at the surface of the magnetic toner particles; has an average circularity of 0.950 to 0.995; and contains 0.05 to 3.00% of isolated iron-containing particles.

If the magnetic toner has an average circularity of at least 0.950, the surface unevenness of the magnetic toner particles is alleviated to some extent so that inorganic fine powder and electroconductive fine powder as other components of the magnetic toner of the present invention can be uniformly attached to the magnetic toner particle surfaces, thus providing a level of flowability suitable for use in an electrophotographic process. Below 0.950, a sufficient flowability is liable to be failed in some cases.

In the image forming system of the present invention, in the case where the developing step (or means) is also used as a step (or means) for recovering residual toner on the image-bearing member, the electroconductive fine powder behaves separately from the toner particles and is supplied to the charging step to promote the charging of the image-bearing member. In this instance, if the toner has an average circularity below 0.950, the effective supply of the electroconductive fine powder from the toner to the charging step is liable to be hindered.

A higher circularity of toner tends to improve the image forming performances, and an average circularity of 0.970 or higher is preferred.

A toner comprising toner particles having an average circularity of 0.970 or higher exhibits a very excellent transferability. This is presumably because in such a magnetic toner having a high circularity, the magnetic toner particles are cause to have a small contact area with the photosensitive member, thus resulting in a small force of attachment force attributable to image force and van der Waals force onto the photosensitive member. As a result of a high transferability. The amount of transfer residual toner is reduced, and the amount of the magnetic toner present at the pressure nip between the charging member and the photosensitive member is reduced to prevent the occurrence of toner attachment onto the photosensitive member, thus remarkably reducing image defects.

Further, magnetic toner particles having an average circularity of at least 0.970 are almost free from surface edges to reduce the friction at the pressure nip between the charging member and the photosensitive member, to suppress the abrasion of the photosensitive member surface. These effects are particularly pronounced in an image forming method including a contact transfer step liable to cause a hollow transfer image dropout. It is particularly preferred that the magnetic toner has a mode circularity of at least 0.990 meaning that particles having a circularity of at least 0.990 are predominant since the effect can be insufficient in some cases if predominant particles have a low circularity even if the average circularity is high.

If the magnetic toner satisfies preferable features having an average circularity of at least 0.970 and a mode circularity of 0.990, toner ears formed on the toner-carrying member become fine and dense to provide a uniform charge, so that fog is remarkably reduced.

The average circularity and mode circularity are used as quantitative measures for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3.0 μm) is determined according to an equation (1) below, and the circularity values (Ci) are totaled and divided by the number of total particles (m) to determine an average circularity (Ca) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity } (Ca) = \sum_{i=1}^{m} Ci/m \tag{2}$$

Further, the mode circularity (Cmod) is determined by allotting the measured circularity values of individual toner particles to 61 classes in the circularity range of 0.40–1.00, i.e., from 0.400–0.410, 0.410–0.420, . . . , 0.990–1.000 (for each range, the upper limit is not included) and 1.000, and taking the circularity of a class giving a highest frequency as a mode circularity (Cmod).

Incidentally, for actual calculation of an average circularity (Ca), the measured circularity values (Ci) of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (Ca) is substantially identical to an average circularity value obtained (according to Equation (2) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/μl. The sample dispersion liquid is subjected to the FPIA analysis for measurement of the average circularity (Ca) and mode circularity (Cm) with respect to particles having $D_{CE} \geqq 3.0$ μm.

The average circularity (Ca) used herein is a measure of roundness, a circularity of 1.00 means that the magnetic toner particles have a shape of a perfect sphere, and a lower circularity represents a complex particle shape of the magnetic toner.

Herein, only particles having a circle-equivalent diameter ($D_{CE}=L/\pi$) of at least 3 μm are taken for the circularity measurement because particles smaller than 3 μm include a substantial amount of external additives and the inclusion of such particles can distort the circularity characteristic of magnetic toner particles.

A magnetic toner having an average circularity (Ca) of at least 0.950, preferably at least 0.970 and a mode circularity (Cmod) of at least 0.990 exhibits a remarkably improved transferability even at a small particle size, which has provided a difficulty in providing an improved transferability, and also exhibits a remarkably improved developing performance for a low-potential latent image. It is particularly effective for development of digital minute spot latent images. This means that the magnetic toner exhibits a good matching with a non-single crystal (or roughly amorphous) silicon photosensitive member used in the image forming system of the present invention.

If the average circularity (Ca) is below 0.950, the magnetic toner not only exhibits a lower transferability but also can exhibit a lower developing performance. On the other hand, if the average circularity exceeds 0.995, the toner surface deterioration becomes noticeable, thus posing a problem in durability.

Next, the percentage of isolated iron-containing particles will be described. The isolated iron-containing particles are particles of iron or iron compound (typically magnetic iron oxide particles) isolated from magnetic toner particles. The isolation percentage can also be determined by observation through, e.g., a scanning electron microscope but may conveniently be determined by plasma-induced particle luminescence spectra. In the latter measurement method, the percentage of isolated iron-containing particles (Fe.iso (%)) is determined based on the frequency of atomic luminescence (abbreviated as "AL") of Fe separate or simultaneous with C (carbon) atomic luminescence and calculated according to the following formula:

$$\text{Fe.}iso\ (\%)=100\times\{\text{number of } AL \text{ of Fe alone}\}/\{(\text{number of } AL \text{ of Fe simultaneous with } AL \text{ of C})+(\text{number of } AL \text{ of Fe alone})\}$$

In this instance, AL of Fe is regarded as simultaneous if it occurs within 2.6 m.sec from AL of C, and regarded as separate if it occurs thereafter.

In the case of a magnetic toner particle containing magnetic iron oxide particles, the simultaneous luminescences of carbon atom and iron atom means a luminescence from a toner particle containing magnetic iron oxide dispersed therein, and the luminescence of only iron atom means a luminescence from an isolated iron-containing particle.

In the plasma-induced luminescence measurement method, fine particles like toner particles are introduced into plasma, particle by particle, to determine an element and a particle size of a luminescent particle from its luminescence spectrum. For example, in the case where a magnetic toner particle is introduced into plasma, each toner particle causes one luminescence of carbon (constituting the binder resin) and one luminescence of iron (constituting the magnetic iron oxide) which can be respectively observed. As one toner particle causes one luminescence, the number of toner particles can be determined based on the number of observed luminescences (C with Fe). The measurement may be performed by using, e.g., a particle analyzer ("PT1000", made by Yokogawa Denki K.K.) according to a principle described in Japan Hardcopy '97 Paper Collection, pp. 65–68.

More specifically, for the measurement, a sample toner left standing overnight in an environment of 23° C. and 60% RH is subjected to measurement together with 0.1% $O_2$-containing helium gas in the above environment. For spectrum separation, Channel 1 detector is used for carbon atom (at wavelength of 247.86 nm, with a recommended value of K factor) and Channel 2 detector is used for iron atom (at wavelength of 239.56 nm, with K factor of 3.3764). Sampling is performed at a rate of one scan for covering 1000–1400 times of luminescence of carbon atom, and the sampling is repeated until the luminescences of carbon atom reaches at least 10,000 times. By integrating the luminescences, a particle size distribution curve is drawn with the number of luminescences taken on the ordinate and with the cube root of voltage representing a particle size on the abscissa, while effecting the sampling so that the particle size distribution curve exhibits a single peak and no valley. Based on the measured data while taking noise cut level during the measurement at 1.50 volts, Fe.iso (%) is calculated according to the above formula.

Incidentally, an azo-iron compound as a charge control agent may be contained in a toner in some cases, but the azo iron compound is an organometallic compound, so that it cannot result in a luminescence of only iron atom.

As a result of our study, there is found a close correlation between the percentage of isolated iron-containing particles (Fe.iso (%)) and the rate of exposure of magnetic iron oxide particles at the toner particle surfaces. More specifically, if Fe.iso (%) is at most 3.00%, the exposure at the toner particle surfaces of magnetic iron oxide particles is suppressed to provide a high chargeability. This is attributable to the uniformity of particle size distribution of the magnetic iron oxide particles and uniformity of surface treatment of the magnetic iron oxide particles. For example, in case where the surface treatment of the magnetic iron oxide particles is ununiform, magnetic iron oxide fine particles having a high hydrophillicity due to insufficient surface treatment are exposed to the toner particle surface, and a portion or all of them can be isolated from the toner particles.

Accordingly, a magnetic toner containing a lower percentage of isolated iron-containing particles tends to show a higher chargeability. On the other hand, if Fe.iso (%) is higher than 3.00%, the charge-leakage points are increased, thus being liable to result in a magnetic toner having an insufficient chargeability. This tendency becomes particularly remarkable in a high temperature/high humidity environment. A magnetic toner having a low chargeability is not desirable because it causes increased fog, causes a lower transferability and is liable to cause charging failure. Further, a magnetic toner satisfying both a high average circularity and a low percentage of isolated iron-containing particles can acquire a high chargeability and also a very high transferability as a result of synergy with the toner particle shape.

On the other hand, an Fe-iso (%) of below 0.05% means that substantially no magnetic iron oxide particles are isolated from the magnetic toner particles. Such a magnetic toner having a low Fe.iso (%) has a high chargeability but is liable to cause an excessive charge resulting in images having a low image density and accompanied with roughening, in image formation on a large number of sheets, particularly in a low temperature/low humidity environment. This is presumably because of the following mechanism.

A magnetic toner carried on a toner-carrying member is not wholly transferred for development onto the photosensitive member, but some magnetic toner remains on the toner-carrying member even immediately after the development. This tendency is particularly noticeable in the jumping developing mode using a magnetic toner. Further, magnetic toner particles having a high circularity form uniformly thin ears in the developing regions, and toner particles present at the tips of ears are used for development and toner particles present close to the toner-carrying member are not readily consumed for the development.

As a result, the magnetic toner particles close to the toner carrying member are liable to be excessively charged due to repetitive triboelectrification with the charging members, and the transfer for development thereof becomes further difficult. In such a state, the charge uniformity of the magnetic toner is impaired, to result in rough images.

Now, if a magnetic toner having Fe.iso (%)≧0.05% is used, the excessive charge of the magnetic toner is suppressed due to the isolated magnetic iron oxide particles and magnetic iron oxide particles present at the toner particle surfaces, and the charge uniformity of the magnetic toner is promoted to suppress the roughening of images.

As a result, even for a magnetic toner having a high circularity and a high chargeability, the excessive charge (charge-up phenomenon) in a long-term use can be alleviated if the exposed magnetic iron oxide particles are present, so that Fe.iso (%) of at least 0.05% is important.

For the above reason, Fe.iso (%) of 0.05%–3.00% is necessary. Fe.iso (%) is preferably 0.05–2.00%, more preferably 0.05–1.50%, further preferably 0.05–0.80%.

The magnetic toner used in the present invention may preferably comprise magnetic toner particles produced through the polymerization process. The magnetic toner particles can be produced through the pulverization process, but the magnetic toner particles produced through the pulverization process are generally indefinitely shaped and have to be mechanically or thermally treated in order to have an average circularity of at least 0.950 as an essential requirement, or a preferable circularity of at least 0.970 (and also a preferred mode circularity of at least 0.990).

Thus, in the present invention, the magnetic toner particles may preferably be produced through the polymerization process, examples of which may include: direct polymerization, suspension polymerization, emulsion polymerization, emulsion-association polymerization and seed polymerization. Among these, the suspension polymerization process is particularly preferred in order to easily provide a good balance of particle size and particle shape.

In the suspension polymerization process for producing a magnetic toner according to the present invention, a monomeric mixture is formed by uniformly dissolving or dispersing a monomer and magnetic powder (fine particles) (and, optionally, other additives, such as wax, a colorant, a crosslinking agent and charge control agent), followed by dispersing the monomeric mixture in an aqueous medium containing a dispersion stabilizer by means of an appropriate stirrer, and subjecting the dispersed monomeric mixture to suspension polymerization in the presence of a polymerization initiator to obtain toner particles of a desirable particle size.

The magnetic polymerization toner polymerized through the suspension polymerization process is caused to comprise individual toner particles having a uniformly spherical shape, so that it is easy to obtain a toner having a circularity of at least 0.970 as a preferred physical requirement of the present invention, and further such a magnetic toner has a relatively uniform chargeability distribution, thus exhibiting a high transferability.

However, by using a monomeric mixture containing ordinary magnetic powder at the time of suspension polymerization, it is difficult to suppress the exposure of the magnetic powder to the resultant toner particle surface, the resultant toner particles are liable to have remarkably lower flowability and chargeability, and also it is difficult to obtain a magnetic toner having a desirable circularity because of strong interaction between the magnetic powder and water. This is (1) because magnetic powder particles are generally hydrophillic, thus being liable to be localized at the toner particle surfaces, and (2) because at the time of suspension of the monomeric mixture in an aqueous medium or at the time of stirring the suspension liquid during the polymerization, the magnetic powder is moved at random within the suspended liquid droplets and the suspended liquid droplet surfaces comprising the monomer are pulled by the randomly moving magnetic powder, thereby distorting the liquid droplets from spheres. In order to solve such problems, it is important to modify the surface property of the magnetic iron oxide powder.

As for magnetic powder used in the magnetic toner of the present invention, it is extremely preferred that the magnetic iron oxide particles are surface-treated for hydrophobization by dispersing magnetic iron oxide particles in an aqueous medium into primary particles thereof, and while maintaining the primary particle dispersion state, hydrolyzing a coupling agent in the aqueous medium to surface-coat the magnetic iron oxide particles. According to this hydrophobization method in an aqueous medium, the magnetic iron oxide particles are less liable to coalesce with each other than in a dry surface-treatment in a gaseous system, and the magnetic iron oxide particles can be surface-treated while maintaining the primary particle dispersion state due to electrical repulsion between hydrophobized magnetic iron oxide particles.

The method of surface-treatment of magnetic iron oxide particles with a coupling agent while hydrolyzing the coupling agent in an aqueous medium does not require gas-generating coupling agents, such as chlorosilanes or silazanes, and allows the use of a high-viscosity coupling agent which has been difficult to use because of frequent coalescence of magnetic iron oxide particles in a conventional gaseous phase treatment, thus exhibiting a remarkable hydrophobization effect.

As a coupling agent usable for surface-treating the magnetic iron oxide particles used in the present invention, a silane coupling agent or a titanate coupling agent may be used. A silicone coupling agent is preferred, and examples thereof may be represented by the following formula (I):

$$R_m SiY_n \quad (I),$$

wherein R denotes an alkoxy group, Y denotes a hydrocarbon group, such as alkyl, vinyl, glycidoxy or methacryl, and m and n are respectively integers of 1–3 satisfying m+n=4.

Examples of the silane coupling agents represented by the formula (I) may include: vinyltrimethoxysilane, vinyltriethoxysilane, gamma-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is particularly preferred to use an alkyltrialkoxysilane coupling agent represented by the following formula (II) to treat the magnetic powder for hydrophobization in an aqueous medium:

$$C_pH_{2p+1}—Si—(OC_qH_{2q+1})_3 \quad (II),$$

wherein p is an integer of 2–20 and q is an integer of 1–3.

In the above formula (II), if p is smaller than 2, the hydrophobization treatment may become easier, but it is difficult to impart a sufficient hydrophobicity, thus making it difficult to suppress the exposure of the magnetic powder to the toner particle surfaces. On the other hand, if p is larger than 20, the hydrophobization effect is sufficient, but the coalescence of the magnetic powder particles becomes frequent, so that it becomes difficult to sufficiently disperse the treated magnetic powder particles in the toner, thus being liable to result in a toner exhibiting lower fog-prevention effect and transferability.

If q is larger than 3, the reactivity of the silane coupling agent is lowered, so that it becomes difficult to effect sufficient hydrophobization.

It is particularly preferred to use an alkyltrialkoxysilane coupling agent represented by the formula (II) wherein p is an integer of 3–15, and q is an integer of 1 or 2.

The coupling agent may preferably be used in 0.05–20 wt. parts, more preferably 0.1–10 wt. parts, per 100 wt. parts of the magnetic powder.

Herein, the term "aqueous medium" means a medium principally comprising water. More specifically, the aqueous medium includes water alone, and water containing a small amount of surfactant, a pH adjusting agent or/and an organic solvent.

As the surfactant, it is preferred to use a nonionic surfactant, such as polyvinyl alcohol. The surfactant may preferably be added in 0.1–5 wt. parts per 100 wt. parts of water. The pH adjusting agent may include an inorganic acid, such as hydrochloric acid. The organic solvent may include methanol which may preferably be added in a proportion of 0–500 wt. % of water.

For the surface-treatment of magnetic iron oxide particles with a coupling agent in an aqueous medium, appropriate amounts of magnetic iron oxide particles and coupling agent may be stirred in an aqueous medium. It is preferred to effect the stirring by means of a mixer having stirring blades, e.g., a high-shearing force mixer (such as an attritor or a TK homomixer) so as to disperse the magnetic iron oxide particles into primary particles in the aqueous medium under sufficient stirring.

The thus-surface treated magnetic iron oxide is free from particle agglomerates and individual particles are uniformly surface-hydrophobized. Accordingly, the magnetic powder is uniformly dispersed in polymerization toner particles to provide almost spherical polymerization toner particles free from surface-exposure of the magnetic iron oxide. As a result, by using such magnetic iron oxide particles, it becomes possible to provide a magnetic toner having $Ca \geqq 0.970$, $Cmod \geqq 0.990$ and $Fe.iso\ (\%) \leqq 1.50\%$.

If such a magnetic toner is used in the image forming method of the present invention, the abrasion of and toner melt-attachment onto the photosensitive member are further effectively suppressed, and it becomes possible to form high-quality images stably even in a low humidity environment.

Further, while the magnetic toner has a uniformly high chargeability due to presence of little or no surface-exposed magnetic iron oxide, the magnetic toner can provide good image during image formation on a large number of sheets in a low temperature/low humidity environment due to the presence of electroconductive fine powder at the magnetic toner particle surfaces.

It is preferred that the magnetic toner used in the present invention contains a wax as described below in a proportion of 0.1–20 wt. % thereof.

In the image forming method, a magnetic toner image transferred onto a transfer(-receiving) material, such as paper, is thereafter fixed onto the transfer material by application of energy, such as heat and/or pressure, to provide a semipermanently fixed image. In this instance, a heat-pressure fixing scheme, such as a hot roller-fixing scheme, is frequently adopted.

By using a weight-average particle size of at most 10 μm, it is possible to obtain a very high-definition image, but such a small-particle size magnetic toner particles are liable to be buried between fibers of paper as a typical transfer medium and fail to receive sufficient heat, thus being liable to cause low-temperature offset. However, by including an appropriate amount of a wax as a release agent, the magnetic toner used in the present invention can satisfy both a high resolution and anti-offset characteristic as well as prevention of abrasion of the photosensitive member.

Examples of waxes usable in the magnetic toner used in the present invention may include: petroleum waxes and derivatives thereof, such as paraffin wax, microcrystalline wax and petrolactum; montan wax and derivatives thereof; hydrocarbon wax by Fischer-Tiropsch process and derivative thereof; polyolefin waxes as represented by polyethylene wax and derivatives thereof; and natural waxes, such as carnauba wax and candelilla wax and derivatives thereof. The derivatives may include oxides, block copolymers with vinyl monomers, and graft-modified products. Further examples may include: higher aliphatic alcohols, fatty acids, such as stearic acid and palmitic acid, and compounds of these, acid amide wax, ester wax, ketones, hardened castor oil and derivatives thereof, vegetable waxes and animal waxes.

Among such waxes, it is preferred to use a wax showing a maximum heat-absorption peak in a temperature range of 40–110° C., more preferably 45–90° C., in the course of temperature increase on a DSC cure measured by using a differential scanning calorimeter. The inclusion of a wax having a maximum heat-absorption peak in the above-mentioned temperature range, contributes to improvements in low-temperature fixability and effective releasability. If the maximum heat-absorption peak temperature (Tabs.max) is below 40° C., the wax is liable to exhibit only a weak self-cohesion, thus lowering the anti-high-temperature offset characteristic. On the other hand, if Tabs.max exceeds 110° C., the fixation temperature is raised so that low-temperature offset is liable to occur. Further, in the case of production of magnetic toner particles by particle formation and polymerization in an aqueous medium, the wax is liable to precipitate during the particle formation.

The maximum heat-absorption peak temperature (Tabs.max) of a wax may be measured by using a differential scanning calorimeter (DSC) (e.g., "DSC-7", available from Perkin-Elmer Corp.) according to ASTM D3418-8. Temperature correction of the detector may be effected based on melting points of indium and zinc, and calorie correction may be effected based on heat of fusion of indium. For the measurement, a sample is placed on an aluminum pan and subjected to heat at an increasing rate of 10° C./min in parallel with a blank aluminum pan as a control.

The magnetic toner used in the present invention may preferably contain such a wax in a proportion of 0.1–20 wt. % of the entire magnetic toner. Below 0.1 wt. %, the low-temperature offset-suppression effect is lowered, and above 20 wt. %, the long-term storability is lowered and the dispersibility of the other toner ingredients becomes lowered to result in lower flowability and image forming performances of the resultant magnetic toner.

The magnetic toner used in the present invention can further contain a charge control agent so as to stabilize the chargeability. Known charge control agents can be used. It is preferred to use a charge control agent providing a quick charging speed and stably providing a constant charge. In the case of polymerization toner production, it is particularly preferred to use a charge control agent showing low polymerization inhibition effect and substantially no solubility in aqueous dispersion medium.

Specific examples of negative charge control agents may include: metal compounds of aromatic carboxylic acids, such as salicylic acid, alkylsalicylic acids, dialkylsalicylic acids, naphthoic acid, and dicarboxylic acids; metal salts or metal complexes of azo-dyes and azo pigments; polymeric compounds having a sulfonic acid group or carboxylic acid group in side chains; boron compounds, urea compounds, silicon compounds, and calixarenes.

Positive charge control agents may include: quaternary ammonium salts, polymeric compounds having such quaternary ammonium salts in side chains, quinacridone compounds, nigrosine compounds and imidazole compounds.

The charge control agent may be included in the toner by internal addition or external addition to the toner particles. The amount of the charge control agent can vary depending on toner production process factors, such as binder resin species, other additives and dispersion methods, but may preferably be 0.1–10 wt. parts, more preferably 0.1–5 wt. parts, per 100 wt. parts of the binder resin.

In the case of providing a negatively chargeable magnetic toner, it is preferred to add a metal salt or a metal complex of an azo dye or an azo pigment.

However, it is not essential for the magnetic toner used in the present invention to contain a charge control agent, but the toner need not necessarily contain a charge control agent by positively utilizing the triboelectrification with a toner layer thickness-regulating member and a toner-carrying member.

Next, description will be made on the magnetic iron oxide and the binder resin contained in the magnetic toner particles.

The magnetic toner particles contain at least particles of a magnetic iron oxide, such as magnetite, maghemite, or ferrite.

The magnetic iron oxide particles may preferably have a BET specific surface area ($S_{BET}$) of 2–30 $m^2/g$, more preferably 3–28 $m^1/g$, as measured according to nitrogen-adsorption, and a Mohs' hardness of 5–7.

For providing the magnetic toner used in the present invention, the magnetic iron oxide particles may preferably be used in 10–200 wt. parts, more preferably 20–180 wt. parts, per 100 wt. parts of the binder resin. Below 10 wt. parts, the coloring power of the resultant magnetic toner is liable to be insufficient, and the suppression of fog becomes difficult. Above 200 wt. parts, the resultant toner is held at an excessively large force onto the toner-carrying member, to show a lower developing performance. Moreover, the dispersion of magnetic iron oxide particles to individual toner particles becomes difficult, and the fixability is lowered.

The magnetic iron oxide particles used for constituting the magnetic toner used in the image forming method of the invention may be produced, e.g., in the following manner, in the case of magnetite-based magnetic iron oxide.

To a ferrous salt aqueous solution, an alkali, such as sodium hydroxide, in an amount equivalent to the iron in the ferrous salt or larger to prepare an aqueous solution containing ferrous hydroxide. While retaining the pH of the thus-prepared aqueous solution at pH 7, preferably pH 8–10 and warming the aqueous solution at a temperature of 70° C. or higher, air is blown into the aqueous solution to oxidize the ferrous hydroxide, thereby first forming seed crystals functioning as nuclei of magnetic iron oxide particles to be produced.

Then, to the slurry-form liquid containing the seed crystals, an aqueous solution containing ferrous salt in an amount of ca. 1 equivalent based on the amount of the previously added alkali, is added. While keeping the liquid at pH 6–10, air is blown thereinto to proceed with the reaction of the ferrous hydroxide, thereby growing magnetic iron oxide particles around the seed crystals as nuclei. Along with the progress of the oxidation reaction, the liquid pH is shifted toward an acidic side, but it is preferred not to allow the liquid pH go down to below 6. At a final stage of the oxidation, the liquid pH is adjusted, and the slurry liquid is sufficiently stirred so as to disperse the magnetic iron oxide in primary particles. In this state, a coupling agent for hydrophobization is added to the liquid to be sufficiently mixed under stirring. Thereafter, the slurry is filtered out and dried, and the dried product is lightly disintegrated to provide hydrophobic treated magnetic iron oxide particles.

Alternatively, the iron oxide particles after the oxidation reaction may be washed, filtered out and then, without being dried, re-dispersed in another aqueous medium. Then, the pH of the re-dispersion liquid is adjusted and subjected to hydrophobization by adding a coupling agent under sufficient stirring. Anyway, it is preferred that untreated iron oxide particles formed in the oxidation reaction system are subjected to hydrophobization in their wet slurry state and without being dried prior to the hydrophobization.

As the ferrous salt used in the above-mentioned production process, it is generally possible to use ferrous sulfate by-produced in the sulfuric acid process for titanium production or ferrous sulfate by-produced during surface washing of steel sheets. It is also possible to use ferrous chloride. In the above-mentioned process for producing magnetic iron oxide from a ferrous salt aqueous solution, a ferrous salt concentration of 0.5–2 mol/liter is generally used so as to obviate an excessive viscosity increase accompanying the reaction and in view of the solubility of a ferrous salt, particularly of ferrous sulfate. A lower ferrous salt concentration generally tends to provide finer magnetic iron oxide particles. Further, as for the reaction conditions, a higher rate of air supply, and a lower reaction temperature, tend to provide finer product particles.

By using a magnetic toner containing the thus-produced hydrophobic magnetic iron oxide particles, it becomes possible to realize an image forming method wherein the abrasion of and toner attachment onto the photosensitive member are effectively suppressed to stably provide high-quality images.

The magnetic iron oxide particles may have octahedral, hexahedral, spherical, acicular or flaky shape, but magnetic iron oxide particles having less anisotropic shapes, such as octahedral, hexahedral or spherical are preferred in order to provide a high image density. Such particle shapes may be confirmed by observation through a scanning electron microscope (SEM).

It is preferred that the magnetic iron oxide particles have a volume-average particle size of 0.1–0.3 μm and contain at most 40% by number of particles of 0.03–0.1 μm, based on measurement of particles having particle sizes of at least 0.03 μm, also in view of magnetic properties of the magnetic iron oxide particles. It is further preferred that the amount of particles of 0.3 μm or larger is suppressed to at most 10% by number.

Magnetic iron oxide particles having an average particle size of below 0.1 μm are not generally preferred because they are liable to provide a magnetic toner giving images which are somewhat tinted in red and insufficient in blackness with enhanced reddish tint in halftone images. Further, as the magnetic iron oxide particles are caused to have an increased surface area, the dispersibility thereof is lowered, and an inefficiently larger energy is consumed for the production. Further, the coloring power of the magnetic iron oxide particles can be lowered to result in insufficient image density in some cases.

On the other hand, if the magnetic iron oxide particles have an average particle size in excess of 0.3 μm, the weight per one particle is increased to increase the probability of exposure thereof to the toner particle surface due to a specific gravity difference with the binder during the production. Further, the wearing of the production apparatus can be promoted and the dispersion stability of a monomer composition containing the magnetic iron oxide particles is liable to become unstable.

Further, if particles of 0.1 μm or smaller exceed 40% by number of total particles (having particle sizes of 0.03 μm or larger), the magnetic iron oxide particles are liable to have a lower dispersibility because of an increased surface area, liable to form agglomerates in the toner to impair the toner chargeability, and are liable to have a lower coloring power. If the percentage is lowered to at most 30% by number, the difficulties are preferably alleviated.

Incidentally, magnetic iron oxide particles having particle sizes of below 0.03 μm receive little stress during the toner production so that the probability of exposure thereof to the toner particle surface is low. Further, even if such minute particles are exposed to the toner particle surface, they do not substantially function as leakage sites lowering the chargeability of the toner particles. Accordingly, the particles of 0.03–0.1 μm are noted herein, and the percentage by number thereof is suppressed to below a certain limit.

On the other hand, if particles of 0.3 μm or larger exceed 10% by number, the magnetic iron oxide particles are caused to have a lower coloring power, thus being liable to result in a lower image density. Further, as the number of magnetic iron oxide particles is decreased at an identical weight percentage, it becomes difficult statistically to have the magnetic iron oxide particles be present up to the proximity of the toner particle surface and distribute equal numbers of magnetic iron oxide particles to respective toner particles. This is undesirable. It is further preferred that the percentage be suppressed to at most 5% by number.

In the present invention, it is preferred that the magnetic iron oxide production conditions are adjusted so as to satisfy the above-mentioned conditions for the particle size distribution, or the produced magnetic iron oxide particles are used for the toner production after adjusting the particle size distribution as by pulverization and/or classification. The classification may suitably be performed by utilizing sedimentation as by a centrifuge or a thickener, or wet classification using, e.g., a cyclone.

The volume-average particle size and particle size distribution of iron oxide particles described herein are based on values measured in the following manner.

Sample particles in a sufficiently dispersed state are photographed at a magnification of $3\times10^4$ through a transmission electron microscope (TEM), and 100 particles each having a particle size of at least 0.03 μm selected at random in visual fields of the taken photographs are subjected to measurement of projection areas. The particle size (projection area-equivalent circle diameter ($D_{CE}$)) of each particle is determined as a diameter of a circle having an area equal to the measured projection area of the particle. Based on the measured particle sizes of the 100 particles, a volume-average particle size ($Dv=(\Sigma(nD_{CE}^3)/\Sigma n)^{1/3}$), percentage by number of particles of 0.03 μm–0.1 μm and percentage by number of particles of 0.3 μm or larger are determined.

The volume-average particle size and particle size distribution of magnetic iron oxide particles dispersed within toner particles may be measured in the following manner.

Sample toner particles are sufficiently dispersed in a cold-setting epoxy resin, which is then hardened for 2 days at 40° C. The hardened product is sliced into thin flakes by a microtome. The thin flakes are observed through a TEM and photographic at magnification of $1\times10^4$–$4\times10^4$. One hundred iron oxide particles of at least 0.03 μm in particle size selected at random in visual fields of the taken photographs are subjected to measurement of projection areas. From the projection areas of the 100 iron oxide particles, a volume-average particle size (projection area-equivalent circular diameter), percentage by number of particles of 0.03 μm–0.1 μm and percentage by number of particles of 0.3 μm or larger are determined similarly as the above.

The magnetic iron oxide particles may preferably have magnetic properties including a saturation magnetization of 10–200 $Am^2/kg$ as measured at a magnetic field of 795.8 kA/m, a residual magnetization of 1–100 $Am^2/kg$, and a coercive force of 1–30 kA/m.

It is particularly preferred that the magnetic toner used in the present invention has a magnetization of 10–50 $Am^2/kg$ at a magnetic field of 79.6 kA/m (1000 oersted).

The magnetization at a magnetic field of 79.6 mA/m is taken as a property of a magnetic toner in a magnetic field realized in an actual image forming apparatus, while the saturation magnetization is used as a parameter representing magnetic properties of magnetic iron oxide. The magnetic field acting on magnetic toners is most commercially available image forming apparatus is on the order of several tens to a hundred and several tens kA/m so as to avid the leakage of excessively large magnetic field to outside the image forming apparatus and suppress the cost of the magnetic field supply. Accordingly, a magnetic field of 79.6 kA/m (1000 oersted) is taken as a representative magnetic field value actually acting on a magnetic toner in image forming apparatus to define a magnetization of a magnetic toner.

A magnetic toner is held within a developing device without causing toner leakage by disposing a magnetic force generating means in the developing device. The conveyance and stirring of the magnetic toner is also effected under a magnetic force. By disposing a magnetic force generating means so that the magnetic force acts on the toner-carrying member, the recover of transfer residual toner is further promoted in the simultaneous developing and toner recovery system and toner scattering is prevented by forming ears of magnetic toner on the toner-carrying member.

However, if the magnetic toner has a magnetization of below 10 $Am^2/kg$ at a magnetic field of 79.6 kA/m, it becomes difficult to convey the magnetic toner on the toner-carrying member, and magnetic toner ear formation on the toner-carrying member becomes unstable, thus failing to provide uniform charge to the toner. As a result, image defects, such as fog, image density irregularity and recovery failure of transfer-residual toner are liable to be caused. If the magnetization exceeds 50 $Am^2/kg$, the toner particles are liable to have an increased magnetic agglomeratability, to result in remarkably lower flowability and transferability. As a result, the transfer-residual toner is increased. Further, if the amount of magnetic iron oxide is increased in order to enhance the magnetization, the resultant toner is caused to have a lower fixability.

The magnetic values described herein are based on values measured at 25° C. under an external magnetic field of 79.6 kA/m for magnetization of magnetic toners and at 25° C. under an external magnetic field of 796 kA/m for magnetic properties of magnetic iron oxides, respectively by using an oscillation-type magnetometer ("VSM P-1-10, made by Toei Kogyo K.K.).

The magnetic toner used in the present invention can further contain another colorant in addition to the magnetic iron oxide. Examples of such another colorant may include: magnetic or non-magnetic inorganic compounds, and known dyes and pigments. Specific examples thereof may include: particles of ferroelectric metals, such as cobalt, nickel and iron, alloys of these with chromium, manganese, copper, zinc, aluminum and rare earth elements; hematite, titanium black, nigrosine dyes/pigments, carbon black and phthalocyanine. The materials may also be surface-treated similarly as the magnetic iron oxide particles.

Next, the suspension polymerization process will be described as a process for producing the magnetic toner particles used in the present invention.

Examples of polymerizable monomers for constituting the binder resin in the magnetic iron oxides may include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a magnetic toner with good developing performances and continuous image forming performances.

In the polymerization magnetic toner production, it is possible to add a resin into the monomer composition to be polymerized. For example, if it is described to introduce a hydrophilic functional group, such as amino group, hydroxyl group, sulfonic acid group, glycidyl group or nitrile group, into toner particles, while such a monomer containing such a hydrophillic group cannot be used because of its water-solubility to be emulsified in an aqueous medium, it is possible to incorporate a random copolymer, a block copolymer or a graft copolymer of such a monomer with another vinyl monomer, such as styrene or ethylene. It is also possible to incorporate a polycondensate, such as a polyester or a polyamide, or an addition polymer, such as a polyether or a polyimine.

If such a polymer having a polar functional group is contained in toner particles, the above-mentioned wax can be effectively enclosed therein by phase separation to provide a magnetic toner with a good combination of anti-offset property, anti-blocking property and low-temperature fixability.

Such a polymer having a polar functional group, when used, may preferably have a weight-average molecular weight of at least 5000. If the molecular weight is below 5000, particularly 4000 or below, the polymer is concentrated at proximity to the magnetic toner particle surfaces, to result in lower developing performance and anti-blocking property.

Further, for the purpose of improving the dispersibility of ingredients and the fixability and image forming performance of the resultant toner, it is possible to add a resin other than the above in the monomeric mixture. Examples of such another resin may include: homopolymers of styrene and its substituted derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resins may be used singly or in combination of two or more species.

Such a resin may preferably be added in 1–20 wt. parts per 100 wt. parts of the monomer. Below 1 wt. part, the addition effect thereof is scarce, and above 20 wt. parts, the designing of various properties of the resultant polymerization toner becomes difficult.

Further, if a polymer having a molecular weight which is different from that of the polymer obtained by the polymerization is dissolved in the monomer for polymerization, it is possible to obtain a toner having a broad molecular weight distribution and thus showing a high anti-offset property.

For the polymerization, a polymerization initiator exhibiting a halflife of 0.5–30 hours at the polymerization temperature may be added in an amount of 0.5–20 wt. % of the polymerizable monomer so as to obtain a polymer exhibiting a maximum in a molecular weight range of $1\times10^4$–$1\times10^5$, thereby providing the toner with a desirable strength and appropriate melt-characteristics. Examples of the polymerization initiator may include: azo- or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and t-butyl peroxy-2-ethylhexanoate.

The polymerizable monomer composition for preparing magnetic toner particles can further contain a crosslinking agent in a proportion of preferably 0.001–15 wt. %.

The crosslinking agent may for example be a compound having two or more polymerizable double bonds. Examples thereof may include: aromatic divinyl compounds, such as divinylbenzene, and divinylnaphthalene; carboxylate esters having two double bonds, such as ethylene glycol diacrylate, ethylene glycol dimethacrylate, and 1,3-butane diol dimethacrylate; divinyl compounds, such as divinylaniline, divinyl ether, divinyl sulfide and divinyl sulfone; and compounds having three or more vinyl groups. These may be used singly or in mixture.

In order to produce the magnetic toner particles through a suspension polymerization process, the above-mentioned monomeric mixture, i.e., a mixture of a polymerizable monomer and magnetic powder, and other toner components a wax, plasticizer, a charge control agent, a crosslinking agent, and a colorant, as desired; further optional ingredients, such as an organic solvent polymer, an additive polymer, and dispersing agent, subjected to uniform dissolution or dispersion by a dispersing machine, such as a homogenizer, a ball mill, a colloid mill, a developer, or an ultrasonic dispersing machine, may be suspended in an aqueous medium.

At this time, it is preferred to use a high-speed dispersing machine, such as a high-speed stirrer or an ultrasonic dispersing machine to form droplets of the monomeric mixture in desired size at a stroke in order to provide toner particles of a narrower particle size distribution.

The polymerization initiator may be added to the polymerization system by adding it to the monomeric mixture together with the other ingredients for providing the monomeric mixture or just before dispersing the monomeric mixture in the aqueous medium. Alternatively, it is also possible to add such a peroxide polymerization initiator in solution within a polymerizable monomer or another solvent into the polymerization system just after the formation of the droplets of the monomeric mixture and before the initiation of the polymerization. After the formation of the droplets of the monomeric mixture, the system may be stirred by an ordinary stirrer at an appropriate degree for maintaining droplet state and preventing the floating or sedimentation of the droplets.

Into the suspension polymerization system, a dispersion stabilizer may be added. As the dispersion stabilizer, it is possible to use a known surfactant or organic or inorganic dispersion agent. Among these, an inorganic dispersing agent may preferably be used because it is less liable to result in excessively small particles which can cause some image defects, its dispersion function is less liable to be impaired even at a temperature change because its stabilizing function principally relies on its stearic hindrance, and also it can be readily removed by washing to be less liable to adversely affect the resultant toner performance.

Examples of such an inorganic dispersing agent may include: polyvalent metal phosphates, such as calcium phosphate, magnesium phosphate, aluminum phosphate, and zinc phosphate; carbonates, such as calcium carbonate and magnesium carbonate; inorganic salts, such as calcium metasilicate, calcium sulfate, and barium sulfate; and inorganic oxides, such as calcium hydroxide, magnesium hydroxide, aluminum hydroxide, silica bentonite, and alumina.

Such an inorganic dispersing agent may desirably be used singly in an amount of 0.2–20 wt. parts per 100 wt. parts of the polymerizable monomeric mixture, but it is also possible to use 0.001–0.1 wt. part of a surfactant in combination particularly for preparation of toner particles having an average particle size of at most 5 μm.

Examples of such a surfactant may include: sodium dodecylbenzenesulfate, sodium tetradecylsulfate, sodium pentadecylsulfate, sodium octylsulfate, sodium oleate, sodium laurate, sodium stearate, and potassium stearate.

An inorganic agent as mentioned above may be used as it is but may be produced in situ in the aqueous medium for suspension polymerization in order to provide toner particles of a narrower particle size distribution. For example, in the case of calcium phosphate, a sodium phosphate aqueous solution and a calcium phosphate aqueous solution may be blended under high-speed stirring to form water-insoluble calcium phosphate, which allows the dispersion of a monomeric mixture into droplets of a more uniform size. At this time, water-soluble sodium chloride is by-produced, but the presence of such a water-soluble salt is effective for suppressing the dissolution of a polymerizable monomer into the aqueous medium, thus conveniently suppressing the formation of ultrafine toner particles owing to emulsion polymerization.

The remaining of such a salt can adversely affect the removal of residual monomer after the polymerization, so that it is preferred to replace the aqueous medium or effect desalting by using an iron-exchange resin. The inorganic dispersing agent can be substantially completely removed by washing with acid or alkali after the polymerization.

The temperature for the suspension polymerization may be set to at least 40° C., generally in a range of 50–90° C. The polymerization in this temperature range is preferred because the wax is precipitated by phase separation to be enclosed more completely. In order to consume the residual polymerization monomer, the temperature can be raised up to 90–150° C. in the final stage of the polymerization.

The polymerizate magnetic toner particles after the polymerization may be recovered by filtration, washing and drying, and then blended with inorganic fine powder and electroconductive fine powder externally added for attachment onto the magnetic toner particles. It is also a preferred mode to include a step for classifying the polymerization toner particles to remove a coarse and/or a fine powder fraction.

Then, a pulverization process as another process for producing the magnetic toner particles used in the present invention, will be described.

The production of magnetic toner particles through the pulverization process may be performed in a known manner. For examples, toner ingredients, inclusive of the binder resin, magnetic iron oxide particles, a release agent, a charge control agent, and optionally another colorant, etc., are sufficiently blended by a blender, such as a Henschel mixer or a ball mill, and then melt-kneaded by a hot kneading means, such as a hot roller, a kneader or an extruder, to form a molten mixture of resinous materials and disperser therein other powdery toner materials such as magnetic iron oxide particles. The melt-kneaded product, after being cooled for solidification, is pulverized, classified and optionally surface-treated to obtain magnetic toner particles, which are then blended with the inorganic fine powder and electroconductive fine powder to obtain a magnetic toner used in the present invention. Either the classification or the surface treatment can be performed in advance. In the classification, it is preferred to use a multi-division classifier in view of the production efficiency.

The pulverization may be performed by using a known pulverization apparatus of, e.g., the mechanical impact type or the jet type. In order to obtain a magnetic toner having he specified circularity, it is preferred to effect the pulverization under heating or apply a supplemental mechanical impact. It is also possible to subject the pulverized (and optionally classified) magnetic toner particles to dispersion into hot water or passing through hot air stream.

Examples of the mechanical impact application apparatus may include: mechanical pulverizers, such as "KRYPRON SYSTEM" (made by Kawasaki Jukogyo K.K.) and "TURBOMILL" (made by Turbo Kogyo K.K.), and mechanical impacting devices, such as "MECHANOFUSION SYSTEM" (made by Hosekawa Micron K.K.) and "HYBRIDIZATION SYSTEM" (made by Nara Kikai Seisakusho K.K.) wherein toner particles are pressed against an inner wall of a casing under action of a centrifugal force exerted by blades stirring at high speeds, thereby applying mechanical impact forces including compression and abrasion forces to the toner particles.

For the mechanical impact application treatment for sphering of toner particles, it is preferred that the treatment atmosphere temperature is selected in a range of temperature of Tg±10° C. around the glass transition temperature (Tg) of the magnetic toner particles, in view of agglomeration prevention and productivity. A treatment temperature in a range of Tg±5° C. is further preferred for providing an improved transferability.

Examples of the binder resin for producing the magnetic toner particles through the pulverization process may include: homopolymers of styrene and its substituted derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resins may be used singly or in combination of two or more species. It is particularly preferred to use a styrene copolymer and/or a polyester resin in view of the developing performance and the fixability.

The binder resin may preferably have a glass transition temperature (Tg) of 50–70° C. Below 50° C., the resultant magnetic toner is liable to have a lower storability, and above 70° C., the fixability is lowered.

Next, the inorganic fine powder and the electroconductive fine powder will be described.

The magnetic toner used in the present invention contains inorganic fine powder, preferably having an average primary particle size of 4–80 nm, as a flowability improving agent. The inorganic fine powder may be added to provide the magnetic toner with an improved flowability and uniformize the chargeability of the magnetic toner particles, and for this purpose, it is preferred to subject the inorganic fine powder to hydrophobization thereby adjusting the chargeability and improve the environmental stability of the magnetic toner.

In case where the inorganic fine powder has a number-average primary particle size larger than the 80 nm or the inorganic fine powder is not added, the transfer-residual toner particles, when attached to the charging member, are liable to stick to the charging member, so that it becomes difficult to stably attain good uniform chargeability of the image-bearing member. Further, it becomes difficult to have a sufficient flowability of the magnetic toner, thus being liable to cause difficulties, such as non-uniform charges to the magnetic toner particles, increased fog, image density lowering and toner scattering.

In case where the inorganic fine powder has a number-average particle size below 4 nm, the inorganic fine powder is caused to have strong agglomeratability, so that the inorganic fine powder is liable to have a broad particle size distribution including agglomerates of which the disintegration is difficult, rather than the primary particles, thus being liable to result in image defects such as image dropout due development with the agglomerates of the inorganic fine powder and defects attributable to damages on the image-bearing member, developer-carrying member or contact charging member, by the agglomerates. For providing a more uniform charge distribution of the magnetic toner, it is further preferred that the number-average primary particle size of the inorganic fine powder is in the range of 6–35 nm.

The number-average primary particle size of inorganic fine powder described herein is based on the values measured in the following manner. A magnetic toner sample is photographed in an enlarged form through a scanning electron microscope (SEM) equipped with an elementary analyzer such as XMA to provide an ordinary SEM picture and also an XMA picture mapped with elements contained in the inorganic fine powder. Then, by comparing these pictures, the sizes of 100 or more inorganic fine powder primary particles attached onto or isolated from the magnetic toner particles are measured to provide a number-average particle size.

The inorganic fine powder used in the present invention may preferably comprise fine powder of at least one species selected from the group consisting of silica, titania and alumina.

For example, silica fine powder may be dry-process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide powder with other metal oxides for example by using another metal halide, such as aluminum chloride or titanium chloride together with silicon halide in the production process.

The inorganic fine powder may preferably be added in a proportion of 0.1–3.0 wt. % of the magnetic toner particles. Below 0.1 wt. %, the addition effect thereof is scarce, and above 30 wt. %, the fixability of the magnetic toner is lowered.

The inorganic fine powder used in the present invention may preferably have been hydrophobized in view of performances in a high temperature/high humidity environment. If the inorganic fine powder added to the magnetic toner absorbs mixture, the chargeability of the magnetic toner particles is remarkably lowered, thus being liable to cause toner scattering.

As the hydrophobization agents, it is possible to use silicone varnish, various modified silicone varnish, silicone oil, various modified silicone oil, silane compounds, silane coupling agents, other organic silicon compounds and organic titanate compounds singly or in combination. Among these, it preferred that the inorganic fine powder has been treated with at least silicone oil, more preferably treated with silicone oil simultaneously with or after hydrophobization treatment with a silane coupling agent, in order to keep a high chargeability of the magnetic toner particles to prevent toner scattering, even in a high humidity environment.

In such a preferred form of the treatment of the inorganic fine powder, silylation is performed in a first step to remove a hydrophilic site, such as a silanol group of silica, by a chemical bonding, and then a hydrophobic film is formed of silicone oil in a second step.

The silicone oil may preferably have a viscosity at 25° C. of 10–200,000 $mm^2/s$, more preferably 3,000–80,000 $mm^2/s$. If the viscosity is below 10 $mm^2/sec$, the treated inorganic fine powder is liable to lack stability and result in image deterioration due to thermal or mechanical shock. On the other hand, if the viscosity is larger than 200,000 mm/sec, the treatment of the inorganic fine powder with the silicone oil is liable to become difficult.

Particularly preferred species of the silicone oil used may include: dimethylsilicone oil, methylphenylsilicone oil, α-methylstyrene-modified silicone oil, chlorophenylsilicone oil, and fluorine-containing silicone oil.

The silicone oil treatment may be performed, e.g., by directly blending the inorganic fine powder (optionally preliminarily treated with e.g., silane coupling agent) with silicone oil by means of a blender such as a Henschel mixer; by spraying silicone oil onto the inorganic fine powder; or by dissolving or dispersing silicone oil in an appropriate solvent and adding thereto the inorganic fine powder for blending, followed by removal of the solvent. In view of less by-production of the agglomerates, the spraying is particularly preferred.

The inorganic fine powder having a number-average primary article size of 4–80 nm may preferably have a specific surface area of 20–250 $m^2/g$, more preferably 40–200 $m^2/g$; a measured by the nitrogen adsorption BET method, e.g., the BET multi-point method using a specific surface area meter ("AUTOSORB 1", made by Yuasa Ionix K.K.).

The magnetic toner used in the present invention contains electroconductive fine powder as described below.

Electroconductive fine powder may preferably be contained in 0.2–10 wt. % of the entire magnetic toner. As the magnetic toner particles used in the present invention are free from magnetic iron oxide particles exposed to the surface thereof, the magnetic toner exhibits a high chargeability so that it is liable to exhibit a lower developing performance if it contains less than 0.2 wt. % of electroconductive fine powder.

Further, in case where the magnetic toner is used in the image forming method including a developing-cleaning step (a step having functions of developing and residual toner-cleaning simultaneously) if the amount is less than 0.2 wt. %, it becomes difficult to supply the electroconductive fine powder to the charging section at the contact position between the contact charging member and the image-bearing member or in a region proximity thereto in an amount sufficient to well charge the image-bearing member by overcoming the charging obstruction caused by the attachment and mixing of the insulating transfer residual toner, thus being liable to cause charging failure.

On the other hand, if the amount of the electroconductive fine powder is above 10 wt. %, the amount of electroconductive fine powder recovered in the developing-cleaning step becomes excessively large to result in lower chargeability and developing performance in the developing section, so that difficulties, such as image density lowering and toner scattering are liable to occur. It is further preferred that the electroconductive fine powder is contained in a proportion of 0.5–5 wt. % of the entire magnetic toner.

The electroconductive fine powder may preferably have a resistivity of at most $10^9$ ohm.cm. If the electroconductive fine powder has a resistivity exceeding $10^9$ ohm.cm, the developing performance of the magnetic toner is liable to be lowered similarly as above. Further, the effect of promoting the uniform chargeability of the image-bearing member becomes small, even if the electroconductive fine powder is present at the contact position between the charging member and the image-bearing member or in the charging region in the vicinity thereof so as to retain an intimate contact via the electroconductive fine powder between the contact charging member and the image-bearing member when used in an image forming method including the developing-cleaning step.

In order to sufficiently attain the effect of promoting the chargeability of the image-bearing member owing to the electroconductive fine powder, thereby stably accomplishing good uniform chargeability of the image-bearing member, it is preferred that the electroconductive fine powder has a resistivity lower than the resistivity at the surface or at contact part with the image-bearing member of the contact charging member, more preferably a resistivity of $10^6$ ohm.cm or below.

The resistivity of electroconductive fine powder may be measured by the tablet method and normalized. More specifically, ca. 0.5 g of a powdery sample is placed in a cylinder having a bottom area of 2.26 $cm^2$ and sandwiched between an upper and a lower electrode under a load of 15 kg. In this state, a voltage of 100 volts is applied between the electrodes to measure a resistance value, from which a resistivity value is calculated by normalization.

The electroconductive fine powder may preferably have a volume-average particle size (Dv) which is smaller than that of the magnetic toner particles and is at least 0.3 μm. If the electroconductive fine powder has a excessively small volume-average particle size, the content of the electroconductive fine powder in the magnetic toner has to be set lower in order to obviate the lowering in developing performance, and if the content is excessively low, an effective amount of the electroconductive fine powder cannot be ensured, thus failing to provide an amount of the electroconductive fine powder sufficient to well effect the charging of the image-bearing member by overcoming the charging obstruction caused by the attachment and mixing of the insulating transfer-residual toner particles with the contact charging member in the charging section at the contact position between the charging member and the image-bearing member or in a region proximity thereto, whereby charging failure is liable to be caused. For this reason, it is further preferred that the volume-average particle size of the electroconductive fine powder is 0.8 μm or larger, particularly 1.1 μm or larger.

On the other hand, if the electroconductive fine powder has a volume-average particle size comparable to or larger than that of the magnetic toner particles, the electroconductive fine powder is liable to be separated from the toner particles, and the supply thereof from the developer vessel to the toner carrying member becomes insufficient to fail in ensuring a sufficient chargeability. Further, the electroconductive fine powder having dropped off the charging member can interrupt or diffuse exposure light for latent image formation to result in lower image quality due to electrostatic latent image defect.

Further, if the volume-average particle size is larger than the above-mentioned range, the number of electroconductive fine powder particles per unit weight is reduced, so that it becomes difficult to sufficiently attain the effect of promoting the recovery of the transfer-residual toner particles. Further, because of the decrease in number of the electroconductive fine powder particles, in view of the decrease and deterioration of the electroconductive fine powder at a vicinity of the charging member, it becomes necessary to increase the content of the electroconductive fine powder in the developer in order to continually supply the electroconductive fine powder to the charging section and stabilize the uniform chargeability of the image-bearing member ensured by intimate contact via the electroconductive fine powder between the image-bearing member and the contact charging member. However, if the content of the electroconductive fine powder is excessively increased, the developer as a whole is liable to have a lower chargeability and developing performance, thus causing image density lowering and toner scattering, especially in a high humidity environment. From these viewpoints, it is further preferred that the volume-average particle size of the developer is 5 μm or smaller.

It is also preferred that the electroconductive fine powder is transparent, white or only pale-colored, so that it is not noticeable as fog even when transferred onto the transfer material. This is also preferred so as to prevent the obstruction of exposure light in the latent image-step. It is preferred that the electroconductive fine powder shows a transmittance of at least 30%, with respect to imagewise exposure light used for latent image formation, as measured in the following manner.

A sample of electroconductive fine powder is attached onto an adhesive layer of a one-side adhesive plastic film to form a mono-particle densest layer. Light flux for measurement is incident vertically to the powder layer, and light transmitted through to the backside is condensed to measure the transmitted quantity. A ratio of the transmitted light to a transmitted light quantity through an adhesive plastic film alone is measured as a net transmittance. The light quantity measurement may be performed by using a a transmission-type densitometer (e.g., "310T", available from X-Rite K.K.).

The electroconductive fine powder used in the present invention may for example comprise: carbon fine powder, such as carbon black and graphite powder; and fine powders of metals, such as copper, gold, silver, aluminum and nickel; metal oxides, such as zinc oxide, titanium oxide, tin oxide, aluminum oxide, indium oxide, silicon oxide, magnesium oxide, barium oxide, molybdenum oxide, iron oxide, and tungsten oxide; and metal compounds, such as molybdenum sulfide, cadmium sulfide, and potassium titanate; an complex oxides of these. Among the above, it is preferred that the electroconductive fine powder comprises a non-magnetic inorganic oxide, such as zinc oxide, tin oxide or titanium oxide at least at the surface portion thereof.

Further, it is also possible to use fine particles of electroconductive inorganic oxide comprising a certain principal metal element further doped with 0.1 to 5 wt. % of an element, such as antimony or aluminum, different from the principal metal element, or fine particles coated with an electroconductive material. Examples of such composite electroconductive fine particles may include: titanium oxide fine particles surface-treated with antimony-tin oxide, antimony-doped stannic oxide fine particles and stannic oxide fine particles.

Herein, "principal metal element of an oxide" means a principal metal element bonded with oxygen, such as titanium in titanium oxide, and tin in tin oxide.

An oxygen-deficient state of the above-mentioned electroconductive inorganic oxides may also preferably be used.

Commercially available examples of electroconductive titanium oxide fine powder coated with antimony-tin oxide may include: "EC-300" (Titan Kogyo K.K.); "ET-300", "HJ-1" and "HI-2" (Ishihara Sangyo K.K.) and "W-P" (Mitsubishi Material K.K.).

Commercially available examples of antimony-doped electroconductive tin oxide fine powder may include: "T-1" (Mitsubishi Material K.K.) and "SN-100P" (Ishihara Sangyo K.K.).

Commercially available examples of stannic oxide fine powder may include: "SH-S" (Nippon Kagaku Sangyo K.K.).

In view of the developing performance, it is particularly preferred to use an aluminum-containing metal oxide and/or an oxygen-deficient state metal oxide.

The volume-average particle size and particle size distribution of the electroconductive fine powder described herein are based on values measured in the following manner. A laser diffraction-type particle size distribution measurement apparatus ("MODEL LS-230", available from Coulter Electronics Inc.) is equipped with a liquid module, and the measurement is performed in a particle size range of 0.04–2000 μm to obtain a volume-basis particle size distribution. For the measurement, a minor amount of surfactant is added to 10 cc of pure water and 10 mg of a sample electroconductive fine powder is added thereto, followed by 10 min. of dispersion by means of an ultrasonic disperser (ultrasonic homongenizer) to obtain a sample dispersion liquid, which is subjected to a single time of measurement for 90 sec.

The particle size and particle size distribution of the electroconductive fine powder used in the present invention may for example be adjusted by setting the production method and conditions so as to produce primary particles of the electroconductive fine powder having desired particle size and its distribution. In addition, it is also possible to agglomerate smaller primary particles or pulverize larger primary particles or effect classification. It is further possible to obtain such electroconductive fine powder by attaching or fixing electroconductive fine particles onto a portion or the whole of base particles having a desired particle size and its distribution, or by using particles of desired particle size and distribution containing an electroconductive component dispersed therein. It is also possible to provide electroconductive fine powder with a desired particle size and its distribution by combining these methods.

In the case where the electroconductive fine powder is composed of agglomerate particles, the particle size of the electroconductive fine powder is determined as the particle size of the agglomerate. The electroconductive fine powder in the form of agglomerated secondary particles can be used as well as that in the form of primary particles. Regardless of its agglomerated form, the electroconductive fine powder can exhibit its desired function of charging promotion by presence in the form of the agglomerate in the charging section at the contact position between the charging member and the image-bearing member or in a region in proximity thereto.

It is another preferred embodiment of the magnetic toner used in the present invention that it further contains closeto-spherical inorganic or organic fine particles having a primary particle size exceeding 30 nm (preferably $S_{BET}$<50 $m^2/g$), more preferably of 50 nm or larger ($S_{BET}$<30 $m^2/g$). For example, spherical silica particles, spherical polymethylsilsesquioxane particles or spherical resin particles, may preferably be used.

The magnetic toner used in the present invention can further contain other additives within an extent of not adversely affecting the performances thereof. Examples of such additives may include: lubricating powder such as, powders of polytetrafluoroethylene, zinc stearate and polyvinylidene fluoride; abrasives, such as powders of cerium oxide, silicon carbide and strontium titanate; flowability-improving agents, such as powders of titanium oxide, and aluminum oxide; anti-caking agents; and a small amount of organic or inorganic fine powder of opposite polarity chargeability as a developing performance-improver. These additives an be added after surface hydrophobization.

The particle size of these additives may be determined by observation through a scanning electron microscope similarly as the above-mentioned inorganic fine powder.

Next, the image forming system (method and apparatus) of the present invention will be described.

The image forming method according to the present invention, includes: a charging step of charging an image-bearing member by charging means comprising a charging member abutted against the image-bearing member at a contact nip; a latent-image forming step of forming an electrostatic latent image on the charged image-bearing member; a developing step of transferring a magnetic toner carried on a toner-carrying member onto the electrostatic latent image to develop the latent image, thereby forming a magnetic toner image on the image-bearing member, and a transfer step of electrostatically transferring the magnetic toner image on the image-baring member onto a transfer material via or without via an intermediate transfer member; wherein the image-bearing member comprises an electroconductive support and a photoconductor layer comprising a silicon-based non-single crystal material and disposed on the electroconductive support, and is charged to a potential of 250 to 600 volts in terms of an absolute value via the charging member.

In a preferred embodiment, the developing step is also operated to function as a cleaning step for recovering transfer residual toner remaining on the image-bearing member after transfer of a toner image onto a transfer material (a developing-cleaning step).

The image forming method including such a developing-cleaning step will be first described. The image forming method may also be referred to as a cleanerless image forming method.

More specifically, the cleanerless image forming method includes: a charging step of charging an image-bearing member by charging means comprising a charging member supplied with a voltage and abutted against the image-bearing member at a contact nip; a latent-image forming step of forming an electrostatic latent image on the charged image-bearing member; a developing step of transferring a magnetic toner carried on a toner-carrying member onto the electrostatic latent image to develop the latent image, thereby forming a magnetic toner image on the image-bearing member, and a transfer step of electrostatically transferring the magnetic toner image on the image-baring member onto a transfer material via or without via an intermediate transfer member, which steps are included in a cycle to be repeated for image formation on the transfer material; wherein the developing step is also operated to function as a cleaning step for recovering transfer residual toner remaining after the transfer of the toner image onto the transfer material, and electroconductive fine powder contained in the magnetic toner is attached to the image-bearing member in the developing step and allowed to remain on the image-bearing member after the transfer step to reach a charging section formed at the contact nip between the charging member and the image-bearing member and/or a proximity thereto.

Now, the behavior or movement of the magnetic toner particles and the electroconductive fine powder externally added thereto to form the magnetic toner is described.

The electroconductive fine powder contained in the magnetic toner is transferred in an appropriate amount thereof together with the magnetic toner particles forming a toner image from the toner-carrying member onto the image-bearing member for development of an electrostatic latent image on the image-bearing member in the developing step.

The toner image formed on the image bearing member is transferred onto a transfer material (via or without via an intermediate transfer member) in the transfer step. A minor portion of the electroconductive fine powder can also be transferred onto the transfer material side, but the remaining major portion thereof remains attached on the image-bearing member. More specifically, in the case of effecting the transfer of the magnetic toner image by applying a bias voltage of a polarity opposite to the charge of the magnetic toner, the toner image is positively transferred electrostatically, whereas the electroconductive fine powder on the image-bearing member is not positively transferred toward the transfer material because of its electroconductivity, so that the major portion thereof remains attached on the image-bearing member.

In the cleanerless image forming method, transfer residual toner and the above-mentioned electroconductive fine powder remaining on the image-bearing member after the transfer step are brought as they are to the charging section formed at the contact nip between the image-bearing member and the contact charging member as a result of the movement of the image-bearing member surface to be attached to the contact charging member. Consequently, the image-bearing member is contact-charged in a state where the electroconductive fine powder is present at the contact nip between the image-bearing member and the contact charging member.

Owing to the presence of the electroconductive fine powder, an intimate contact and a low contact resistance between the contact charging member and the image-bearing member can be retained regardless of soiling by mixing of the transfer residual toner at the contact nip, thereby allowing an effective charging of the image-bearing member by the contact charging member.

The transfer residual toner attached in mixture to the contact charging member is charged to a polarity identical to that of a charging bias voltage applied from the charging member to the image-bearing member owing to the charging bias voltage, and is then gradually discharged out of the contact charging member, and moved along with the image-bearing member surface to reach a developing section and be recovered thereat in the developing-cleaning step.

By repetition of the image forming cycle, the electroconductive fine powder contained in the magnetic toner is transferred onto the image-bearing member surface in the developing section and conveyed along with the movement of the image-bearing member surface via the transfer section to react the charging section, thus effecting a continual supply of the electroconductive fine powder to the charging section. As a result, even if the electroconductive fine powder is lost to some extent by falling-down, the lowering in charging performance thereby is prevented to stably retain good charging performance.

In the case of using a magnetic toner containing such electroconductive fine powder in an amount sufficient to ensure a good charging performance by overcoming the charging obstruction due to insulating transfer residual toner attached in mixture to the contact charging member by positive presence of the electroconductive fine powder at the contact nip between the image-bearing member and the contact charging member, there can be encountered with difficulty in ensuring good image quality due to image density lowering and increased fog as a result of a lower magnetic toner content in the developer container immediately before the toner replenishment.

Also in a conventional image forming apparatus equipped with a cleaning mechanism, in the case of using a magnetic toner containing electroconductive fine powder, the above-mentioned difficulties of image density lowering and increased fog have occurred at the time when the image formation is continued until the amount of the toner is reduced in the developer vessel, due to a concentration change in the toner mixture caused by a selective consumption or a selective remaining of the electroconductive fine powder in the developing step. As a countermeasure to this problem, it has been known to securely attach the electroconductive fine powder onto the magnetic toner particles, thereby reducing the selective consumption or localization of the electroconductive fine powder to prevent the image density lowering and increased fog.

In the case of using a magnetic toner contains electroconductive fine powder in a cleanerless image forming method, the localization of electroconductive fine powder adversely affects the image forming performances more seriously. As mentioned above, a portion of electroconductive fine powder contained in a magnetic toner transferred in an appropriate amount to the image-bearing member together with the magnetic toner particles is transferred together with the toner image toward the transfer material but the remaining major portion of the electroconductive fine powder remains attached on the image-bearing member.

In the cleanerless image forming method, the transfer residual toner and the remaining portion of the electroconductive fine powder after the transfer step are moved as they are to reach the charging section. In this instance, the proportion of the electroconductive fine powder reaching the charging section is clearly larger than that in the original magnetic toner due to a difference in transferability between the electroconductive fine powder contained in the charging section, and is then gradually discharged and moved together with the transfer residual toner to the developing(-cleaning) section to be recovered thereat. Due to the recovered magnetic toner containing a larger proportion of electroconductive fine powder, the localization or concentration disturbance by the electroconductive fine powder can be remarkably accelerated to result a remarkable lowering in image density affecting the image quality.

For overcoming the problem of localization or concentration change, if the above-mentioned measure of secure attachment of electroconductive fine powder onto magnetic toner particles adopted in the conventional image forming apparatus equipped with a cleaning mechanism is similarly adopted in a cleanerless image forming system, the electroconductive fine powder is transferred together with the magnetic toner particles toward the transfer material, thus failing to realize sufficient supply to and presence at the charging section of the electroconductive fine powder. As a result, intimate contact between the charging member and the image-bearing member is failed and the chargeability of the image-bearing member is lowered to result in fog and image soiling. The use of a magnetic toner containing electroconductive fine powder in a cleanerless image forming system using a contact charging member has involved such serious difficulties.

As a result of our study, it has been clarified that the above-mentioned problem of localization or concentration disturbance due to inclusion of electroconductive fine powder in a magnetic toner used in a cleanerless image forming system (which per se is desirable from ecological viewpoints, such as freeness from the occurrence of waste toner, and suppression of discharge products, such as ozone, owing to the inclusion of a contact charging member allowing the direct injection charging mechanism) by using a magnetic toner having a weight-average particle size (D4) of 3–10 μm as well as the above-mentioned specific circularity requirement.

A magnetic toner having a weight-average particle size of below 3 μm exhibits a lower flowability and a higher liability of movement together with the electroconductive fine powder, thus promoting the transfer of the electroconductive fine powder in the transfer step to reduce the supply of the electroconductive fine powder to the charging section. As a result, the charging obstruction due to the transfer residual toner is predominant, thus being liable to result in fog and image soiling.

In the case of using a magnetic toner having a weight-average particle size above 10 μm, the chargeability of the magnetic toner particles is liable to be remarkably decreased when the amount of electroconductive fine powder is increased. As a result, if the amount of the electroconductive fine powder is increased to a level sufficient to maintain an intimate contact between the contact charging member and the image-bearing member at the charging section, the chargeability of the magnetic toner particles can be excessively lowered to exhibit a lower developing performance. As a result, even by a slight degree of concentration disturbance due to recovery of the magnetic toner containing a larger proportion of electroconductive fine powder in the developing-cleaning step, the difficulty of image density lowering leading to inferior image quality is liable to occur. In order to ensure stable chargeability and developing performance, the magnetic toner may preferably have a weight-average particle size of 4.0–8.0 μm.

Also from the viewpoints of forming high-quality images through faithful reproduction of minute latent image dots, the magnetic toner weight-average particle size of 3–10 μm, particularly 4.0–8.0 μm, is preferred.

A magnetic toner having a weight-average particle size (D4) below 3 μm is liable to cause a lower transferability resulting in an increased amount of transfer residual toner which leads to difficulties such as toner melt-sticking and increased abrasion of the image-bearing member in the contact charging section. Further, as the flowability and storability of the magnetic toner are lowered due to increased surface area of the entire magnetic toner, it becomes difficult to uniformly charge the individual magnetic toner particles, thus resulting in image irregularities as by fog and lower transferability as well as abrasion and melt-sticking.

If the magnetic toner has a weight-average particle size exceeding 10 μm, character or line images are liable to be accompanied with toner scattering, so that it becomes difficult to realize a high resolution. Further, in a high resolution image forming system, a magnetic toner of D4>8 μm is liable to show a lower one-dot reproducibility.

The particle size distributions and average particle sizes may be measured by using, e.g., COULTER COUNTER Model TA-II or COULTER MULTISIZER (respectively available from Coulter Electronics, Inc.). Herein, these values are determined based on values measured by using COULTER MULTISIZER connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by sing a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned Coulter counter with a 100 μm-aperture to obtain a volume-basis distribution and a number-basis distribution. From the volume-basis distribution, a weight-average particle size (D4) and a volume-average particle size (Dv) are calculated by using a central value as a representative value channel. From the number-basis distribution, a number-average particle size (D1) and a number-basis variation coefficient (S1) is calculated.

The magnetic toner particles may preferably have a resistivity of at least $10^{10}$ ohm.cm, more preferably at least $10^{12}$ ohm.cm. Unless the magnetic toner particles show substantially insulating property, it is difficult to satisfy the developing performance and transferability in combination. Further, charge injection into magnetic toner particles is liable to occur under a developing electric field, so that the charge of the magnetic toner is liable to be disturbed to result in fog.

Figure 2:
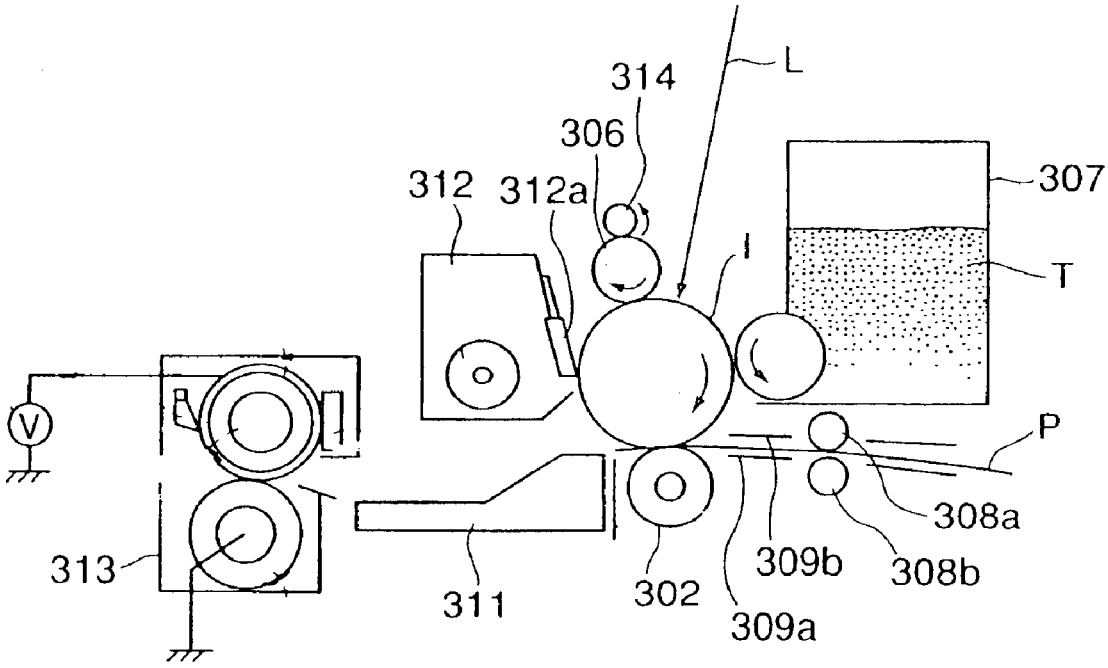
FIGS. 2 and 3 respectively illustrate an embodiment of image forming system according to the invention.
Figure 3:
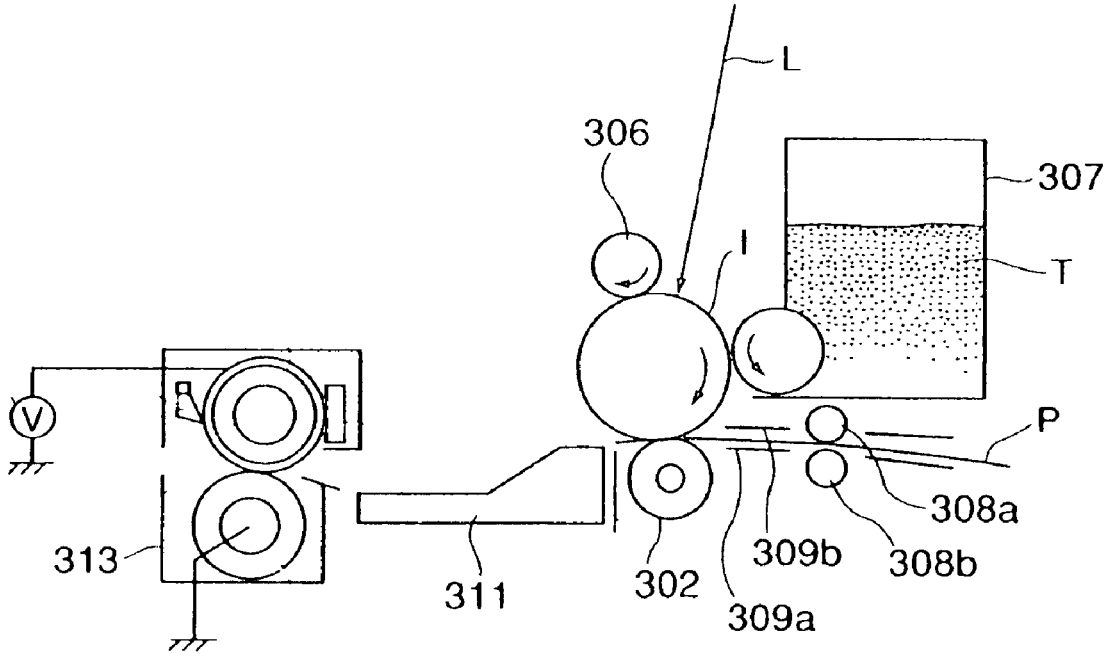

Next, the image forming system (method and apparatus) of the present invention will be described with reference to the drawings. FIGS. 2 and 3 illustrate embodiments having a cleaner and no cleaner, respectively, of the image forming apparatus of the present invention.

Preferring to FIG. 2, the image forming apparatus includes a photosensitive member (photosensitive drum) 1, and a primary charging roller 306, a developing device 307, a transfer charging roller 302, a cleaner 312 and conveyer rollers 308*a*, 30*b*, disposed surrounding the photosensitive member 1. The photosensitive member 1 is charged by the charging roller 306 with the aid of electroconductive fine powder applied on the charging roller 306 from an electroconductive fine powder-application mechanism 314, and exposed to laser light L from a laser light source (not shown) to form an electrostatic image thereon, which is then developed with a dry monocomponent magnetic toner T in the developing device 307 to form a toner image thereon. The toner image is transferred onto a transfer material P by the transfer roller 302 abutted against the photosensitive member 1 via the transfer material P. The transfer material P carrying the toner image is then conveyed via a conveyer guide 311 to a fixing device 313, where the toner image is fixed onto the transfer material P. A minor portion of the magnetic toner remaining on the photosensitive member 1 after the transfer is then cleaned by the cleaning means 312. Incidentally, the cleaning means can be omitted in a system as shown in FIG. 3 wherein the developing device 307 also functions as a cleaning means for cleaning such transfer residual toner on the photosensitive member.

Figure 4:
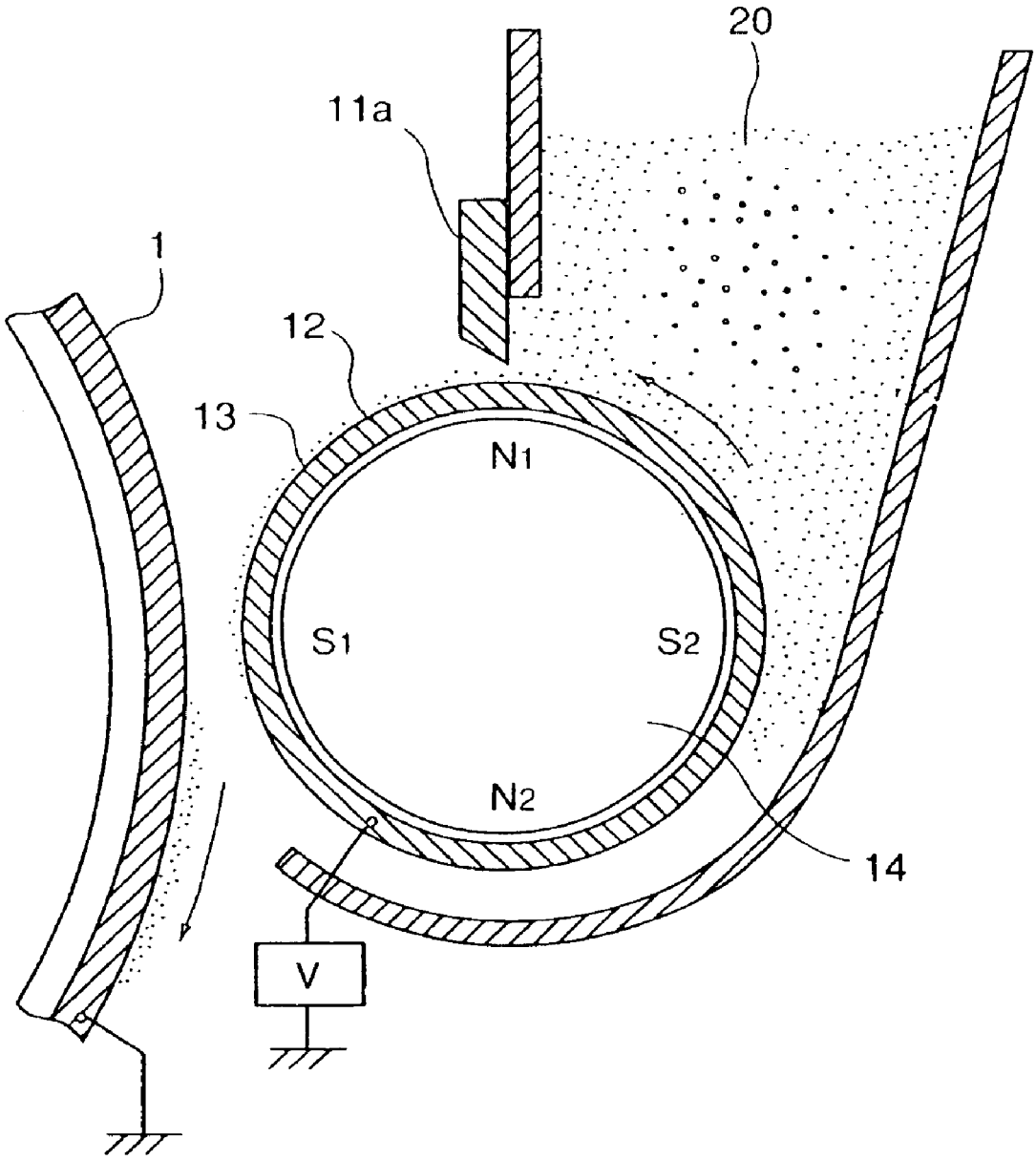
FIG. 4 illustrates a developing device suitable for use in an image forming system of the invention.

FIG. 4 is an enlarged schematic view of such a developing device 307.

Referring to FIG. 4, the developing device (307) includes a cylindrical toner-carrying member (developing sleeve) 12 comprising a non-magnetic metal, such as aluminum or stainless steel, disposed in proximity to a photosensitive member 1. The photosensitive member 1 and the developing sleeve 12 are disposed with a gap of ca. 200 μm therebetween by a sleeve/photosensitive member gap-retaining member (not shown). Inside the rotatable developing sleeve 12, a fixed magnet roller 14 is disposed non-movably and concentrically with the developing sleeve 12.

The fixed magnet roller 14 is provided with a plurality of magnetic poles, as shown, including S1 for development, N1 for regulating toner coating amount, S2 for take-in and conveyance of toner and N2 for preventing toner blow-out. As a member for regulating the amount of magnetic toner attached to and conveyed with the developing sleeve, a magnetic blade 11*a* is disposed so as to regulate the amount of magnetic toner conveyed to a developing region depending on a gap between the magnetic blade 11*a* and the developing sleeve 12. At the developing region, a DC/AC-superposed bias voltage is applied between the photosensitive member 1 and the developing sleeve 12, whereby the magnetic toner on the developing sleeve 12 is caused to fly onto the electrostatic latent image on the photosensitive member 1 to form a magnetic toner image thereon.

Now, a charging step of the image forming method of the present invention will be described.

In the charging step, the image-bearing member (photosensitive member) is charged by a charging member supplied with a voltage and contacting the image-bearing member so as to form a contact nip with the image-bearing member.

In the image forming method of the present invention, the above-mentioned electroconductive fine powder is preferably present at the contact nip between the charging member and the image-bearing member, e.g., by application of electroconductive fine powder on the charging roller 306 from the electroconductive fine powder-application mechanism (roller 314, etc.). Accordingly, the charging member may preferably be provided with elasticity, and electroconductivity so as to charge the image-bearing member while being supplied with a voltage. For this purpose, the charging member may preferably comprise an elastic electroconductive roller, a magnetic brush contact charging member comprising a magnetic brush of magnetically constrained magnetic particles and contacting the image-bearing member, or an electroconductive fiber brush contacting the image-bearing member.

From the viewpoint of temporarily recovering transfer residual toner on the image-bearing member and carrying the electroconductive fine powder for advantageously effecting direct injection charging, the contact charging member may preferably comprise an elastic electroconductive roller or a rotatable charging brush roller, as a flexible member.

If the contact charging member has a flexibility, the electroconductive fine powder is provided with an increased opportunity of contacting the image-bearing member at the contact nip with the image-bearing member, thereby exhibiting an improved direct injection charging performance through a high contactivity. As the contact charging member intimately contacts the image-bearing member via the electroconductive fine powder to rub the image-bearing member surface without gap with the electroconductive fine powder present at the contact nip between the contact charging member and the image-bearing member, the charging of the image-bearing member by the contact charging member is predominantly governed by stable and safe direct injection charging mechanism free from discharge phenomenon, whereby a high charging efficiency not achievable by the conventional roller charging scheme can be realized to provide the image-bearing member with a potential almost identical to the voltage applied to the contact charging member.

It is preferred to provide a relative surface speed difference between the contact charging member and the image-bearing member. As a result, the opportunity of the electroconductive fine powder contacting the image-bearing member at the contact position between the contact charging member and the image-bearing member is remarkably increased, thereby further promoting the direct injection charging to the image-bearing member via the electroconductive fine powder.

As the electroconductive fine power is present at the contact position between the contact charging member and the image-bearing member, the electroconductive fine powder exhibits a lubricating effect (i.e., friction-reducing effect), so that it becomes possible to provide such a relative surface speed difference between the contact charging member and the image-bearing member without causing a remarkable increase in torque acting between these members or a remarkable abrasion of these members.

Such a relative surface speed difference may be provided by rotating the contact charging member and the image-bearing member with a certain peripheral speed ratio.

It is preferred that the charging member and the image-bearing member are moved in mutually opposite directions at the contact part. This is preferred in order to enhance the effect of temporarily damming and leveling the transfer-residual toner particles on the image-bearing member brought to the contact charging member. This is for example accomplished by driving the contact charging member in rotation in a direction and also driving the image-bearing member in rotation so as to move the surfaces of these members in mutually opposite directions. As a result, the transfer-residual toner particles on the image-bearing member are once released from the image-bearing member to advantageously effect the direct injection charging and suppress the obstruction of the latent image formation.

It is possible to provide a relative surface speed difference by moving the charging member and the image-bearing member in the same direction. However, as the charging performance in the direct injection charging depends on a moving speed ratio between the image-bearing member and the contact charging member, a larger moving speed is required in the same direction movement in order to obtain an identical relative movement speed difference than in the opposite direction movement. This is disadvantageous. Further, the opposite direction movement is more advantageous also in order to attain the effect of leveling the transfer-residual toner particle pattern on the image-bearing member.

Such a relative speed difference may be represented by a relative (movement) speed ratio as determined by the following formula:

$$\text{Relative speed ratio } (\%) = |[(Vc - Vp)/Vp] \times 100|,$$

wherein Vp denotes a surface moving speed of the image-bearing member, Vc denotes a surface moving speed of the charging member of which the sign is taken positive when the charging member surface moves in the same direction as the image-bearing member surface at the contact position.

The relative (movement) speed ratio is generally in the range of 10–500%, but preferably above 100%, more preferably 150% or higher.

Also from the viewpoints of temporarily recovering the transfer-residual toner on the image-bearing member and carrying the electroconductive fine powder to advantageously effect the direct injection charging, it is preferred to use a flexible charging member, such as a conductive elastic charging roller or a rotatable charging brush roller, as mentioned above as a contact charting member.

The contact charging member may assume a form of, e.g., a charging roller, a charging blade or an electroconductive brush, and achieves advantages, such as no necessity of using a high voltage and reduction of discharge products, such as ozone.

The charging roller or charging blade as a contact charging member may preferably comprise an electroconductive rubber, which may be surface-coated with a release film comprising, e.g., nylon resin, PVdF (polyvinylidene fluoride), PVdC (polyvinylidene chloride) or fluorine-containing acrylic resin, so as to alleviate the attachment of transfer-residual toner.

Too low a hardness of the elastic conductive roller results in a lower contact with the image-bearing member because of an unstable shape and abrasion or damage of the surface layer due to the electroconductive fine powder present at the contact part between the charging member and the image-bearing member, thus being difficult to provide a stable chargeability of the image-bearing member. On the other hand, too high a hardness makes it difficult to ensure a contact part with the image-bearing member and results in a poor microscopic contact with the image-bearing member surface, thus making it difficult to attain a stable chargeability of the image-bearing member. From these viewpoints, it is further preferred that the elastic conductive roller has an Asker C hardness of at most 50 deg., more preferably 25–50 deg.

In addition to the elasticity for attaining a sufficient contact with the image-bearing member, it is important for the elastic conductive roller to function as an electrode having a sufficiently low resistance for charging the moving image-bearing member. On the other hand, in case where the image-bearing member has a surface defect, such as a pinhole, it is necessary to prevent the leakage of voltage. In the case of an image-bearing member such as an electrophotographic photosensitive member, in order to have sufficient charging performance and leakage resistance, the elastic conductive roller may preferably have a resistivity of $10^3$–$10^8$ ohm.cm, more preferably $10^4$–$10^7$ ohm.cm. The resistivity values of an elastic conductive roller described herein are based on values measured by pressing the roller against a 30 mm-dia. cylindrical aluminum drum under an abutting pressure of 49 N/m and applying 100 volts between the core metal of the roller and the aluminum drum.

Such an elastic conductive roller may be prepared by forming a medium resistivity layer of rubber or foam material on a core metal. The medium resistivity layer may be formed in a roller shape on the core metal from an appropriate composition comprising a resin (of, e.g., urethane), conductor particles (of, e.g., carbon black), a vulcanizer and a foaming agent. Thereafter, a post-treatment, such as cutting or surface polishing, for shape adjustment may be performed to provide an elastic conductive roller. The elastic conductive roller may preferably have a surface provided with minute cells or unevennesses so as to stably retain the electroconductive fine powder.

The cells may preferably have concavities providing an average cell diameter corresponding to spheres of 5–300 μm and also a void areal percentage at the surface of 15–90%.

If the average cell diameter is below the above-mentioned range, the supply of the electroconductive fine powder is liable to be short, and in excess of the above-mentioned range, the durability of the roller member is liable to be impaired. The average cell diameter is a spherical diameter when each cell or surface cavity is regarded as a part of a sphere, and can be measured by a scanning electron microscope. An image analyzer can be used as desired at that time.

Further, if the void percentage is below the above-mentioned range, the electro-conductive fine powder supply is liable to be short, and in excess of the above-mentioned range, the durability of the roller member is liable to be short.

The elastic conductive roller may be formed of other materials. A conductive elastic material may be provided by dispersing a conducive substance, such as carbon black or a metal oxide, for resistivity adjustment in an elastomer, such as ethylene-propylene-diene rubber (EPDM), urethane rubber, butadiene-acrylonitrile rubber (NBR), silicone rubber or isoprene rubber. It is also possible to use a foam product of such an elastic conductive material. It is also possible to effect a resistivity adjustment by using an ionically conductive material alone or together with a conductor substance as described above.

The elastic conductive roller is disposed under a prescribed pressure against the image-bearing member while resisting the elasticity thereof to provide a charging contact part (or portion) between the elastic conductive roller and the image-bearing member. The width of the contact part is not particularly restricted but may preferably be at least 1 mm, more preferably at least 2 mm, so as to stably provide an intimate contact between the elastic conductive roller and the image-bearing member.

The charging member used in the charging step of the present invention may also be in the form of a brush comprising conductive fiber so as to be supplied with a voltage to charge the image-bearing member. The charging brush may comprise ordinary fibrous material containing a conductor dispersed therein for resistivity adjustment. For example, it is possible to use fiber of nylon, acrylic resin, rayon, polycarbonate or polyester.

Examples of the conductor may include fine powder of electroconductive metals, such as nickel, iron, aluminum, gold and silver; electroconductive metal oxides, such as iron oxide, zinc oxide, tin oxide, antimony oxide and titanium oxide; and carbon black. Such conductors can have been surface-treated for hydrophobization or resistivity adjustment, as desired. These conductors may appropriately be selected in view of dispersibility with the fiber material and productivity.

The charging brush as a contact charging member may include a fixed-type one and a rotatable roll-form one. A roll-form charging brush may be formed by winding a tape to which conductive fiber pile is planted about a core metal in a spiral form. The conductive fiber may have a thickness of 1–20 denier (fiber diameter of ca. 10–500 μm) and a brush fiber length of 1–15 mm arranged in a density of $10^4$–$3\times10^5$ fibers per inch ($1.5\times10^7$–$4.5\times10^8$ fibers per $m^2$).

The charging brush may preferably have as high a density as possible. It is also preferred to use a thread or fiber composed of several to several hundred fine filaments, e.g., threads of 300 denier/50 filaments, etc., each thread composed of a bundle of 50 filaments of 300 denier. In the present invention, however, the charging points in the direct injection charging are principally determined by the density of electroconductive fine powder present at the contact part and in its vicinity between the charging member and the image-bearing member, so that the latitude of selection of charging member materials has been broadened.

Similarly as the elastic conductive roller, the charging brush may preferably have a resistivity of $10^3$–$10^8$ ohm.cm, more preferably $10^4$–$10^7$ ohm.cm so as a to provide sufficient chargeability and leakage resistance of the image-bearing member.

Commercially available examples of the charging brush materials may include: electro-conductive rayon fiber "REC-B", "REC-C", "REC-M1" and "REC-M10" (available from Unitika K.K.), "SA-7" (Toray K.K.), "THUNDERRON" (Nippon Sanmo K.K.), "BELTRON" (Kanebo K.K.), "KURACARBO" (carbon-dispersed rayon, Kuraray K.K.) and "ROABAL" (Mitsubishi Rayon K.K.), "REC-B", "REC-C", "REC-M1" and "REC-M10" are particularly preferred in view of environmental stability.

It is preferred to control the amount of electroconductive fine powder present at the contact position between the image-bearing member and the contact charging member at an appropriate level. If the amount is too small, the lubricating effect of the electroconductive fine powder cannot be sufficiently attained but results in a large friction between the image-bearing member and the contact charging member, so that it becomes difficult to drive the contact charging member in rotation with a speed difference relative to the image-bearing member. As a result, the drive torque increases, and if the contact charging member is forcibly driven, the surfaces of the contact charging member and the image-bearing member are liable to be abraded. Further, as the effect of increasing the contact opportunity owing to the electroconductive fine powder is not attained, it becomes difficult to attain a sufficient chargeability of the image bearing member. On the other hand, if the electroconductive fine powder is present in an excessively large amount, the falling of the electroconductive fine powder from the contact charging member is increased, thus being liable to cause adverse effects, such as obstruction of latent image formation as by interception of imagewise exposure light.

In view of the above, the amount of the electroconductive fine powder at the contact position between the image-bearing member and the contact charging member is preferably at least $10^3$ particles/$mm^2$, more preferably $10^3$–$5\times10^5$ particles/$mm^2$, further preferably $10^4$–$5\times10^5$ particles/$mm^2$. Below $10^3$ particles/$mm^2$, it becomes difficult to attain sufficient lubrication effect and opportunity of contact, thus being liable to result in a lower chargeability. Below $10^4$ particles/$mm^2$, some lowering in chargeability can occur in case of an increased amount of transfer residual toner.

The appropriate range of amount of the electroconductive fine powder on the image-bearing member in the charging step, is also determined depending on a density of the electroconductive fine powder affecting the uniform charging on the image-bearing member.

It is needless to say that the image-bearing member has to be charged more uniformly than at least a recording resolution. However, in view of a human eye's visual characteristic, at spatial frequencies exceeding 10 cycles/mm, the number of discriminatable gradation levels approaches infinitely to 1, that is, the discrimination of density irregularity becomes impossible. As a positive utilization of this characteristic, in the case of attachment of the electroconductive fine powder on the image-bearing member, it is effective to dispose the electroconductive fine powder at a density of at least 10 cycles/mm and effect the direct injection charging.

Even if charging failure is caused at sites with no electroconductive fine powder, an image density irregularity caused thereby occurs at a spatial frequency exceeding the human visual sensitivity, so that no practical problem is encountered on the resultant images.

As to whether a charging failure is recognized as density irregularity in the resultant images, when the application density of the electroconductive fine powder is changed, only a small amount (e.g., 10 particles/$mm^2$) of electroconductive fine powder can exhibit a recognized effect of suppressing density irregularity, but this is insufficient from a viewpoint as to whether the density irregularity is tolerable to human eyes. However, an application amount of $10^2$ particles/$mm^2$ results in a remarkably preferable effect by objective evaluation of the image. Further, an application density of $10^3$ particles/$mm^2$ or higher results in no image problem at all attributable to the charging failure.

In the charging step based on the direct injection charging mechanism as basically different from the one based on the discharge charging mechanism, the charging is effected through a positive contact between the contact charging member and the image-bearing member, but even if the electroconductive fine powder is applied in an excessively large density, there always remain sites of no contact. This however results in practically no problem by applying the electroconductive fine powder while positively utilizing the above-mentioned visual characteristic of human eyes.

However, the application of the direct injection charging scheme for uniform charging of the image-bearing member in a developing-cleaning image forming method causes a lowering in charging performance due to attachment and mixing with the charging member of the transfer residual toner. For suppressing the attachment and mixing with the charging member of the transfer residual toner and overcoming the charging obstruction thereby to well effect the direct injection charging, it is preferred that the electroconductive fine powder is present at a density of $10^4$ particles/$mm^2$ or higher at the contact position between the image-bearing member and the contact charging member.

The upper limit of the amount of the electroconductive fine powder present on the image-bearing member is determined by the formation of a densest mono-particle layer of the electroconductive fine powder. In excess of the amount, the effect of the electroconductive fine powder is not increased, but an excessive amount of the electroconductive fine powder is liable to be present on the image-bearing member after the charging step, thus being liable to cause difficulties, such as interruption or scattering of imagewise exposure light.

Thus, a preferable upper amount of the electroconductive fine powder may be determined as an amount giving a densest mono-particle layer of the electroconductive fine powder on the image-bearing member while it may depend on the particle size of the electroconductive fine powder and the retentivity of the electroconductive fine powder by the contact charging member.

More specifically, if the electroconductive fine powder is present on the image-bearing member at a density in excess of $5\times10^5$ particles/$mm^2$ while it depends on the particle size of the electroconductive fine powder, the amount of the electroconductive fine powder falling off the image-bearing member is increased to soil the interior of the image forming apparatus, and the exposure light quantity is liable to be insufficient regardless of the light transmissivity of the electroconductive fine powder. If the amount is suppressed to be $5\times10^5$ particles/$mm^2$ or below, the amount of falling particles soiling the apparatus is suppressed and the exposure light obstruction can be alleviated. As an experimental result, the amount of the electroconductive fine powder in the above-mentioned range at the contact part between the image-bearing member and the contact charging member resulted in amounts of electroconductive fine powder falling on the image-bearing member (i.e., the amount of electroconductive fine powder on the image-bearing member in the latent image forming step) in the range of $10^2$–$10^5$ particles/$mm^2$. Also in view of adverse effect for latent image formation, a preferred range of the electroconductive fine powder at the contact part between the charging member and the image-bearing member is $10^4$–$5\times10^5$ /$mm^2$.

The amounts of the electroconductive fine powder at the charging contact part and on the image-bearing member in the latent image forming step described herein are based on values measured in the following manner. Regarding the amount of the electroconductive fine powder at the contact part, it is desirable to directly measure the value at the contacting surfaces on the contact charging member and the image-bearing member. However, in the case of opposite surface moving directions of the contact charging member and the image-bearing member, most particles present on the image-bearing member prior to the contact with the contact charging member are peeled off by the charging member contacting the image-bearing member while moving in the reverse direction, so that the amount of the electroconductive fine powder present on the contact charging member just before reaching the contact part is taken herein as the amount of electroconductive fine powder at the contact part.

More specifically, in the state of no charging bias voltage application, the rotation of the image-bearing member and the elastic conductive roller is stopped, and the surfaces of the image-bearing member and the elastic conductive roller are photographed by a video microscope ("OVM 1000N", made by Olympus K.K.) and a digital still recorder ("SR-310", made by Deltis K.K.).

For the photographing, the elastic conductive roller is abutted against a slide glass under an identical condition as against the image-bearing member, and the contact surface is photographed at 10 parts or more through the slide glass and an objective lens having a magnification of 1000 of the video microscope. The digital images thus obtained are processed into binary data with a certain threshold for regional separation of individual particles, and the number of regions retaining particle fractions are counted by an appropriate image processing software. Also the electroconductive fine powder on the image-bearing member is similarly photographed through the video microscope and the amount thereof is counted through similar processing.

In the charging step of the image forming method of the present invention, an electroconductive contact charging member (or contact charger) such as a charging roller or a fur brush charger, a magnetic brush charger or a blade charger (charging blade), is caused to contact a photosensitive member (a member-to-be-charged, an image-bearing member) and is supplied with a prescribed charging bias voltage to charge the photosensitive member surface to a prescribed potential of a prescribed polarity. The charging bias voltage applied to the contact charging member may be a DC voltage alone for exhibiting a good charging performance or also a superposition of a DC voltage and an AC voltage (alternating voltage).

The AC voltage may have an appropriate voltage, waveform such as a sine wave, a rectangular wave, a triangular wave, etc. Further, the AC voltage may comprise a pulse wave formed by periodically turning on and off a DC voltage supply. Thus, the AC voltage may have periodically changing voltages.

The AC voltage may preferably have a peak voltage of below 2×Vth (Vth: discharge initiation voltage at the time of DC voltage application). If this condition is not satisfied, the potential on the image-bearing member is liable to be unstable. The AC voltage applied in superposition with a DC voltage may more preferably have a peak voltage below Vth so as to charge the image-bearing member without being substantially accompanied with a discharge phenomenon.

As preferred conditions for driving a charging roller, the roller may be abutted at a pressure of 4.9–490 N/m (5–500 g/cm) and supplied with a DC voltage alone or in superposition with an AC voltage. The DC/AC-superposed voltage, for example, may preferably comprise an AC voltage of 0.5–5 kV (Vpp) and a frequency of 50 Hz to 5 kHz, and a DC voltage of ±0.2–±5 kV.

In another preferred embodiment of the present invention, the charging step may be operated by using a magnetic brush charger comprising a brush of magnetically constraint magnetic particles abutted against the image-bearing member surface and supplied with a voltage to charge the image-bearing member surface.

More specifically, such a magnetic brush charger may comprise a magnet roller as a magnetic force-generating means, a non-magnetic electroconductive sleeve of, e.g., aluminum, stainless steel or an electroconductive resin, disposed rotatably so as to cover an outer periphery of the magnet roller, and a layer of magnetic particles (magnetic brush) held in attachment onto the electroconductive sleeve under a magnetic force exerted by the magnet roller. The magnetic brush is caused to contact the image-bearing member and charge the image-bearing member surface by applying a voltage to the electroconductive sleeve.

The magnetic brush is composed of magnetic particles which comprise electroconductive and magnetically susceptible materials, such as single or mixture crystals like ferrite and magnetite. It is also possible to use conductive and magnetic particles formed of a kneaded mixture of electroconductive and magnetic fine powder with a binder polymer, optionally further coated with a resin layer. Among the above, ferrite particles are preferred, and the ferrite may suitably comprise a metal element, such as copper, zinc, manganese, magnesium, iron, lithium, strontium or barium.

The magnetic particles may preferably have a saturation magnetization of 15 to 70 $Am^2/kg$. If the saturatio magnetization exceeds 70 $Am^2/kg$, because of an excessively large magnetic constraint force, the resultant magnetic brush becomes hard to be prevented from free movement, thus being liable to cause a lower contactivity and charging failure and also promote the wearing of the photosensitive member. If the saturation magnetization is below 15 $Am^2/kg$, the magnetic constraint force is lowered, and the magnetic particles transferred onto the photosensitive member is liable to remain on the photosensitive member without being returned to the magnetic brush, thus causing difficulties, such as charging failure due to reduction of the magnetic particles, and adverse effects on the developing, transfer and fixing steps.

The saturation magnetization values described herein are based on values measured under a magnetic field of 1 kilo-oersted by using an oscillating magnetometer ("VSM-35-15", made by Toei Kogyo K.K.).

The magnetic particles may preferably have an average particle size (Dv.50%, volume-basis median diameter of 10–50 μm). Below 10 μm, the magnetic particles in the brush are liable to attach to the photosensitive member, and the conveyability of the magnetic particles forming the brush is liable to be impaired. Above 50 μm, the contact points between the magnetic particles and the photosensitive member are reduced, thus being liable to lower the uniformity of the injection charging performance. An average particle size of 15–30 μm is further preferred.

Such an average particle size may be adjusted by control of production conditions or by an adjustment of particle size distribution as by classification after the production.

The classification method and apparatus used for production of magnetic particles are not particularly limited. In order to obtain a desired particle size efficiently, it is preferred use a sloped inertia classifier such as "ELBOW JET", a centrifugal separator, such as "DISPERSION SEPARATOR" or "TURBOPLEX", or sieving.

The volume-basis average particle size and particle size distribution of magnetic particles described herein are based on values measured by using a laser diffraction-type particle size distribution meter ("HELOS", made by Nippon Denshi K.K.) combined with a dry dispersion unit ("RODOS", made by Nippon Denshi K.K.) under the conditions of a lens focal distance of 200 mm, a dispersion pressure of 300 kPa and a measurement time of 1–2 sec to effect a measurement in a range of 0.5 μm to 350.0 μm divided into 31 channels to measure the number of particles in each channel and determining a particle size giving a 50%-volume on an accumulative volume-particle size curve as a median particle size (Dv.50%) and % by volume values of particles for respective particle size ranges.

The laser diffraction-type particle size distribution meter ("HELOS") is an apparatus for measurement based on the Franhofer's diffraction principle wherein sample particles are illuminated with laser light from a laser light source to form a diffraction image on a lens focal plane on the opposite side from the light source, and the diffraction image is detected and processed to determine a particle size distribution of the sample particles.

The magnetic particles may preferably have a volume resistivity of $10^4$ to $10^9$ ohm.cm. Below $10^4$ ohm.cm, the pinhole leakage is liable to occur, and above $10^9$ ohm.cm, the photosensitive member is liable to be charged insufficiently. In view of the leakage through magnetic particles, it is further preferred that the charger magnetic particles have a resistivity of $10^6$ ohm.cm or higher.

The volume resistivity values of magnetic particles described herein are based on values measured by placing an amount of magnetic particles between upper and lower electrodes of 2 $cm^2$ in area so as to form a thickness of 1 mm under a load of 1 kg on the upper electrode and applying an voltage of 100 volts between the electrodes in an environment of 23° C./65% RH. From a measured current value, the resistivity is calculated. It is further preferred that the magnetic particles exhibit little resistivity difference between smaller and larger particle sizes.

The magnetic particles may preferably be coated with a surface layer for controlling the resistivity and triboelectric chargeability. The surface layer may assume, e.g., a vapor deposition film, a resin film, an electroconductive resin film, a resin film with an electroconductive agent dispersed therein, or a coupling agent film.

The surface layer need not completely coat the magnetic particles, but the magnetic particles can be partially exposed, e.g., can be coated with a discrete film.

The resin forming the surface coating layer may for example comprise: homopolymers or copolymers of monomers, inclusive of styrene monomers, such as styrene and chlorostyrene: olefins, such as ethylene, propylene, butylene and isobutylene; vinyl esters, such as vinyl acetate, vinyl propionate, vinyl benzoate, and vinyl butyrate; α-methylene aliphatic monocarboxylate, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl esters, such as vinyl methyl ether, vinyl ethyl ether and vinyl butyl ether; and vinyl ketones, such as vinyl methyl ketone, vinyl hexyl ketone, and vinyl isopropenyl ketone. Particularly, in view of the dispersion of electroconductive fine particles and film formability and productivity of the coating layer, polystyrene, styrene-alkyl acrylate copolymers, styrene-acrylonitrile copolymer, styrene-butadiene copolymer, styrene-maleic anhydride copolymer, polyethylene and polypropylene are preferred. It is also preferred to use polycarbonate resin, phenolic resin, polyester, polyurethane, epoxy resin, polyolefin, fluorine-containing resin, silicone resin or polyamide.

Examples of the fluorine-containing resin may include: polyvinyl fluoride, polyvinylidene fluoride, polytrifluoroethylene, polychlororifluoroethylene, polydichlorodifluoroethylene, polytetrafluoroethylene and polyhexafluoropropylene, and solvent-soluble copolymers of these monomers with another monomer.

Examples of electroconductive agent dispersed in the surface layer-forming resin may include: ionicaly conductive powders inclusive of powders of metals, such as copper, nickel, iron, aluminum, gold and silver; metal oxides, such as iron oxide, ferrite, zinc oxide, tin oxide, antimony oxide, and titanium oxide; and carbon black; and further ionic conductive agents, such as lithium perchlorate, and tetraammonium salts.

Examples of the coupling agent may include: titanate coupling agents, such as isopropoxytriisostearoyl titanate, dihydroxybis(lactato)titanium, and diisopropoxybis (acetylacetonato)titanium; aluminum coupling agents, such as acetoalkoxyaluminum diisopropylate; and silane coupling agents, such as dimethylaminopropyltrimethoxysilane, n-octadecyldimethylmethoxysilane, n-hexyltriethoxysilane, 3-aminopropyltrimethoxysilane and n-octadecyltrimethoxysilane. It is possible to introduce a functional group, such as amino or fluoro. The coating with a layer of coupling agent allows the formation of a very thin film of molecular order on the surface of magnetic particles, thus little affecting the resistivity of the magnetic particles, so that the resistivity control of the coating layer need not be effected if the resistivity of the core magnetic particles has been adjusted.

A characteristic feature of the image forming system of the present invention resides in the use of a photosensitive member comprising an electroconductive support and an Si-based non-single crystal photoconductor layer (sometimes representatively called an "a-Si (photosensitive) layer" formed on the electroconductive support. The photosensitive member may be representatively called an "a-Si photosensitive member" sometimes.

The a-Si photosensitive member used in the present invention comprises an electroconductive support and a photosensitive layer of Si-based non-single crystal material (which may be typically amorphous but can be microcrystalline or polycrystalline to some extent unlike a single crystal material) formed on the electroconductive support.

It is possible to dispose a lower charge injection-barier layer below the a-Si photosensitive layer, so as to prevent the charge injection from the support. It is also possible to dispose an upper charge injection barrier layer, an interference-prevention layer (or reflection-prevention layer) or a surface layer, above or below the photosensitive layer, as desired.

In order to have desired properties, the a-Si layer may be formed by incorporating one or more of other doping elements, inclusive of: hydrogen; group III elements, such as boron, aluminum and gallium; group IV elements, such as germanium and tin; group V elements, such as nitrogen, phosphorus and arsenic; group VII elements, such as oxygen, sulfur and selenium; halogen atoms, such as fluorine, chlorine and bromine. An a-Si photosensitive member functioning as a negatively charged image-bearing member may be formed as a combination of layers having controlled properties; e.g., as a combination of a hydrogen-containing a-Si layer as a photosensitive layer, a phosphorus-doped hydrogen-containing a-Si layer as a lower charge injection barrier layer and a boron-doped hydrogen-containing a-Si layer as an upper charge injection-barrier layer.

Figure 5:
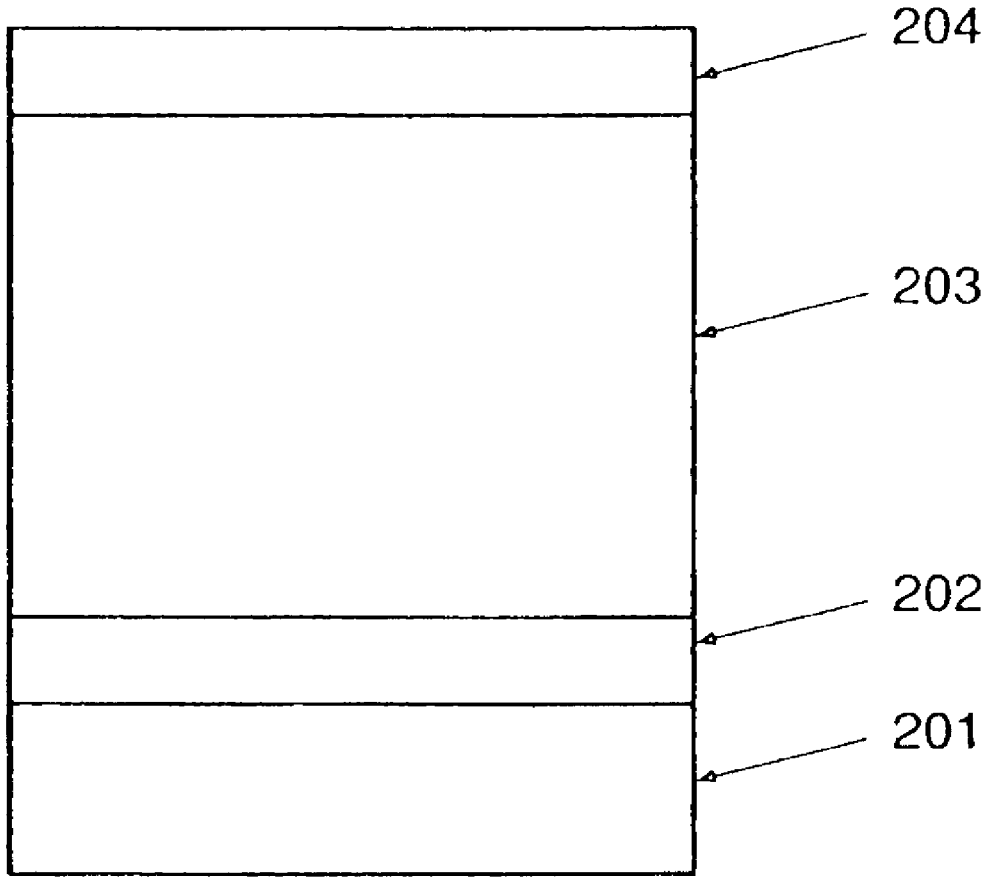
FIGS. 5 and 6 are schematic sectional views for illustrating a sectional organization of an image-bearing member usable in an image forming system according to the invention.
Figure 6:
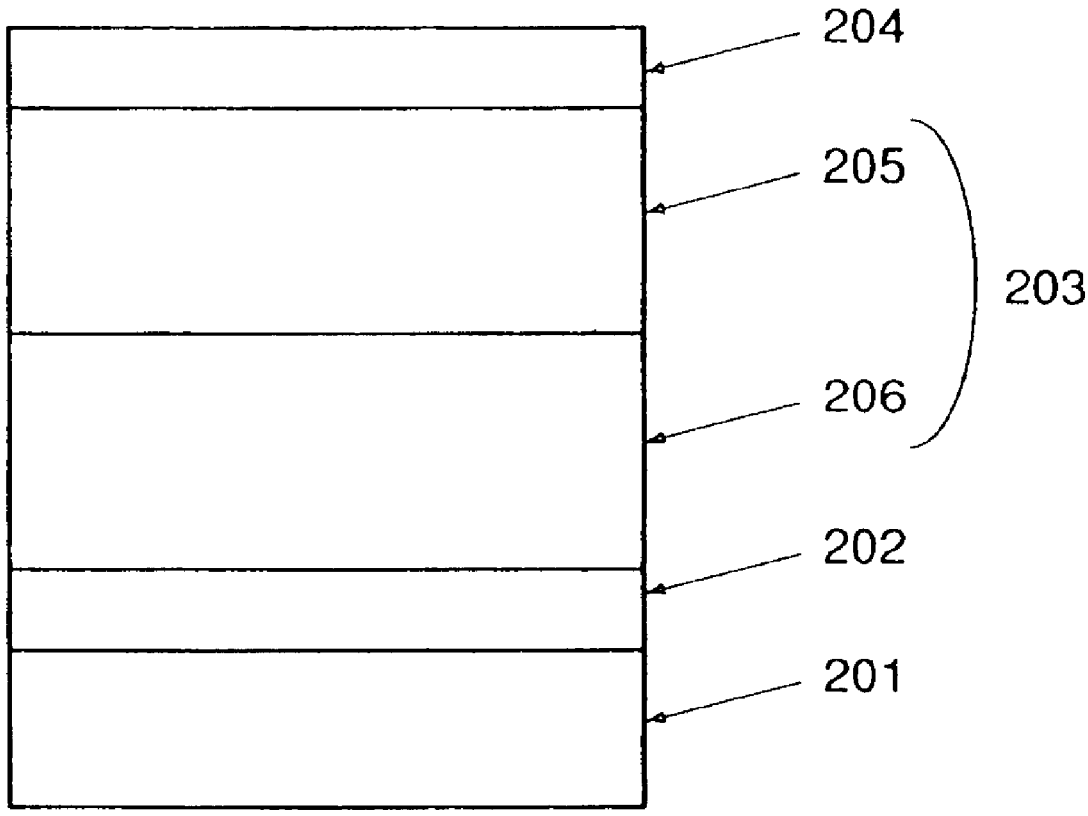

Hereinbelow, some specific examples of layer structure of photosensitive member (image-bearing member) suitably used in the present invention are described with reference to FIGS. 5 and 6, showing a single layer-type photosensitive member including a single photoconductor layer (FIG. 5), and a function separation-type photosensitive member including a photoconductor layer functionally separated into a charge generation layer and a charge transport layer (FIG. 6).

More specifically, the a-Si photosensitive member shown in FIG. 5 includes an electroconductive support 201 of, e.g., aluminum, and a charge injection barrier layer 202, a photoconductor layer 203 and a surface layer 204 successively formed on the electroconductive support 201. The charge injection barrier layer 202 may be disposed as desired for preventing charge injection from the electroconductive support 201 to the photoconductor layer 203. The photoconductor layer 203 comprises at least Si-based non-single crystal material and exhibits photoconductivity. The surface layer 204 may be disposed as desired for retaining a developed image thereon.

The following description will be made on an assumption that the charge injection barrier layer 202 and the surface layer 204 are present except for a case where the presence or absence of the charge injection barrier layer and the surface layer 204 affects the performances concerned.

The a-Si photosensitive member shown in FIG. 6 includes a laminate photoconductor layer 203 which is functionally separated into a charge transport layer 206 comprising an amorphous material containing at least silicon and carbon atoms and a charge generation layer 205 comprising an amorphous material containing at least silicon atom. When the photosensitive member is exposed to light, carriers principally generated in the charge generation layer 205 are passed through the charge transport layer 206 to reach the electroconductive support 201.

The surface layer 204 may be formed from a gas, such as $CH_4$, $C_2H_6$, $C_3H_8$ or $C_4H_{10}$ or a gassifiable hydrocarbon. Such a carbon-source gas may be diluted with a gas, such as $H_2$, He, Ar and Ne.

The electroconductive support 201 may comprise an electro-conductive or -nonconductive substrate. The electroconductive support may be composed of an electroconductive substrate comprising: a metal, such as Al, Cr, Mo, Au, In, Nb, Ge, V, Ti, Pt, Pd or Fe, or an alloy of these metals, such as stainless steel. Alternatively, the electroconductive support may also be formed by coating at least a side of forming a photosensitive layer of an insulating substrate, such as a film or sheet of synthetic resins, such as polyester, polyethylene, polycarbonate, cellulose acetate, polypropylene, polyvinyl chloride, polystyrene or polyamide, or glass or ceramic sheet, with an electroconductive layer.

The electroconductive support 201 may assume a form of a cylinder or an endless belt having a smooth or uneven surface. The thickness thereof may be appropriately determined so as to provide a desirable image-bearing member but may ordinarily be at least 10 μm in view of the production, processing and mechanical strength of the electroconductive support 201.

Particularly, in the case of using coherent light such as laser light capable of causing interferential fringes appearing as image defects in developed images, the electroconductive support 201 may be provided with surface unevennesses within an extent of not causing substantial reduction of photogenerated carriers in a manner as described in JP-A 60-168156, JP-A 60-178457, JP-A 60-225854 and JP-A 61-231561.

As another method of obviating image defect such as interferential fringes caused by coherent light such as laser light, it is possible to dispose an interference-prevention layer, such as a light-absorbing layer, or a like region, within or below the photosensitive layer.

Further, by imparting minute scars onto the electroconductive support surface, the surface roughness of the photosensitive member surface can be controlled. Such scars may be provided by using an abrasive, chemical etching, so-called dry etching in plasma, or sputtering. The depth and size of the scars thus formed may be controlled so as not to cause a substantial decrease in photogenerated carriers.

The photoconductor layer 203 as a part of photosensitive layer may be formed by a vacuum film deposition process under controlled conditions for providing a desired property on the electroconductive support 201 or optionally on the charge injection barrier layer 202.

More specifically, various vacuum film deposition processes, inclusive of glow discharge processes (AC-discharge CVD, such as low-frequency CVD, high-frequency CVD, and microwave CVD, or DC-discharge CVD), sputtering, vacuum evaporation, ion plating, photo-CVD, and thermo-CVD, may be used. These vacuum film deposition processes and conditions thereof may be appropriately selected, in view of investment costs, production scale and desired properties of the resultant photosensitive members, but it is generally suitable to use a glow discharge process, particularly a high-frequency glow discharge process using a power source frequency of RF-band, μW-band or VHF-band.

As is well known, the formation of a photoconductor layer 203 by the glow discharge process may basically be performed by introducing an Si-supply source gas for supplying silicon (Si) atoms, an H-supply source gas for supplying hydrogen (H) atoms and/or an X-supply source gas for supplying halogen (X) atoms into a reaction vessel placeable in a reduced pressure to cause glow discharge therein, thereby forming a layer of a-Si; H,X on an electroconductive support 201 disposed in advance at a prescribed position in the vessel.

In order to compensate for dangling bonds of silicon atoms to provide the layer with improved performances, particularly photoconductivity and charge retention characteristic, it is necessary to have the photoconductive layer 203 contain hydrogen atoms or/and halogen atoms in a proportion of preferably 10–30 atomic %, more preferably 15–25 atomic %, with respect to the total amount of silicon, and hydrogen or/and halogen.

In order to structurally incorporate hydrogen into the photoconductor layer at a controlled percentage so as to form a layer of desired properties, it is desirable to further introduce gas stream of $H_2$ and/or He or a hydrogen-containing silicon compound in a desired mixing ratio. Each source gas can comprise a single species or a mixture of several species in a desired ratio.

Preferred halogen-supply source gas used in the present invention may include: gaseous or gassifiable halogen compounds, such as halogen gas, halogen compounds, and halogen-substituted silane derivatives. It is also possible to use a gaseous or gassifiable halogen-containing hydrogenated silicon compound containing both silicon and halogen. Suitable examples of the halogen compounds usable in the present invention may include: fluorine gas ($F_2$), and inter-halogen compounds, such as BrF, ClF, $ClF_3$, $BrF_3$, $BrF_5$, $IF_3$ and $IF_7$.

Suitable examples of the halogen-containing silicon compounds or so-called halogen-substituted silane derivative may include: silicon fluorides, such as $SiF_4$ and $Si_2F_6$.

The content(s) of hydrogen atom or/and halogen atom contained in the photoconductor layer may be adjusted by controlling the temperature of the electroconductive support 201, rates of introduction of hydrogen- or/and halogen-source gas into the reaction vessel and the intensity of discharge power supply.

The photoconductor 203 may preferably contain a conductivity-controlling atom, which can be contained uniformly in the photoconductor layer 203 or in different concentration in a thickness direction.

The conductivity-controlling atom may be a so-called impurity as used in the semiconductor field, and may be a group IIIb atom in the periodic table for providing a p-type conductivity or a group Vb atom on the periodic table for providing an n-type conductivity.

The group IIIb atoms may include: boron (B), aluminum (Al), gallium (Ga), indium (In) and tallium (Tl), and particularly suitably be B, Al and Ga. The group Vb atoms may include: phosphorus (P), arsenic (As), antimony (Sb) and bismuth, and particularly suitably be P and As.

The conductivity-controlling atom may preferably be contained in the photoconductor layer 203 at a concentration of $1\times10^{-2}$–$\times10^{4}$ atom.ppm, more preferably $5\times10^{-2}$–$5\times10^{3}$ atom.ppm, particularly $1\times10^{-1}$–$1\times10^{3}$ atom.ppm.

For introducing the group IIIb atom or group Vb atom into the photoconductor layer 23, a IIIb atom-source compound or a Vb atom-source compound may be introduced in a gaseous state into the reaction vessel together with other source gases for providing the photoconductor layer 203. The IIIb atom-source compound or the Vb atom-source compound may preferably be a gaseous compound under normal temperature and normal pressure, or at least a compound which can be readily gassifiable under the layer-forming condition.

Specific examples of the IIIb atom-source compound may include: boron-source compounds, inclusive of boron hydrides, such as $B_2H_6$, $B_4H_{10}$, $B_5H_9$, $B_5H_{11}$, $B_6H_{10}$, $B_6H_{12}$, and $B_6H_{14}$, and boron halides, such as $BF_3$, $BCl_3$, and $BBr_3$; and further $AlCl_3$, $GaCl_3$, $Ga(CH_3)_3$, $InCl_3$ and $TlCl_3$.

Specific examples of the Vb atom-source compounds may include: phosphorus-source compounds, inclusive of boron hydrides, such as $PH_3$ and $P_2H_4$, and phosphorus halides, such as $PH_4I$, $PF_3$, $PF_5$, $PCl_3$, $PCl_5$, $PBr_3$, $PBr_5$ and PI3; and further $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$. These conductivity-controlling atom-source compounds may be diluted with $H_2$ and/or He as desired.

It is also effective for the photoconductor layer to contain carbon atom and/or oxygen atom and/or nitrogen atom. The content(s) of the carbon and/or oxygen and/or nitrogen may preferably be in a proportion of $1\times10^{-5}$–10 atm. %, more preferably $1\times10^{-4}$–8 atm. %, further preferably $1\times10^{-3}$–5 atm. %, based on the total of the silicon, carbon, oxygen and nitrogen. The carbon and/or oxygen and/or nitrogen can be contained at a uniform concentration throughout the photoconductor layer 203 or at different concentrations in a thickness direction of the photoconductor layer.

The photoconductor layer 203 may have a thickness determined appropriately depending on the desired electrophotographic performances and economical viewpoints, and preferably a thickness of 1–50 μm, more preferably 5–45 μm, further preferably 10–40 μm.

During the formation of the photoconductor layer 203, the electroconductive support 201 may be held at an optimally set temperature, preferably 200–350° C., more preferably 230–330° C., further preferably 250–310° C.

The support temperature and gas pressure for producing the photoconductor layer 203 should not be determined independently but may desirably be determined in association with each other so as to provide a photosensitive member having desired properties.

The photoconductor layer 203 formed on the electroconductive support 201 may preferably be coated with a surface layer (surfacemost layer) 204 comprising a non-single crystal material. The surface layer 204 has a free surface and is disposed to provide improvements, principally in moisture-resistance, performances in continuous and repetitive use, electrical durability, environmental characteristic and durability.

The surface layer 204 may comprise any non-single crystal material. For example, the surface layer may comprise: amorphous silicon containing hydrogen (H) and/or halogen (X) and further carbon (C) (denoted by "a-SiC:H, X"), amorphous silicon containing hydrogen (H) and/or halogen (X) and further oxygen (O) (denoted by "a-SiO:H, X"), amorphous silicon containing hydrogen (H) and/or halogen (X and further nitrogen (N) (denoted by "a-SiN:H, X"), and amorphous silicon containing hydrogen (H) and/or halogen (X) and further at least one of carbon (C), oxygen (O) and nitrogen (N) (denoted by "a-SiCON:H,X").

The surface layer 204 may be formed through various vacuum film deposition processes, inclusive of glow discharge processes (AC-discharge CVD, such as low-frequency CVD, high-frequency CVD, and microwave CVD, or DC-discharge CVD), sputtering, vacuum evaporation, ion plating, photo-CVD, and thermo-CVD. These vacuum film deposition processes and conditions thereof may be appropriately selected, in view of investment costs, production scale and desired properties of the resultant photosensitive members, but it is generally suitable to use a glow discharge process, similar to the one for production of the photoconductor layer 203.

For example, a surface layer 204 comprising a-SiC:H,X may be produced according to the glow discharge process by introducing a silicon (Si)-source gas, a carbon (C)-source gas, a hydrogen(H)-source gas and/or a halogen (X)-source gas into a reaction vessel placeable in a reduced pressure to cause flow discharge therein to form a layer of a-SiC:H,X on the photoconductor layer 203 already formed on an electroconductive support disposed in advance at a prescribed position in the reaction vessel.

In the surface layer 204 principally comprising SiC, the content of carbon may preferably be 30–90 atm. % based on the total of silicon and carbon atoms. Particularly, by controlling the hydrogen content to 30–70 wt. % in the surface layer, it becomes possible possible to ensure a surface layer of a high hardness exhibiting remarkably improved electrical properties and high-speed continuous image forming performances.

The hydrogen content in the surface layer can be controlled by controlling the $H_2$ gas flow rate, support temperature, discharge power, gas pressure, etc. Further, the content(s) of hydrogen or/and halogen in the surface layer may be controlled by controlling the support temperature, rates of introduction of hydrogen- and/or halogen-source gases, and discharge power, etc.

The carbon, oxygen and/or nitrogen may be contained at constant concentrations throughout the surface layer or at different concentrations in a thickness direction of the surface layer.

The surface layer 204 may preferably contain a conductivity-controlling atom at a concentration which may be constant throughout the surface layer or vary in a thickness direction of the surface layer 204.

The conductivity-controlling atom may be a so-called impurity atom used in the semiconductor field, such as group IIIb atom or group Vb atom, which may be introduced into the reaction in the form of a gaseous or gassifiable source-compound optionally diluted with a gas such as $H_2$, He, Ar or Ne.

The surface layer 204 may preferably be formed in a thickness of 0.01–3 μm, more preferably 0.5–2 μm, further preferably 0.1–1 μm. If the thickness is below 0.01 μm, the surface layer is liable to be lost due to abrasion during the continual use of the photosensitive member, and above 3 μm, the electrophotographic performance of the photosensitive member is liable to be lowered, such as an increased residual potential.

The surface layer 204 having desired properties may be produced while setting the temperature of support and gas pressure in the reaction vessel which may desirably be determined in association with each other so as to provide a surface layer having desired properties.

It is effective to dispose between the photoconductor layer and the surface layer a buffer layer (lower surface layer) containing carbon, oxygen and/or nitrogen at a concentration lower than in the surface layer for the purpose of improving the chargeability of the photosensitive member.

Further, it is also possible dispose between the surface layer 204 and the photoconductive layer 203 a thickness region wherein the concentration of carbon, oxygen and/or nitrogen is decreased toward the photoconductor layer 203. This is effective for improving the adhesion between the surface layer and the photoconductor layer and reducing any interference caused by light reflection at the boundary.

In the present invention, it is further preferred to use a surface layer comprising a non-single crystal carbon hydride film or an amorphous hydrogen-containing carbon film (denoted by "a-C:H").

An a-C:H film also has a high hardness and is excellent in durability. An a-C:H film also has a low friction coefficient and shows excellent water repellency, so that it is possible to obviate image blurring in a high humidity environment without using a heater for obviating the difficulty. Further, it is possible to prevent the attachment of electroconductive fine powder and other particles due to mechanical friction.

The a-C:H surface layer may preferably contain a hydrogen content of 41–60 atm. %, more preferably 45–55 atm. % as calculated by H/(C+H). If the hydrogen content is below 40%, the resultant photosensitive member is liable to show an insufficient sensitivity, thus being unsuitable for an image forming apparatus. Above 60%, the fine texture of the film is liable to be impaired to result in a weaker mechanical strength.

The thickness of the surface layer of the image-bearing member used in the present invention may be optimally set in view of the wearing rate and the life of the image forming apparatus but may ordinarily be 0.01–10 μm, more preferably 0.1–1 μm. Below 0.01 μm, the mechanical strength can be impaired, and above 10 μm, the residual potential is liable to be increased. The surface layer may suitably have a refractive index of ca. 1.8–2.8.

The carbon-source compound may suitably comprise a gaseous or gassifiable hydrocarbon, such as $CH_4$, $C_2H_6$, $C_3H_8$ or $C_4H_{10}$. For easiness of handling and carbon supply efficiency at the time of layer formation, $CH_4$ and $C_2H_6$ are preferred. Such a carbon-source compound or gas may be diluted with another gas, such as $H_2$, Ne, Ar or Ne before introduction to the reaction vessel.

The substrate (electroconductive support) temperature may be adjusted in a range of from room temperature to 350° C. A rather low temperature may be preferred since too high a substrate temperature can result in a film of a lower transparency because of a lowering in band gap. A higher rate of high-frequency power supply is generally preferred so as to sufficiently decompose the hydrocarbon, more specifically at a rate of $5\times10^{-6}$ J/(sec/m$^3$) for the hydrocarbon gas feed, but as too high a power supply rate results in abnormal discharge to deteriorate the properties of the resultant image-bearing member, the power supply rate should be suppressed to a level of not causing abnormal discharge. The discharge space pressure may be held at a level of $1.33\times10^{-2}$–1.33 kPa for a power supply of ordinary RF band (representatively 13.56 MHz, and $1.33\times10^{-5}$–$1.33\times10^{-3}$ kPa for a power supply of VHF band (representatively 50–450 MHz).

The a-C:H surface layer can further contain halogen atom as desired. Particularly, an amorphous carbonaceous film comprising principally carbon and also containing bonded fluorine inside or at the utmost surface of the film (denoted by an "a-C:H:F") layer may exhibit excellent water-repellency and low friction characteristic and can obviate image blurring in a high humidity environment without using a heater for obviating the difficulty.

Such a halogen-containing surface layer may be produced in a similar manner as the a-C:H surface layer except for using a halogen-source gas. Examples of the halogen-source compound may include: $F_2$ and inter-halogen compounds, such as BrF, ClF, $ClF_3$, $BrF_3$, $BrF_5$, $IF_3$ and $IF_7$. For the purpose of fluorine introduction, it is suitable to use a fluorine-containing gas, such as $CF_4$, $CHF_3$, $C_2F_6$, $ClF_3$, $CHClF_2$. $F_2$, $C_3F_8$ or $C_4F_{10}$.

It is also suitable to dispose a layer of amorphous material between the photoconductor layer and the surface layer in order to improve the function of the image-bearing member. Such a layer may for example be composed of non-single crystal silicon, non-single crystal silicon carbide, or non-single crystal carbon hydride.

The photosensitive member (image-bearing member) used in the image forming apparatus of the present invention may preferably include a charge injection-barrier layer (202 as shown in FIGS. 5 and 6) between the electroconductive support (201) and the photoconductor layer (203) for preventing charge injection from the electroconductive support. More specifically, the charge injection-barrier layer has a function of preventing charge injection from the support to the photoconductor layer when the photosensitive member is charged to a prescribed polarity on its free surface but does not show such a function when the photosensitive member free surface is charged to an opposite polarity, thus showing a so-called polarity-dependence. For imparting such a function, the charge injection barrier layer is caused to contain a relatively large amount of conductivity-controlling atom compared with the photoconductor layer.

The conductivity-controlling atom can be contained in the charge injection-barrier layer at a constant concentration or at different concentrations with a certain concentration distribution. In the case of different concentrations, it is preferred that the conductivity-controlling atom is present at a higher concentration in proximity to the support. In any case, it is preferred that the controlling atom is present at a constant concentration in a plane parallel to the substrate surface so as to uniformize the performance in a planar direction.

The conductivity-controlling atom contained in the charge injection barrier layer may be a so-called impurity atom used in the semiconductor field, such as group IIIb atom or group Vb atom.

The charge injection barrier layer may preferably be formed in a thickness of 0.1–5 μm, more preferably 0.3–4 μm, further preferably 0.5–3 μm.

The charge injection barrier layer may produced under conditions, inclusive of diluent gas mixture ratio, gas pressure, discharge power and substrate temperature which may be selected in association with each other from ranges described above for providing an optimum property.

In order to provide a further improved adhesion between the electroconductive support 201 and the photoconductor layer 203 or the charge injection barrier layer 202, it is possible to insert an adhesive layer formed of an amorphous material principally comprising $Si_3N_4$, $SiO_2$ or silicon atom and further containing hydrogen and/or halogen, and carbon and/or oxygen and/or nitrogen. Further, in order to prevent the occurrence of interference fringes due to reflection light from the support, it is possible to dispose a light-absorbing layer.

In the image forming method of the present invention, the image-bearing member (photosensitive member) is primarily charged by a contact charging member to a potential of 250 to 600 volts in terms of an absolute value. If the potential on the image-bearing member is below 250 volts, it becomes difficult to take a balance between the image part density and fog at the background part. On the other hand, in excess of 600 volts, an increased current is required to charge the image-bearing member to such a primary potential level, and image defects due to charge leakage is liable to occur corresponding thereto. For a similar reason, a potential of 250 to 500 volts is further preferred. The polarity (positive or negative) of the primary charge potential may be appropriately be determined in harmony with process steps of developing, charging, electrostatic latent image formation, and transfer of the image forming system (method and apparatus).

The primary charging values described herein are based on values measured in the following manner.

An image-bearing member incorporated in an image forming apparatus is primarily charged by a prescribed charger and a charged position is moved to a point closest to a developing sleeve of a developing device, where the surface potential is measured at three point along a generatrix of the image-bearing member, i.e., at 2 points at distances of 50 mm ±10 mm toward the center from both ends and at 1 point of ±10 mm from the center by a non-contact potentiometer ("Model 344", available from T Rek K.K.).

An average of the three measured values is recorded as a measured primary charging voltage.

The image forming apparatus of the present invention may preferably be free from means for directly warming the image-bearing member, e.g., for minimizing power consumption, but it is not prevented to provide such a warming means as desired.

In the latent image forming step of the image forming method according to the present invention, the charged surface of the image-bearing member may be exposed to imagewise exposure light carrying given image data preferably emitted from an imagewise exposure means to form an electrostatic latent image on the charged surface of the image-bearing member.

The imagewise exposure means is not limited to a laser scanning exposure means suitable for digital latent image formation but can be ordinary analog imagewise exposure means or other light-emitting devices, such as LED, or a combination of light source, such as a fluorescent lamp, and a liquid crystal shutter.

In the developing step of the image forming method according to the present invention, an electrostatic latent image on the image-bearing member is developed with the above-mentioned specific toner carried on a toner-carrying member (e.g., 12, as shown in FIG. 4).

The toner-carrying member may preferably comprise an electroconductive cylinder (developing roller) formed of a metal or alloy, such as aluminum or stainless steel. It is also possible to form such an electroconductive cylinder with a resin composition having sufficient mechanical strength and electroconductivity, or use an electroconductive rubber roller. Instead of such a cylindrical member, it is also possible to use an endless belt which can be driven in rotation.

In the present invention, it is preferred to form a magnetic toner layer 13 at a coating rate of 5–50 g/m$^2$ on the toner-carrying member. If the toner coating rate is below 5 g/m$^2$, it becomes difficult to attain a sufficient image density and the toner layer irregularity is liable to occur due to an excessive charge of the magnetic toner. If the toner coating 2 rate is above 50 g/m$^2$, toner scattering is liable to occur.

The toner-carrying member used in the present invention may preferably have a surface roughness (in terms of JIS center line-average surface roughness (Ra)) in the range of 0.2–3.5 μm.

If Ra is below 0.2 μm, the toner on the toner-carrying member is liable to be charged excessively to have an insufficient developing performance. If Ra exceeds 3.5 μm, the magnetic toner coating layer on the toner-carrying member is liable to be accompanied with irregularities, thus resulting images with density irregularity. Ra is further preferably in the range of 0.5–3.0 μm.

The surface roughness (Ra) values described herein are based on values measurcd at center line average roughness values by using a surface roughness meter "SURFCORDER SE-3OH", available from K.K. Kosaka Kenkyusho) according to JIS B-0601. More specifically, based on a surface roughness curve obtained for a sample surface, a length of a is taken along a center line of the roughness curve. The roughness curve is represented by a function Y=f(x) while setting the X-axis on the center line and a roughness scale (y) on the Y-axis along the length x portion. A center line-average roughness Ra of the roughness curve is determined by the following formula:

$$Ra=(1/a)\int_0^a f(x)dx$$

The toner-carrying member may be provided with a surface roughness Ra in the above-mentioned range, e.g., by adjusting an abrasion state of the surface layer. More specifically, a coarse abrasion of the toner-carrying member surface provides a larger roughness, and a finer abrasion provides a smaller roughness.

As the magnetic toner of the present invention has a high chargeability, it is desirable to control the total charge thereof for use in actual development, so that the toner-carrying member used in the present invention may preferably be surfaced with a resin layer containing electroconductive fine particles and/or lubricating particles dispersed therein.

The electroconductive fine particles dispersed in the coating resin layer of the toner-carrying member may preferably exhibit a resistivity of at most 0.5 ohm.cm as measured under a pressure of 14.7 MPa (120 kg/cm$^2$).

The electroconductive fine particles may preferably comprise carbon fine particles, crystalline graphite particles or a mixture of these, and may preferably have a particle size of 0.005–10 μm.

Examples of the resin constituting the surface layer of the developer-carrying member may include: thermoplastic resin, such as styrene resin, vinyl resin polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, urea resin, silicone resin and polyimide resin; an thermosetting resins.

Among the above, it is preferred to use a resin showing a releasability, such as silicone resin or fluorine-containing resin; or a resin having excellent mechanical properties, such as polyethersulfone, polycarbonate, polyphenylene oxide, polyamide, phenolic resin, polyester, polyurethane resin or styrene resin. Phenolic resin is particularly preferred.

The electroconductive fine particles may preferably be used in 3–20 wt. parts per 10 wt. parts of the resin. In the case of using a mixture of carbon particles and graphite particles, the carbon particles may preferably be used in 1 to 50 wt. parts per 10 wt. parts of the graphite particles. The coating layer containing the electro-conductive fine particles of the toner-carrying member may preferably have a volume resistivity of $10^{-6}$ to $10^{-6}$ ohm.cm, more preferably $10^{-1}$ to $10^{-6}$ ohm.cm.

In the present invention, it is preferred that the magnetic toner 13 on the toner-carrying member 12 is regulated by a ferromagnetic metal blade 11*a* disposed opposite to and with a small gap from the toner-carrying member 12 as shown in FIG. 4, so as to stably retain the powder characteristic and chargeability of the magnetic toner for a long period, thereby providing a magnetic toner with a uniform charge not liable to cause toner scattering without being affected by environmental conditions such as temperature and humidity.

The toner-carrying member may preferably be moved with a speed difference relative to the image-bearing member surface speed so as to sufficiently supply the magnetic toner particles and electroconductive fine powder from the toner-carrying member to the image-bearing member side, thereby providing good images.

In the present invention, the toner-carrying member surface may be moved in a direction which is identical to or opposite to the moving direction of the image-bearing member surface at the developing section. In the case of movement in the identical direction, the toner-carrying member may preferably be moved at a surface velocity which is at least 100% of that of the image-bearing member. Below 100%, the image quality can be lowered in some cases. A higher surface speed ratio supplies a larger amount of toner to the developing section, thus increasing the frequency of attachment onto and returning from the latent image on the image-bearing member of the toner, i.e., more frequent repetition of removal from an unnecessary part and attachment onto a necessary part of the toner, to provide a toner image more faithful to a latent image. The speed ratio can be calculated according to the following formula]

Speed ratio (%)={(toner-carrying member surface speed)/(image-bearing member surface speed)}×100.

A surface speed ratio of 105–300% between the toner-carrying member and the image-bearing member is further preferred.

In the developing region, the toner-carrying member and the photosensitive member are disposed opposite to each other with a certain gap therebetween. In order to obtain fog-free high-quality images, it is preferred to apply the magnetic toner in a layer thickness, which is smaller than the closest gap between the toner-carrying member and the photosensitive member, on the toner-carrying member and effect the development under application of an alternating voltage. The small toner layer thickness on the toner-carrying member may be achieved by the action of the toner layer thickness-regulating member. Thus, the development is effected in a state of no contact between the toner layer on the toner-carrying member and the photosensitive member (image-bearing member) in the developing region. As a result, it is possible to obviate development fog caused by injection of the developing bias voltage to the image-bearing member even if electroconductive fine power having a low resistivity is added into the toner.

More specifically, it is preferred that the toner-carrying member is disposed with a spacing of 100–1000 μm, more preferably 120–500 μm, from the image-bearing member. If the spacing is below 100 μm, the developing performance with the toner is liable to be fluctuated depending on a fluctuation of the spacing, so that it becomes difficult to mass-produce image-forming apparatus satisfying stable image qualities. If the spacing exceeds 1000 μm, the followability of toner onto the latent image on the image-bearing member is lowered, thus being liable to cause image quality lowering, such as lower resolution and lower image density.

In the present invention, it is preferred to operate the developing step under application of an alternating electric field (AC electric field) between the toner-carrying member and the image-bearing member. The alternating developing bias voltage may be a superposition of a DC voltage with an alternating voltage (AC voltage).

The alternating bias voltage may have a waveform which may be a sine wave, a rectangular wave, a triangular wave, etc., as appropriately be selected. It is also possible to use pulse voltages formed by periodically turning on and off a DC power supply. Thus, it is possible to use an alternating voltage waveform having periodically changing voltage values.

It is preferred to form an AC electric field at a peak-to-peak intensity of $3\times10^6$–$10\times10^6$ V/m and a frequency of 100 to 5000 Hz between the toner-carrying member and the image-bearing member by applying a developing bias voltage.

If the AC electric field strength is below $3\times10^6$ V/m, the performance of recovery of transfer-residual toner is lowered, thus being liable to result in foggy images. Further, because of a lower developing ability, images having a lower density are liable to be formed. On the other hand, if the AC electric field exceeds $1\times10^7$ V/m, too large a developing ability is liable to result in a lower resolution because of collapsion of thin lines and image quality deterioration due to increased fog, a lowering in chargeability of the image-bearing member and image defects due to leakage of the developing bias voltage to the image-bearing member.

If the frequency of the AC electric field is below 100 Hz, the frequency of toner attachment onto and toner removal from the latent image is lowered and the recovery of transfer-residual toner is liable to be lowered, thus being liable to result in a lower developing performance. If the frequency exceeds 5000 Hz, the amount of toner following the electric field change is lowered, thus being liable to result in a lowering in transfer-residual toner recovery and a lowering in developing performance.

By applying an alternating electric field as a developing bias voltage, charge injection to the image-bearing member at the developing section is prevented even if a high potential difference is present between the toner-carrying member and the image-bearing member, so that the electroconductive fine powder added in the magnetic toner on the toner-carrying member can be evenly transferred onto the image-bearing member, thereby promoting the uniform contact and charging in the charging section.

Next, a contact transfer step preferably adopted in the image forming method of the present invention will now be described. The transfer step of the present invention can be a step of once transferring the toner image formed in the developing step to an intermediate transfer member and then re-transferring the toner image onto a recording medium, such as paper. Thus, the transfer(-receiving) material receiving the transfer of the toner image from the image-bearing member can be an intermediate transfer member, such as a transfer drum, instead of a transfer material P such as paper as illustrated in FIGS. 2 and 3.

In the present invention, it is preferred to adopt a contact transfer step wherein a toner image on the image-bearing member is transferred onto a transfer(-receiving) material while abutting a transfer(-promoting) member against the image-bearing member via the transfer material, and the abutting pressure of the transfer member may preferably be a linear pressure of at least 2.9 N/m (3 g/cm), more preferably at least 19.6 N/m (20 g/cm). If the abutting pressure is below 2.9 N/m, difficulties, such as deviation in conveyance of the transfer material and transfer failure, are liable to occur.

Figure 7:
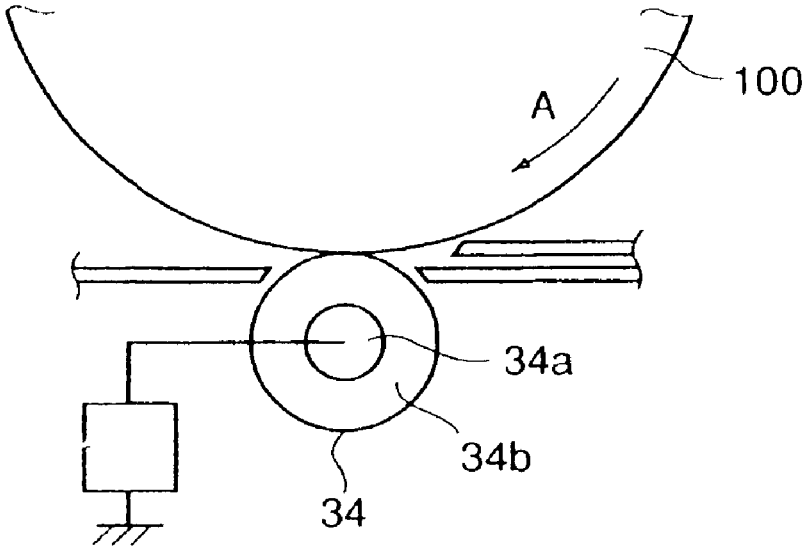
FIG. 7 illustrates a contact transfer means suitably used in an image forming system of the invention.

The transfer member used in the contact transfer step may preferably be a transfer roller as illustrated in FIG. 7 or a transfer belt. Referring to FIG. 7, a transfer roller 34 may comprise a core metal 34*a* and a conductive elastic layer 34*b* coating the core metal 34*a* and is abutted against a photosensitive member 100 so as to be rotated following the rotation of the photosensitive member 100 rotated in an indicated arrow A direction. The conductive elastic layer 34*b* may comprise an elastic material, such as polyurethane rubber or ethylene-propylene-diene rubber (EPDM), and an electroconductivity-imparting agent, such as carbon black, dispersed in the elastic material so as to provide a medium level of electrical resistivity (volume resistivity) of $10^6$–$10^{10}$ ohm.cm. The conductive elastic layer may be formed as a solid or foam rubber layer. The transfer roller 34 is supplied with a transfer bias voltage from a transfer bias voltage supply.

Next, an image forming method including a developing-cleaning step (clearless system) as an embodiment of the present invention will be described.

FIG. 3 schematically illustrates an embodiment of image forming apparatus including a charging roller for the injection charging scheme and designed for achieving a developing-cleaning step (cleanerless system). A cleaning unit including a cleaning member, such as a cleaning blade has been removed from the image forming apparatus, and a layer of the above-mentioned specific magnetic toner (mono-component toner) carried on a toner-carrying member is used to develop a latent image on an image-bearing member while being in no contact with the image-bearing member.

The image forming system includes a rotating drum-type a-Si image-bearing member 1 which is driven in rotation in an indicated arrow direction at a constant peripheral speed (process speed).

A charging roller 306 as a contact charging member is abutted against the image-bearing member 1 at a prescribed pressing force in resistance to its elasticity so as to form a charging contact nip between the image-bearing member 1 and the charging roller 306. The charging roller 306 is driven in rotation in a counterdirection with respect to the image-bearing member (i.e., so as to provide a surface moving direction opposite to that of the image-bearing member) at the charging nip, thus providing a surface speed difference between the image-bearing member 1 and the charging roller 306. The above-mentioned electroconductive fine powder is applied at a uniform coating rate on the surface of the charging roller 306.

The charging roller 306 is provided with a core metal (not shown) to which a DC charging bias voltage is applied from a charging bias voltage supply (not shown). As a result, the image-bearing member 1 surface is uniformly charged to a potential which is almost identical to the DC bias voltage applied to the charging roller 306 according to the direct injection charging scheme.

The thus-charged image-bearing member 1 surface is then exposed to laser light L carrying objective image data to form an electrostatic image thereon, which is then developed with a magnetic toner T supplied from a developing device 307.

The developing device 307 is a non-contact reversal developing device having a structure as shown in FIG. 4, and includes a developing sleeve (toner-carrying member) 1 rotated in an arrow direction so as to provide a prescribed spherical speed in a surface moving direction identical to that of the image-bearing member 1 at a developing section which is a region where the image-bearing member 1 and the developing sleeve 12 are opposite to each other. The magnetic toner 20 (T in FIG. 3) is applied in a thin layer 13 on the developing sleeve 12 under the action of a magnetic field exerted by a magnetic blade 11. Under the action of a magnetic field formed between the magnetic blade 11*a* and a pole N1 of a multi-pole static magnet 14 disposed inside the sleeve 12, the magnetic toner is charged and applied in the thin layer 13 at a regulated thickness. The layer 13 of magnetic toner formed on the developing sleeve 12 is brought to the developing section opposite to the image-bearing member 1, where the magnetic toner is caused to jump onto the electrostatic latent image on the image-bearing member 1 under the action of a developing bias voltage applied to the developing sleeve 12 from a bias voltage supply 21, thereby forming a toner image on the image-bearing member 1 (mono-component jumping development).

Referring to FIG. 3, a transfer roller 302 as a contact transfer means is abutted against the image-bearing member 1 at a prescribed linear pressure to form a transfer nip, where a transfer material P is supplied via conveyer rollers 308*a* and 308*b* and guides 309*a* and 309*b* at a prescribed timing, i.e., in synchronism with the toner image formation on the image-bearing member 1, whereby the toner image on the image-bearing member 1 is successively transferred onto a surface of the transfer material P under the action of a prescribed transfer bias voltage applied to the transfer roller 302 from a transfer bias voltage supply (not shown). The transfer roller 302 is designed to have a prescribed resistance value and supplied with a DC voltage to effect the transfer. The transfer material conveyed to the transfer nip is conveyed through the nip while receiving the toner image on the image-bearing member 1 under the action of an electrostatic force and a pressing force.

The transfer material P having received the toner image at the transfer section is then separated from the image-bearing member 1 and conveyed via a guide 311 to a heat-fixation type fixing device 313, where the toner image is fixed onto the transfer material to form an image product (print or copy), which is then discharged out of the apparatus.

A cleaning unit 312 as included in the apparatus of FIG. 2 has been removed from the apparatus of FIG. 3. As a result, transfer residual toner remaining on the image-bearing member 1 after the toner image transfer onto the transfer material is not removed by such a cleaning unit, and along with the rotation of the image-bearing member 1, is conveyed via the charging section to reach the developing section, where the residual toner is subjected to a developing-cleaning operation to be recovered thereat.

Now, the behavior or movement of the electroconductive fine powder in the above-mentioned cleanerless image forming system will be described.

Electroconductive fine powder mixed in the magnetic toner T in the developing device 307 is moved together with the toner and transferred in an appropriate amount to the photosensitive member (image-bearing member) 1 at the time of developing operation of the developing device 307.

The toner image (composed of toner particles) on the photosensitive member 1 is positively transferred onto the transfer material P (recording medium) under an influence of a transfer bias voltage at the transfer section. However, because of its electroconductivity, the electroconductive fine powder on the photosensitive member 1 is not positively transferred to the transfer material P but substantially remains in attachment onto the photosensitive member 1.

As no cleaning unit is involved in the image forming apparatus of FIG. 3, the transfer-residual toner particles and the electroconductive fine powder remaining on the photosensitive member 1 after the transfer step are, along with the rotation of the photosensitive member 1 , brought to the charging section formed at the contact part between the photosensitive member 1 and the charging roller 306 (contact charging member) to be attached to and mixed with the charging roller 306. As a result, the photosensitive member 1 is charged by direct charge injection in the presence of the electroconductive fine powder at the contact part between the photosensitive member 1 and the charging roller 306.

By the presence of the electroconductive fine powder, the intimate contact and low contact resistivity between the charging roller 306 and the photosensitive member 1 can be maintained even when the transfer-residual toner particles are attached to the charging roller 306, thereby allowing the direct injection charging of the photosensitive member 1 by the charging roller 306.

More specifically, the charging roller 306 intimately contacts the photosensitive member 1 via the electroconductive fine powder, and the electroconductive fine powder rubs the photosensitive member 1 surface without discontinuity. As a result, the charging of the photosensitive member 1 by the charging roller 306 is performed not relying on the discharge charging mechanism but predominantly relying on the stable and safe direct injection charging mechanism, to realize a high charging efficiency that has not been realized by conventional roller charging. As a result, a potential almost identical to the voltage applied to the charging roller 306 can be imparted to the photosensitive member 1.

The transfer-residual toner attached to the charging roller 306 is gradually discharged or released from the charging roller 306 to the photosensitive member 1, and along with the movement of the photosensitive member 1, reaches the developing section where the residual toner is recovered to the developing device 307 in the developing-cleaning operation.

The developing-cleaning step is a step of recovering the toner remaining on the photosensitive member 1 after the transfer step at the time of developing operation in a subsequent cycle of image formation (developing of a latent image formed by recharging and exposure after a previous image forming cycle operation having resulted in the transfer-residual toner particles) under the action of a fog-removing bias voltage of the developing device (Vback, i.e., a difference between a DC voltage applied to the developing device and a surface potential on the photosensitive member). In an image forming apparatus adopting a reversal development scheme adopted in this embodiment, the developing-cleaning operation is effected under the action of an electric field of recovering toner particles from a dark-potential part on the photosensitive member and an electric field of attaching toner particles from the developing sleeve and a light-potential part on the photosensitive member, respectively, exerted by the developing bias voltage.

As the image-forming apparatus is operated, the electroconductive fine powder contained in the magnetic toner T in the developing device 307 is transferred to the photosensitive member 1 surface at the developing section, and moved via the transfer section to the charging section along with the movement of the photosensitive member 1 surface, whereby the charging section is successively supplied with fresh electroconductive fine powder. As a result, even when the electroconductive fine powder is reduced by falling, etc., or the electroconductive fine powder at the charging section is deteriorated, the chargeability of the photosensitive member 1 at the charging section is prevented from being lowered and good chargeability of the photosensitive member 1 is stably retained.

In this way, in the image forming apparatus including a contact charging scheme, a transfer scheme and a toner recycle scheme, the photosensitive member 1 (as an image-bearing member) can be uniformly charged at a low application voltage by using a simple charging roller 306. Further, the direct injection charging of the ozonless-type can be stably retained to exhibit uniform charging performance even though the charging roller 306 is soiled with transfer-residual toner particles. As a result, it is possible to provide an inexpensive image forming apparatus of a simple structure free from difficulties, such as generation of ozone products and charging failure.

As mentioned above, it is necessary for the electroconductive fine powder to have a resistivity of at most $1\times10^9$ ohm.cm for not impairing the charging performance.

As a result, in a developing device wherein a magnetic toner directly contacts a photosensitive member, charges are injected to the photosensitive member via the electroconductive fine powder in the developer at the developing section under the application of a developing bias voltage. However, a non-contact developing device is used in this embodiment, so that good images can be formed without causing charge injection to the photosensitive member by the developing bias voltage. Further, as the charge injection to the photosensitive member is not caused at the developing section, it is possible to provide a high potential difference between the sleeve (12 in FIG. 4) and the photosensitive member 1 as by application of an AC bias voltage. As a result, it becomes possible to uniformly apply the electroconductive fine powder onto the photosensitive member 1 surface to achieve uniform contact at the charging section to effect the uniform charging, thereby obtaining good image.

Owing to the lubricating effect (friction-reducing effect) of the electroconductive fine powder present at the contact part between the charging roller 306 and the photosensitive member 1, it becomes possible to easily and effectively provide a speed difference between the charging roller 306 and the photosensitive member 1. Owing to the lubricating effect, the friction between the charging roller 306 and the photosensitive member 1 is reduced, the drive torque is reduced, and the surface abrasion or damage of the charging roller 306 and the photosensitive member 1 can be reduced. As a result of the speed difference, it becomes possible to remarkably increase the opportunity of the electroconductive fine powder contacting the photosensitive member 1 at the contact part (charging section) between the charging roller 306 and the photosensitive member 1, thereby allowing good direct injection charging.

In this embodiment, the charging roller 306 is driven in rotation to provide a surface moving direction which is opposite to that of the photosensitive member 1 surface at the charging section, whereby the transfer-residual toner particles on the photosensitive member 1 brought to the charging section are once recovered by the charging roller 1 to level the density of the transfer-residual toner particles present at the charging section. As a result, it becomes possible to prevent charging failure due to localization of the transfer-residual toner particles at the charging section, thereby achieving stabler charging performance.

Hereinbelow, the present invention will be described more specifically based on Examples which however should not be construed to restrict the scope of the present invention.

(Magnetic Powders)

Surface-treated magnetic powders 1–6 and Untreated magnetic powder 1 were prepared in the following manner.

<Surface-treated Magnetic Powder 1>

Into a ferrous sulfate aqueous solution, a causitic soda solution in an amount of 1.0–1.1 equivalent of the ferrous ion was added and mixed to prepare an aqueous solution containing ferrous hydroxide.

While maintaining the pH at ca. 9, air was blown into the aqueous solution to cause oxidation at 80–90° C., thereby forming a slurry containing seed crystals.

Then, into the slurry, a ferrous sulfate aqueous solution in an amount of 0.9–1.2 equivalent of the alkali (i.e., sodium in the caustic soda solution) was added, and while maintaining the pH of the slurry at 8, air wax blown into the slurry to proceed with oxidation. After the oxidation, the resultant magnetic iron oxide powder was washed and once recovered by filtration. A small portion of the wet sample was sampled to measure the moisture content. Then, the wet sample (without drying) was re-dispersed in a separate aqueous medium, and the pH of the dispersion liquid was adjusted to ca. 6. Then, into the dispersion liquid under sufficient stirring, a silane coupling agent ($n\text{-}C_{10}H_{21}Si(OCH_3)_3$) in an amount of 1.9 wt. parts per 100 wt. parts of the magnetic iron oxide (of which the amount was measured in advance by subtracting the moisture content from the wet magnetic iron oxide weight) was added to effect a coupling treatment. The resultant hydrophobic iron oxide powder was washed, filtered out and dried in an ordinary manner, followed by disintegration of slight agglomerate thereof to obtain Surface-treated magnetic power 1.

<Surface-treated Magnetic Powder 2>

Surface-treated magnetic powder 2 was prepared similarly as Surface-treated magnetic powder 1 except for using n-$C_6H_{13}Si(OCH_3)_3$ as the silane coupling agent.

<Surface-treated Magnetic Powder 3>

Surface-treated magnetic powder 3 was prepared similarly as Surface-treated magnetic powder 1 except for using n-$C_{18}H_{37}Si(OCH_3)_3$ as the silane coupling agent.

<Surface-treated Magnetic Powder 4>

Surface-treated magnetic powder 4 was prepared similarly as Surface-treated magnetic powder 1 except for using 1.0 wt. part of n-$C_4H_9Si(OCH_3)_3$ as the silane coupling agent.

<Surface-treated Magnetic Powder 5>

Surface-treated magnetic powder 5 was prepared similarly as Surface-treated magnetic powder 1 except for using 0.7 wt. part of n-$C_4H_9Si(OCH_3)_3$ as the silane coupling agent.

<Surface-treated Magnetic Powder 6>

Surface-treated magnetic powder 6 was prepared similarly as Surface-treated magnetic powder 1 except for using 0.3 wt. part of n-$C_4H_9Si(OCH_3)_3$ as the silane coupling agent.

The above-prepared Surface-treated magnetic powders 1–6 are summarized in Table 1 below together with their surface treating agents and amounts thereof.

TABLE 1

| Surface-treated magnetic powders | | |
|---|---|---|
| Surface-treated magnetic powder | Surface-treating agent | Added amount (wt. parts) |
| 1 | n-$C_{10}H_{21}Si(OCH_3)_3$ | 1.4 |
| 2 | n-$C_6H_{13}Si(OCH_3)_3$ | 1.9 |
| 3 | n-$C_{18}H_{37}Si(OCH_3)_3$ | 1.9 |
| 4 | n-$C_4H_9Si(OCH_3)_3$ | 1.0 |
| 5 | n-$C_4H_9Si(OCH_3)_3$ | 0.7 |
| 6 | n-$C_4H_9Si(OCH_3)_3$ | 0.3 |

<Untreated Magnetic Powder 1>

Into a ferrous sulfate aqueous solution, a caustic soda solution in an amount of 1.0–1.1 equivalent of the ferrous ion was added and mixed to prepare an aqueous solution containing ferrous hydroxide.

While maintaining the pH at ca. 9, air was blown into the aqueous solution to cause oxidation at 80–90° C., thereby forming a slurry containing seed crystals.

Then, into the slurry, a ferrous sulfate aqueous solution in an amount of 0.9–1.2 equivalent of the alkali (i.e., sodium in the caustic soda solution was added, and while maintaining the pH of the slurry at 8, air wax blown into the slurry to proceed with oxidation. After the oxidation, the resultant magnetic iron oxide powder was washed, filtered out and dried in an ordinary manner, followed by disintegration of slight agglomerate thereof to obtain Untreated magnetic power 1.

(Electroconductive Fine Powders)

Electroconductive fine powders 1–5 were provided in the following manner.

<Electroconductive Fine Powder 1>

Zinc oxide primary particles having a primary particle size of 0.1–0.3 μm were agglomerated under pressure to obtain Electroconductive fine powder 1, which was white in color, and exhibited a volume-average particle size (Dv) of 3.6 μm, a particle size distribution including 6.4% by volume of particles of 0.5 μm or smaller (V % (D≦0.5 μm)=6.4% by volume) and 7% by number of particles of 5 μm or larger (N % (D≧5 μm)=7% by number), and a resistivity (Rs) of 1400 ohm.cm.

As a result of observation through a scanning electron microscope (SEM) at magnifications of $3\times10^3$ and $3\times10^4$, Electroconductive fine powder 1 was found to be principally composed of zinc oxide primary particles of 0.1–0.3 μm in primary particle size and agglomerated particles of 1–5 μm.

Electroconductive fine powder 1 also exhibited a transmittance of a mono-particle densest layer with respect to light of 675 nm in wavelength ($T_{675}$ (%)) of ca. 36% as measured by a transmission densitometer ("310T", available from X-Rite K.K.). The wavelength of 675 nm was identical to the exposure wavelength of a laser beam scanner used in Examples described hereinafter.

<Electroconductive Fine Powder 2>

Electroconductive fine powder 1 was pneumatically classified to obtain Electroconductive fine powder 2, which exhibited Dv=2.2 μm, V % (D≦0.5 μm)=4.2% by volume, N % (D≧5 μm)=1% by number, Rs=1400 ohm.cm and $T_{675}$ (%)=36%.

As a result of the SEM observation, Electroconductive fine powder 2 was found to be principally composed of zinc oxide primary particles of 0.1–0.3 μm in primary particle size and agglomerate particles of 1–5 μm, but the amount of the primary particles was reduced than in Electroconductive fine powder 1.

<Electroconductive Fine Powder 3>

Electroconductive fine powder 1 was pneumatically classified to obtain Electroconductive fine powder 3, which exhibited Dv=1.3 μm, V % (D≦0.5 μm)=30% by volume, N % (D≧5 μm)=0% by number, Rs=1400 ohm.cm and $T_{675}$ (%)=36%.

As a result of the SEM observation, Electroconductive fine powder 3 was found to be principally composed of zinc oxide primary particles of 0.1–0.3 μm in primary particle size and agglomerate particles of 1–4 μm, but the amount of the primary particles was increased than in Electroconductive powder 1.

<Electroconductive Fine Powder 4>

White zinc oxide fine particles were used as Electroconductive fine powder 4, which exhibited Dv=0.3 μm, V % (≦0.5 μm)=81% by volume, N % (≧5 μm)=0% by number, primary particle sizes (Dp)=0.1–0.3 μm, Rs 100 ohm.cm, a purity of 99% or higher and $T_{675}$ (%)=36%.

As a result of the TEM observation, Electroconductive fine powder 4 was found to be composed of zinc oxide primary particles of Dp=0.1–0.3 μm and contain little agglomerate particles.

<Electroconductive Fine Powder 5>

Aluminum borate powder surface-coated with antimony tin oxide and having Dv=2.5 μm was pneumatically classified to remove coarse particles, and then subjected to a repetition of dispersion in aqueous medium and filtration to remove fine particles to recover Electroconductive fine powder 5, which was grayish-white electroconductive fine powder and exhibited Dv=3.1 μm, V % (D≦0.5 μm)=0.7% by volume, and N % (D≧5 μm)=1% by number.

(Magnetic Toners)

Magnetic toners used in Examples described hereinafter were prepared in the following manner.

<Magnetic Toner 1>

Into 709 wt. parts of deionized water, 451 parts of 0.1M-$Na_3PO_4$ aqueous solution was added, and after heating to 60° C., hydrochloric acid was added so as to provide a pH of 6.0 after a subsequent addition of calcium chloride. Thereafter, 67.7 wt. parts of 1.0 M-$CaCl_2$ aqueous solution was added to form an aqueous medium containing calcium phosphate.

| | |
|---|---|
| Styrene | 78 wt. part(s) |
| n-Butyl acrylate | 22 wt. part(s) |
| Unsaturated polyester resin (formed by condensation of bisphenol A PO (propylene oxide)- and EO (ethylene oxide)-adduct with fumaric acid) | 2 wt. part(s) |
| Saturated polyester resin (formed by condensation of bisphenol A PO- and EO-adduct with terephthalic acid) | 3 wt. part(s) |
| Negative charge control agent (monoazo dye-Fe compound) | 1 wt. part(s) |
| Surface-treated magnetic powder 1 | 90 wt. part(s) |

The above ingredients were uniformly dispersed and mixed by an attritor (made by Mitsui Miike Kakoki K.K.) to form a monomer composition.

To the monomer composition warmed at 60° C., 4.5 wt. parts of ester wax (Tabs.max (maximum heat-absorption peak temperature on a DSC curve)=72° C.) was added to be dissolved therein, and 5 wt. parts of 2,2'-azobis(2,4-dimethylvaleronitrile) (polymerization initiator showing $t_{1/2}$=140 min. at 60° C.) was added to be dissolved, thereby forming a polymerizable monomer mixture.

The thus-formed polymerizate monomer mixture was charged into the above-prepared aqueous medium and stirred at 60° C. in an $N_2$ atmosphere for 15 min. at 10,000 rpm by a TK HOMOMIXER (made by Tokushu Kika Kogyo K.K.) to disperse the droplets of the monomer mixture. Then, the system was further stirred by a paddle stirrer and subjected to 6 hours of reaction at 60° C. Thereafter, the liquid temperature was raised to 80° C. for further 4 hours of reaction. After the reaction, the system was subjected to 2 hours of distillation at 80° C. After cooling, hydrochloric acid was added to the suspension liquid to dissolve the calcium phosphate salt. Then, the polymerizate was filtered out, washed with water and dried to recover black-colored Magnetic toner particles 1 having a weight-average particle size (D4) of 7.1 μm.

Then, 100 wt. parts of Magnetic toner particles 1 were blended with 0.9 wt. part of hydrophobic silica fine powder ($S_{BET}$=200 $m^2/g$) which has been successively treated with hexamethyldisilazane and silicone oil, and 1.6 wt. parts of Electroconductive fine powder 3 by means of a HENSCHEL mixer to obtain Magnetic toner 1.

Some compositional features and properties of Magnetic toner 1 are summarized in Table 2 together with those of other Magnetic toners prepared in manners described below.

<Magnetic Toner 2>

Magnetic toner 2 was prepared in the same manner as Magnetic toner 1 except for using Surface-treated magnetic powder 2 instead of Surface-treated magnetic powder 1 and using t-butyl peroxy-2-ethylhexanoate as the polymerization initiator.

<Magnetic Toner 3>

Magnetic toner 3 was prepared in the same manner as Magnetic toner 1 except for using Surface-treated magnetic powder 3 instead of Surface-treated magnetic powder 1 and omitting the pH adjustment by addition of hydrochloric acid to prepare and use an aqueous medium having a pH of 10.3 for the polymerization.

<Magnetic Toner 4>

Magnetic toner 4 was prepared in the same manner as Magnetic toner 1 except for using Surface-treated magnetic powder 4 instead of Surface-treated magnetic powder 1.

<Magnetic Toner 5>

Magnetic toner 5 was prepared in the same manner as Magnetic toner 1 except for using Surface-treated magnetic powder 5 instead of Surface-treated magnetic powder 1.

<Magnetic Toner 6>

100 wt. parts of Magnetic toner particles 1 prepared in the course of the preparation of Magnetic toner 1 were blended with 0.8 wt. part of hydrophobic silica fine powder ($S_{BET}$=250 $m^2/g$) which had been treated with hexamethyldisilazane and 1.6 wt. parts of Electroconductive fine powder 3 by a HENSCHEL mixer to prepare Magnetic toner 6.

<Magnetic Toner 7>

Magnetic toner 7 was prepared in the same manner as Magnetic toner 1 except for using 1.5 wt. parts of nigrosin instead of 1 wt. part of the negative charge control agent (monoazodye Fe compound) and using 0.9 wt. part of positively chargeable hydrophobic dry-process silica fine powder ($S_{BET}$=200 $m^2/g$) instead of 0.9 wt. part of the hydrophobic silica fine powder ($S_{BET}$=200 $m^2/g$).

<Magnetic Toner 8>

Magnetic toner 8 was prepared in the same manner as Magnetic toner 1 except for reducing the amount of the ester wax to 1.2 wt. parts.

<Magnetic Toner 9>

Magnetic toner 9 was prepared in the same manner as Magnetic toner 1 except for increasing the amount of the ester wax to 54 wt. parts.

<Magnetic Toner 10>

Magnetic toner 10 was prepared in the same manner as Magnetic toner 1 except for using polyethylene wax (Tabs.max=100° C.) instead of the ester wax.

<Magnetic Toner 11>

Magnetic toner 11 was prepared in the same manner as Magnetic toner 1 except for reducing the amount of Surface-treated magnetic powder 1 to 40 wt. parts.

<Magnetic Toner 12>

Magnetic toner 12 was prepared in the same manner as Magnetic toner 1 except for increasing the amount of Surface-treated magnetic powder 1 to 150 wt. parts.

<Magnetic Toner 13)

| | |
|---|---|
| Styrene/n-butyl acrylate copolymer (weight ratio = 80/20) | 100 wt. part(s) |
| Unsaturated polyester resin | 2 wt. part(s) |
| Saturated polyester resin | 3 wt. part(s) |
| Negative charge control agent (monoazo dye Fe compound) | 1 wt. part(s) |
| Surface-treated magnetic powder 1 | 90 wt. part(s) |
| Ester wax used in Magnetic toner 1 | 4.5 wt. part(s) |

The above ingredients were blended in a blender and melt-kneaded by a twin-screw extruder heated at 105° C. After being cooled, the kneaded product was coarsely crushed by a hammer mill and finely pulverized by a jet mill, followed by pneumatic classification. The classified pulverizate was surface-treated by an impact-type surface treatment apparatus under the conditions of treatment temperature of 50° C. and a rotor blade peripheral speed of 90 m/sec to obtain spherical Magnetic toner particles 13 of D4=9.3 μm. Then, 100 wt. parts of Magnetic toner particles 13 were blended with 1.2 wt. parts of the hydrophobic silica fine powder used in Magnetic toner 1 and 1.6 wt. parts of Electro-conductive fine powder 3 by a HENSCHEL mixer to obtain Magnetic toner 13.

<Magnetic Toner 14>

Sphered Magnetic toner particles 14 of D4=8.6 μm were prepared similarly as Magnetic toner particles 13 except for pulverizing the coarsely crushed product by means of a TURBO MILL (made by Turbo Kogyo K.K.), followed by treatment by an impact-type surface treating apparatus (treatment temperature=50° C., rotating blade peripheral speed=90 m/sec).

Then, 100 wt. parts of Magnetic toner particles 14 were blended with 1.0 wt. part of the hydrophobic colloidal silica used in Magnetic toner 6 and 1.6 wt. parts of Electroconductive fine powder 3 by a HENSCHEL mixer to obtain Magnetic toner 14.

<Magnetic Toners 15–17>

Magnetic toners 15–17 were prepared in the same manner as Magnetic toner 1 except for using Electroconductive fine powders 2, 1 and 5, respectively, instead of Electroconductive fine powder 3.

As for magnetization measured at a magnetic field of 79.6 kA/m, Magnetic toner 11 exhibited 17.3 $Am^2$/kg, Magnetic toner 12 exhibited 37.2 $Am^2$ /kg, and all the other Magnetic toners exhibited values in the range of 26–30 $Am^2$/kg.

<Comparative Magnetic Toner 1>

Comparative Magnetic toner 1 was prepared in the same manner as Magnetic toner 1 except for using Surface-treated magnetic powder 6 instead of Surface-treated magnetic powder 1.

<Comparative Magnetic Toner 2>

Comparative Magnetic toner 2 was prepared in the same manner as Magnetic toner 1 except for using Untreated magnetic powder 1 instead of Surface-treated magnetic powder 1.

<Comparative Magnetic Toner 3>

Comparative Magnetic toner particles 3 of D4=2.9 μm were prepared in the same manner as Magnetic toner particles 1 except for increasing the amounts of $N_3PO_4$ aqueous solution and $CaCl_2$ aqueous solution. Then, 100 wt. parts of Comparative Magnetic toner particles 3 were blended with 2.2 wt. parts of the hydrophobic silica fine powder used in Magnetic toner 1 and 3.9 wt. parts of Electroconductive fine powder 4 by a HENSCHEL mixer to obtain Comparative Magnetic toner 3.

<Comparative Magnetic Toner 4>

Comparative Magnetic toner particles 4 of D4=10.4 μm were prepared in the same manner as Magnetic toner particles 1 except for decreasing the amounts of $N_3PO_4$ aqueous solution and $CaCl_2$ aqueous solution. Then, 100 wt. parts of Comparative Magnetic toner particles 4 were blended with 0.6 wt. part of the hydrophobic silica fine powder used in Magnetic toner 1 and 1.0 wt. parts of Electroconductive fine powder 3 by a Henschel mixer to obtain Comparative Magnetic toner 4.

<Comparative Magnetic Toner 5>

Comparative Magnetic toner particles 5 of D4=8.7 μm were prepared in the same manner as Magnetic toner particles 13 except for omitting the surface treatment after the classification. Then, 100 wt. parts of Magnetic toner particles 13 were blended with 1.2 wt. parts of the hydrophobic silica fine powder used in Magnetic toner 1 and 1.8 wt. parts of Electroconductive fine powder 3 to obtain Comparative Magnetic toner 5.

Some compositional features and properties of the above prepared (Comparative) Magnetic toners are inclusively summarized in the following Table 2.

TABLE 2

Magnetic toner compositions and properties

| | Composition | | | | | | | | Properties | | | |
|---|---|---|---|---|---|---|---|---|---|---|---|---|
| | Surface-treated | | | Charge | External additive | | | | | | | Isolated |
| Magnetic | Magnetic powder | Wax | | control | silica | | Conductive powder | | D4 | Circularity | | iron |
| Toner | (wt. parts) *4 | species | wt. parts | agent | species | wt. part (s) | name | wt. parts | (μm) | C av | C mode | particles (%) |
| 1 | 1 | ester | 4.5 | monoazo Fe | *1 | 0.9 | 3 | 1.6 | 7.1 | 0.983 | 1.00 | 0.21 |
| 2 | 2 | ↑ | ↑ | ↑ | ↑ | ↑ | ↑ | ↑ | 6.8 | 0.984 | 1.00 | 0.29 |
| 3 | 3 | ↑ | ↑ | ↑ | ↑ | ↑ | ↑ | ↑ | 7.0 | 0.987 | 1.00 | 0.10 |
| 4 | 4 | ↑ | ↑ | ↑ | ↑ | ↑ | ↑ | ↑ | 6.7 | 0.982 | 1.00 | 1.71 |
| 5 | 5 | ↑ | ↑ | ↑ | ↑ | ↑ | ↑ | ↑ | 6.6 | 0.983 | 1.00 | 2.80 |
| 6 | 1 | ↑ | ↑ | ↑ | *2 | 0.8 | ↑ | ↑ | 7.1 | 0.984 | 1.00 | 0.21 |
| 7 | 1 | ↑ | ↑ | nigrosin | *3 | 0.9 | ↑ | ↑ | 7.0 | 0.982 | 1.00 | 0.14 |
| 8 | 1 | ↑ | 1.2 | monoazo Fe | *1 | ↑ | ↑ | ↑ | 6.1 | 0.990 | 1.00 | 0.14 |
| 9 | 1 | ↑ | 54 | ↑ | ↑ | ↑ | ↑ | ↑ | 8.3 | 0.975 | 1.00 | 0.99 |
| 10 | 1 | poly-ethylene | 4.5 | ↑ | ↑ | ↑ | ↑ | ↑ | 7.7 | 0.974 | 1.00 | 0.95 |
| 11 | 1 (40) | ester | ↑ | ↑ | ↑ | ↑ | ↑ | ↑ | 8.5 | 0.990 | 1.00 | 0.07 |
| 12 | 1 (150) | ↑ | ↑ | ↑ | ↑ | ↑ | ↑ | ↑ | 6.1 | 0.976 | 1.00 | 1.92 |
| 13 | 1 | ↑ | ↑ | ↑ | ↑ | 1.2 | ↑ | ↑ | 9.3 | 0.952 | 0.96 | 1.61 |
| 14 | 1 | ↑ | ↑ | ↑ | *2 | 1.0 | ↑ | ↑ | 8.6 | 0.963 | 0.97 | 1.42 |
| 15 | 1 | ↑ | ↑ | ↑ | *1 | 0.9 | 2 | ↑ | 7.1 | 0.983 | 1.00 | 0.21 |
| 16 | 1 | ↑ | ↑ | ↑ | ↑ | ↑ | 1 | ↑ | 7.1 | 0.983 | 1.00 | 0.21 |
| 17 | 1 | ↑ | ↑ | ↑ | ↑ | ↑ | 5 | ↑ | 7.1 | 0.983 | 1.00 | 0.21 |
| Comp. 1 | 6 | ↑ | ↑ | ↑ | ↑ | 0.9 | 3 | ↑ | 7.2 | 0.982 | 1.00 | 3.28 |
| Comp. 2 | Untreated 1 | ↑ | ↑ | ↑ | ↑ | ↑ | 3 | ↑ | 5.6 | 0.970 | 1.00 | 3.52 |
| Comp. 3 | 1 | ↑ | ↑ | ↑ | ↑ | 2.2 | 4 | 3.9 | 2.9 | 0.986 | 1.00 | 1.32 |
| Comp. 4 | 1 | ↑ | ↑ | ↑ | ↑ | 0.6 | 3 | 1.0 | 10.4 | 0.972 | 1.00 | 0.24 |
| Comp. 5 | 1 | ↑ | ↑ | ↑ | ↑ | 1.5 | 3 | 1.8 | 8.7 | 0.928 | 0.95 | 1.45 |

*1 : silica treated with hexamethyl disilazane and silicone oil

*2 : silica treated with hexamethyl disilazane

*3 : positively chargeable hydrophobic dry-process silica.

*4 : 90 wt. parts of magnetic powder was contained except for Magnetic toners 11 and 12.

(Photosensitive Member)

Photosensitive members (image-bearing members) were prepared in the following manner.

<Photosensitive Member 1>

An electroconductive substrate of Al cylinder having an outer diameter of 3 mm, a length of 357 mm and a thickness of 3 mm was successively coated with a charge injection-barrier layer, a photoconductor layer, a buffer layer and a surface layer by using a plasma CVD apparatus respectively under the following conditions to prepare Photosensitive member 1 having a 0.5 μm-thick surface layer.

| | |
|---|---|
| Charge injection-barrier layer: | |
| $SiH_4$ | 300 ml/min (under NTP = 298 K/$10^5$ Pa) |
| $H_2$ | 500 ml/min (NTP) |
| NO | 8 ml/min (NTP) |
| $PH_3$ | 800 ppm (based on $SiH_4$) |
| Power | 400 W (13.56 MHz) |
| Internal press. | 53.3 Pa |
| Substrate temp. | 250° C. |
| Thickness | 1 pm |
| Photoconductor layer: | |
| $SiH_4$ | 500 ml/min (NTP) |
| $H_2$ | 500 ml/min (NTP) |
| Power | 800 W (13.56 MHz) |
| Internal press. | 66.7 Pa |
| Substrate temp. | 250° C. |
| Thickness | 20 μm |
| Buffer layer: | |
| $SiH_4$ | 50 ml/min (NTP) |
| $CH_4$ | 350 ml/min (NTP) |
| Power | 200 W (13.56 MHz) |
| Internal press. | 66.7 Pa |
| Substrate temp. | 250° C. |
| Thickness | 0.2 μm |
| Surface layer: | |
| $SiH_4$ | 20 ml/min (NTP) |
| $CH_4$ | 500 ml/min (NTP) |
| Power | 300 W (13.56 MHz) |
| Internal press. | 40.0 Pa |
| Substrate temp. | 250° C. |

<Photosensitive Member 2>

Photosensitive member 2 having a 0.2 μm-thick surface layer was prepared similarly as Photosensitive member 1 while changing the layer-forming conditions as follows.

| | |
|---|---|
| Charge injection-barrier layer: | |
| $SiH_4$ | 100 ml/min (under NTP) |
| $H_2$ | 500 ml/min (NTP) |
| NO | 5 ml/min (NTP) |
| $PH_3$ | 500 ppm (based on $SiH_4$) |
| Power | 100 W (105 MHz) |
| Internal press. | 1.0 Pa |
| Substrate temp. | 250° C. |
| Thickness | 1 μm |
| Photoconductor layer: | |
| $SiH_4$ | 500 ml/min (NTP) |
| $H_2$ | 500 ml/min (NTP) |
| Power | 300 W (105 14Hz) |
| Internal press. | 1.0 Pa |
| Substrate temp. | 250° C. |
| Thickness | 15 μm |
| Buffer layer: | |
| $SiH_4$ | 50 ml/min (NTP) |
| $CH_4$ | 500 ml/min (NTP) |

-continued

| | |
|---|---|
| Power | 300 W (105 MHz) |
| Internal press. | 1.0 Pa |
| Substrate temp. | 250° C. |
| Thickness | 0.2 μm |
| Surface layer: | |
| $CH_4$ | 500 ml/min (NTP) |
| Power | 1000 W (105 MHz) |
| Internal press. | 0.27 Pa |
| Substrate temp. | 100° C. |

<Photosensitive Member 3>

Photosensitive member 3 having a 0.5 μm-thick surface layer was prepared similarly as Photosensitive member 1 while omitting the buffer layer-forming step and changing the layer-forming conditions as follows.

| | |
|---|---|
| Charge injection-barrier layer: | |
| $SiH_4$ | 100 ml/min (under NTP) |
| $H_2$ | 300 ml/min (NTP) |
| NO | 5 ml/min (NTP) |
| $B_2H_6$ | 2000 ppm (based on $SiH_4$) |
| Power | 400 W (13.56 MHz) |
| Internal press. | 53.3 Pa |
| Substrate temp. | 290° C. |
| Thickness | 2 μm |
| Photoconductor layer: | |
| $SiH_4$ | 200 ml/min (NTP) |
| $H_2$ | 800 ml/min (NTP) |
| $B_2H_6$ | 1 ppm (based on $SiH_4$) |
| Power | 800 W (13.56 MHz) |
| Internal press. | 66.7 Pa |
| Substrate temp. | 290° C. |
| Thickness | 27 μm |
| Surface layer: | |
| $SiH_4$ | 10 ml/min (NTP) |
| $CH_4$ | 500 ml/min (NTP) |
| Power | 300 W (13.56 MHz) |
| Internal press. | 66.7 Pa |
| Substrate temp. | 290° C. |

<Comparative Photosensitive Member 1>

Figure 8:
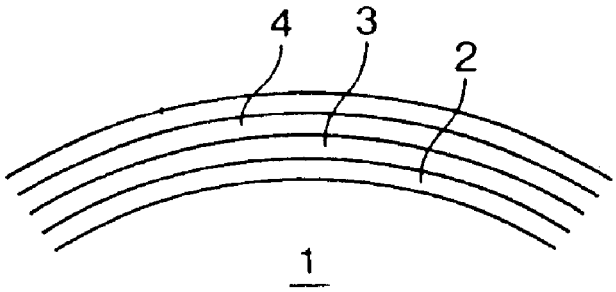
FIG. 8 is a schematic sectional view for illustrating a sectional organization of a comparative photosensitive member (image-bearing member).

Comparative Photosensitive member 1 having a laminar structure as shown in FIG. 8 was prepared by successively forming the following layers by dipping on a 30 mm-dia. aluminum cylinder support 1.

(1) First layer 2 was a 15 μm-thick electroconductive coating layer (electroconductive) layer, principally comprising phenolic resin with powder of tin oxide and titanium oxide dispersed therein.

(2) Second layer 3 was a 0.6 μm-thick undercoating layer comprising principally modified nylon and copolymer nylon.

(3) Third layer 4 was a 0.6 μm-thick charge generation layer comprising principally an azo pigment having an absorption peak in a long-wavelength region dispersed within butyral resin.

(4) Fourth layer was a 25 μm-thick charge transport layer comprising principally a hole-transporting triphenylamine compound dissolved in polycarbonate resin (having a molecular weight of $2\times10^4$ according to the Ostwald viscosity method) in a weight ratio of 8:10 and further containing 10 wt. % based on total solid of polytetrafluoroethylene powder (volume-average particle size (Dv)=0.2 μm) dispersed therein. The layer surface exhibited a contact angle with pure water of 95 deg. as measured by a contact angle meter ("CA-X", available from Kyowa Kaimen Kagaku K.K.).

(Charging Members)

Charging members 1–3 were prepared in the following manners.

<Charging Member 1>

Charging member 1 (charging roller) was prepared in the following manner.

A SUS (stainless steel)-made roller of 9 mm in diameter and 346 mm in length was used as a core metal and coated with a medium resistivity roller-form foam urethane layer formed from a composition of urethane resin, carbon black (as electroconductive particles), a vulcanizing agent and a foaming agent, followed by cutting and polishing for shape and surface adjustment to obtain a charging roller having a flexible foam urethane coating layer of 16 mm in outer diameter and 318 mm in length.

The thus-obtained charging roller exhibited a resistivity of $10^5$ ohm.cm and an Asker C hardness of 30 deg. with respect to the foam urethane layer. As a result of observation through a scanning electron microscope, the charging roller surface was covered with concave cells showing an average cell diameter of ca. 100 μm and a cell areal percentage of 65%.

(Charging Member 2)

About a SUS roller of 9 mm in diameter and 346 mm in length as a core metal, a tape of piled electroconductive nylon fiber was spirally wound to prepare a charging brush roller (Charging member 2). The electroconductive nylon fiber was formed from nylon in which carbon black was dispersed for resistivity adjustment and comprised yarns of 6 denier (composed of 50 filament of 300 denier). The nylon yarns in a length of 3 mm were planted at a density of $10^5$ yarns/in$^2$ to provide a brush roller exhibiting a resistivity of $1\times10^7$ ohm.cm.

<Charging Member 3>

To a mixture of $Fe_2O_3$ 50 mol. %, CuO 25 mol. % and ZnO 25 mol. %, 0.05 wt. % of phosphorus was added together with a dispersing agent, a binder agent and water, and the mixture was subjected to dispersion and mixing in a ball mill and then formed into particles by a spray dryer. Then, the particles were calcined at 1150° C. for 6 hours, and the calcined particles were then disintegrated and classified by a dispersion separator to obtain spherical ferrite particles of Dv.50%=35 μm.

100 wt. parts of the ferrite particles were blended with a solution of 0.10 wt. part of a titanium coupling agent (isopropoxy-triisostearoyl titanate) in toluene to be wet-coated with the latter, and then cured at 170° C. in an electric oven to prepare magnetic particles forming a magnetic brush. The magnetic particles exhibited a volume resistivity of $3.5\times10^7$ ohm.cm.

Separately, for having the magnetic particles form a magnetic brush, a magnet roller giving a magnetic flux density of 0.1 T (tesla) was enclosed within an aluminum cylinder having an outer diameter of 16 mm to form an electrode sleeve, which was designed to be disposed with a gap of ca. 500 μm from a photosensitive member and then coated with the above prepared magnetic particles at a rate of 170 mg/m$^2$ to provide Charging member 3.

EXAMPLE 1

An image forming apparatus having an organization as illustrated in FIG. 2 was provided by remodeling a commercially available copying machine using laser light for digital latent image formation ("GP-405" made by Canon K.K.).

Photosensitive member 1 prepared in the above-described manner was used as an image-bearing member 1. Against the image-bearing member 1, Charging member 1 as a primary charging member 306 was abutted at a prescribed pressure in resistance to its elasticity and a DC charging bias voltage of −440 volts was applied to the core metal of the charging member 306 while rotating the charging member 306 while rotating the charging member 306 at a peripheral speed of −100% relative to that of the image-bearing member 1 (210 mm/sec) in a counter direction with respect to the image-bearing member 1, i.e., at a relative speed ratio of 200%, thereby uniformly charging the image-bearing member 1. The charging member 306 surface was uniformly coated with Electroconductive fine powder 3 at a rate of $1\times10^4$ particles/mm$^2$ while operating an electroconductive fine powder-supply mechanism 314. The thus primarily charged image-bearing member 1 surface was exposed to imagewise laser light having a wavelength of 675 nm to form an electrostatic latent image comprising a dark-part potential (Vd) of −400 vols and light-part potential (Vl) of −20 volts respectively as an average of potentials measured at three points on the image-bearing member 1 when brought to a position closest to the developing sleeve (12 in FIG. 4).

Referring to FIG. 4, the developing sleeve 12 was disposed with a gap of 200 μm from the image-bearing member 1, and comprised a 20 mm-dia. aluminum cylinder surface-blasted with glass beads and then coated with a ca. 10 μm-thick resin layer formed from the following composition so as to have a JIS center line-average roughness (Ra) of 0.85 μm.

| | |
|---|---|
| Phenolic resin | 100 wt. parts |
| Graphite (particle size = ca. 7 μm) | 36 wt. parts |
| Carbon black | 4 wt. parts |

Inside the developing sleeve 12, a fixed multi-pole magnet 14 including a developing pole S1 of 95 mT (950 Gauss), and a knife edge-shaped ferromagnetic blade 11*a* (of Fe—Ni alloy) having a tapered portion toward the photosensitive member 1 was disposed with a gap of 210 μm from the sleeve 12.

For the development, a developing bis voltage of a DC component of Vdc=−270 volts and an AC component of Vpp=800 volts and f=1900 Hz in superposition. The developing sleeve 12 was rotated to provide a peripheral speed of 378 mm/sec which was 180% of a peripheral speed (210 mm/sec) of the image-bearing member 1 in an identical direction. A transfer device 302 for the commercial apparatus was replaced by one of a corona transfer-type.

Further, a pre-exposure device emitting light having a wavelength of 660 nm was disposed between the cleaning member 312*a* and the charging member 306. A hot roller fixing device 313 included in the commercial apparatus was used as it was.

In this Example, Magnetic toner 1 was used for continuous image formation on plain paper of 64 g/m$^2$ as a transfer material P in a normal temperature/normal humidity environment while replenishing Magnetic toner 1 as required. As a result, good images free from transfer dropout of character and line images, back soil due to offset or fog at non-image parts, were obtained at the initial stage.

Then, for evaluating image forming performances in more detail, an A4-lateral size image of a test chart having an image aral percentage of ca. 5% ("TC-A1 Chart: FY9-9045-000", made by Canon K.K.) was reproduced on 20,000 sheets in a continuous mode in various environments described hereinafter, and image evaluation was performed with respect to the following items.

(1) Image Density (I.D.)

An image density formed on plain paper for copying (64 g/m$^2$) was measured relative to the density (0.00) at the non-image portion by using a Macbeth reflection densitometer ("RD 918", made by Macbeth Co.). Based on the measured image density, the evaluation was performed according to the following standard:

A: ≧1.40 (very good)

B: ≧1.35 and <1.40 (good)

C: ≧1.00 and <1.35 (practically of no problem)

D: ≧<1.00 (somewhat problematic)

(2) Fog

Fog density (%) was measured as a difference in whiteness (reflectance) between a white background portion of printed image and a blank white paper as measured by a reflectometer ("MODEL TC-6DS", made by Tokyo Denshoku K.K.). Based on the measured fog density, the evaluation was performed according to the following standard.

A: <1.0% (very good)

B: ≧1.0% and <2.0% (good)

C: ≧2.0% and <3.0% (practically of no problem)

D: >3.0% (somewhat problematic)

(3) Transferability

Transfer residual toner remaining on the photosensitive member after formation and transfer of a solid black image (by using a test chart "FY9-9073-000", made by Canon K.K.) was peeled off with a polyester adhesive tape, and the adhesive tape was applied on a white paper to measure a Macbeth density (denoted by "C"). An identical polyester adhesive tape was applied on the solid black image transferred onto white paper to measure a Macbeth density (denoted by "D"). An identical polyester adhesive tape was applied on a blank white paper to measure a Macbeth density (denoted by "E"). Based on the measured density values, a transfer efficiency is calculated according to the formula:

Transfer efficiency (%)={(D−C)/(D−E)}×100. Based on the measured transfer efficiency values, the evaluation was performed according to the following standard.

A: ≧97% (very good)

B: ≧94% and <9.7% (good)

C: ≧90% and <94% (fair)

D: <90% (poor)

(4) Image Roughening

An image forming apparatus including a photosensitive member and a magnetic toner to be tested was left to stand for at least 72 hours in each test environment. Thereafter, continuous copying was performed on 20,000 sheets, and then power supply to the apparatus was turned off, followed by standing for 24 hours in the environment. Thereafter, the apparatus was used for continuous reproduction of two types of halftone charts having image densities of 0.3 and 0.4 ("FY9-9042-000" and "FY9-9098-000", both made by Canon K.K.) on 100 sheets. The reproduced halftone images were evaluated according to the following standard.

A: Halftone density irregularity could not be recognizable with eyes.

B: Recognition of halftone image irregularity was almost impossible with eyes.

C: Halftone density irregularity could be recognizable with eyes.

D: Halftone density irregularity was clearly recognizable with eyes.

(5) Toner Consumption

From the amount of consumed toner after continuous image formation on 20,000 sheets in the normal temperature/normal humidity (NT/NH, environment, a toner consumption (mg/A4-sheet) was calculated.

Test environments (temperature and humidity) were selected as follows:

HT/HH: 30±2° C./80±10% RH

HT/NH: 25±2° C./50±10% RH

NT/LH: 25±2° C./10±5% RH

LT/LH: 15±2° C./10±5% RH

The above items (1)–(3) were evaluated in the normal temperature/normal humidity (NT/NH) environment both at the initial stage and after 20,000 sheets of copying, and the item (4) was evaluated in all the environment after 20,000 sheets as mentioned above. Each test image formation was performed while turning off the drum heater as an anti-humidity measure. Further, the continuous image formation on 20,000 sheets were basically performed by using the "TC-A1 Chart: FY9-9045-000" made by Canon K.K.), and specific test charts for respective items were used at an appropriate point of and after the continuous image formation.

The results of the above tests for Example 1 are inclusively shown in Table 3 together with those of the following Examples.

Incidentally, in the following Examples an identical species of Electroconductive fine powder as contained in Magnetic toner to be tested was supplied by application to the charging member.

EXAMPLE 2

Image formation and evaluation were performed in the same manner as in Example 1 except for using Magnetic toner 2 instead of Magnetic toner 1.

EXAMPLE 3

Image formation and evaluation were performed in the same manner as in Example 1 except for omitting the replacement of the transfer device to a corona transfer device and using Magnetic toner 3 instead of Magnetic toner 1.

EXAMPLES 4–6

Image formation and evaluation were performed in the same manner as in Example 1 except for using Magnetic toners 4 to 6, respectively, instead of Magnetic toner 1.

EXAMPLE 7

Image formation and evaluation were performed in the same manner as in Example 1 except for using Magnetic toner 7 (positively chargeable toner) instead of Magnetic toner 1, and using Photosensitive member 3 (positively chargeable) instead of Photosensitive member 1, and changing the polarities of the charging bias voltage, and DC-component of the developing bias voltage and the transfer bias voltage to opposite to those applied in Example 1.

Examples 8–17

Image formation and evaluation were performed in the same manner as in Example 1 except for using Magnetic toners 8–17, respectively, instead of Magnetic toner 1.

EXAMPLE 18

Image formation and evaluation were performed in the same manner as in Example 1 except for charging the image-bearing member to Vd=−540 volts and Vl=−100 volts and changing the DC component (Vdc) of the developing bias voltage to −400 volts.

EXAMPLE 19

Image formation and evaluation were performed in the same manner as in Example 1 except for charging the image-bearing member to Vd=−540 volts and Vl=−100 volts and changing Vdc of the developing bias voltage to −400 volts.

EXAMPLE 20

Image formation and evaluation were performed in the same manner as in Example 1 except for charging the image-bearing member to Vd=−490 volts and Vl=−80 volts and changing Vdc to −360 volts.

EXAMPLE 21

Image formation and evaluation were performed in the same manner as in Example 1 except for charging the image-bearing member to Vd=−310 volts and Vl=−10 volts and changing Vdc to −200 volts.

EXAMPLE 22

Image formation and evaluation were performed in the same manner as in Example 1 except for charging the image-bearing member to Vd=−290 volts and Vl=−5 volts and changing Vdc to −190 volts.

EXAMPLE 23

Image formation and evaluation were performed in the same manner as in Example 1 except for changing the peripheral speed of the image-bearing member to 263 mm/sec while retaining the charging roller peripheral speed and changing the developing sleeve to Ra=1.10 μm and the peripheral speed to 426 mm/sec.

EXAMPLE 24

Image formation and evaluation were performed in the same manner as in Example 1 except for using Charging member 2 instead of Charging member 1, and applying a charging bias voltage of −450 volts to the core metal of the charging member.

EXAMPLE 25

Image formation and evaluation were performed in the same manner as in Example 1 except for using Charging member 3 instead of Charging member 1 while omitting the electroconductive fine powder-application mechanism and operating Charging member 3 so that its electrode sleeve peripheral moving direction was opposite to that of the image-bearing member so as to provide a relative speed ratio of 150% while fixing the magnet roll therein to form a magnetic brush rubbing the image-bearing member surface. Then, the electrode sleeve was supplied with a charging voltage of Vdc=−450 volts and $VA_C$=0.5 k-volts (peak-to-peak) in superposition to charge the image-bearing member.

Comparative Example 1 and 2

Image formation and evaluation were performed in the same manner as in Example 1 except for using Comparative Magnetic toners 1 and 2, respectively, instead of Magnetic toner 1.

Comparative Example 3

Image formation and evaluation were performed in the same manner as in Example 1 except for using Comparative Photosensitive member 1 instead of Photosensitive member 1 and changing the relative speed ratio to 150% so as to provide identical dark potential to the image-bearing member, while retaining the moving direction of the charging member.

Comparative Example 4

The contact charging member of the commercial copying apparatus ("GP 405") was used as it was to charge Photosensitive member 1 by applying a charging bias voltage of Vdc=−400 volts and Vac of Vpp=800 volts and f=1900 Hz in superposition, whereby the occurrence of charger amount of ozone was recognized and the charging efficiency was lowered than in Example 1.

Comparative Example 5

Image formation and evaluation were performed in the same manner as in Example 1 except for charging the image-bearing member to Vd=−540 volts and Vl=−150 volts and changing Vdc (of the developing bias voltage) to −480 volts.

Comparative Example 6

Image formation and evaluation were performed in the same manner as in Example 1 except for charging the image-bearing member to Vd=−240 volts and Vl=0 volt and changing Vdc to −170 volts.

Comparative Examples 7–9

Image formation and evaluation were performed in the same manner as in Example 1 except for using Comparative Magnetic toners 3–5, respectively, instead of Magnetic toner 1.

The results of evaluation of the above Examples and Comparative Examples are inclusively shown in Table 3.

TABLE 3

| | | Image forming performances | | | | | | | | | | |
|---|---|---|---|---|---|---|---|---|---|---|---|---|
| | | NT/NH (25 ° C./50% RH) | | | | | | | | | | Toner |
| | Magnetic | Intial | | | After 20000 sheets | | | | | | | consumption |
| | toner | | | Transfer- | | | Transfer- | Halftone image roughening | | | | (mg/sheet) |
| Example | (used) | I.D. | Fog | ability | I.D. | Fog | ability | HT/HH | NT/NH | NT/LH | LT/LH | NT/NH |
| 1 | 1 | A | A | A | A | A | A | A | A | A | A | 36 |
| 2 | 2 | A | A | A | A | A | A | A | A | A | A | 37 |
| 3 | 3 | A | A | A | A | A | A | A | A | A | A | 36 |
| 4 | 4 | B | B | B | B | B | B | B | B | C | C | 41 |
| 5 | 5 | B | B | C | C | C | C | B | B | C | C | 43 |
| 6 | 6 | A | A | B | A | A | C | A | A | B | B | 39 |
| 7 | 7 | A | A | B | A | A | B | A | A | A | A | 39 |
| 8 | 8 | A | A | B | A | A | B | A | A | A | A | 39 |
| 9 | 9 | B | B | C | B | B | C | A | B | B | B | 45 |

TABLE 3-continued

| | | Image forming performances | | | | | | | | | | |
|---|---|---|---|---|---|---|---|---|---|---|---|---|
| | | NT/NH (25 ° C./50% RH) | | | | | | | | | | Toner |
| | Magnetic | Intial | | | After 20000 sheets | | | | | | | consumption |
| | toner | | | Transfer- | | | Transfer- | Halftone image roughening | | | | (mg/sheet) |
| Example | (used) | I.D. | Fog | ability | I.D. | Fog | ability | HT/HH | NT/NH | NT/LH | LT/LH | NT/NH |
| 10 | 10 | B | A | B | A | B | B | B | A | B | B | 41 |
| 11 | 11 | B | B | B | B | C | C | A | A | B | B | 43 |
| 12 | 12 | B | B | C | B | B | C | C | B | C | B | 45 |
| 13 | 13 | B | B | C | A | C | C | B | B | C | C | 46 |
| 14 | 14 | A | B | C | A | C | C | B | B | B | B | 40 |
| 15 | 15 | A | A | A | A | A | B | A | A | A | A | 36 |
| 16 | 16 | A | A | A | A | A | B | A | A | A | A | 36 |
| 17 | 17 | A | A | A | A | A | B | A | A | A | A | 36 |
| 18 | 1 | A | B | A | A | B | B | A | A | B | B | 38 |
| 19 | 1 | A | A | A | A | A | B | A | A | B | A | 36 |
| 20 | 1 | A | A | A | A | A | B | A | A | A | A | 36 |
| 21 | 1 | A | B | A | B | B | B | A | A | A | A | 38 |
| 22 | 1 | B | B | B | B | C | B | A | B | B | A | 35 |
| 23 | 1 | A | A | B | A | A | C | A | A | A | A | 39 |
| 24 | 1 | A | A | A | A | A | B | A | A | A | A | 38 |
| 25 | 1 | A | A | A | A | A | B | A | A | A | A | 38 |
| Comp. 1 | Comp. 1 | C | C | C | C | C | D | C | C | D | C | 50 |
| Comp. 2 | Comp. 2 | C | C | D | C | D | D | C | C | D | D | 52 |
| Comp. 3 | 1 | A | B | C | — | — | — | — | — | — | — | — |
| Comp. 5 | 1 | A | A | B | — | — | — | — | — | — | — | — |
| Comp. 6 | 1 | C | B | B | C | C | B | C | C | C | C | 34 |
| Comp. 7 | Comp. 3 | C | C | C | C | C | C | C | B | C | C | 50 |
| Comp. 8 | Comp. 4 | C | C | B | C | C | C | C | C | C | C | 48 |
| Comp. 9 | Comp. 5 | C | C | D | B | C | 0 | C | B | C | C | 47 |

To supplement the evaluation results in Table 3, in Comparative Example 3, image defects attributable to charging irregularity occurred after continuous copying on 15,000 sheets, so that the image formation and evaluation were terminated. In Comparative Example 5, charge leakage occurred on the image-bearing member after 100 sheets, so that the image formation and evaluation were terminated thereafter.

In all Examples except for Examples 8 and 10, good images free from ghost and back soiling of the copied images were obtained without causing soiling of the image-bearing member, the transfer device and the fixing device. In Examples 8 and 10, slight toner soiling was observed on the pressure roller in the fixing device after the continuous image formation test but no images were accompanied with back surface soiling.

EXAMPLE 26

An image forming apparatus (so-called cleanerless apparatus) having an organization obtained by removing the cleaning device 312 and the electroconductive fine powder-application mechanism 314 from the apparatus used in Example 1, was used for continuous image formation on 50,000 sheets in the normal temperature/normal humidity environment, and evaluated with respect to identical items as in Example 1. Further, halftone image roughening evaluation was performed in the same manner as in Example 1 except that it was performed after continuous copying on 50,000 sheets instead of 20,000 sheets.

Before each continuous image formation, Electroconductive fine powder 3 was applied onto the surface of Charging member 1 at a coating rate of ca. $1\times10^4$ particles/mm$^2$. For evaluating the matching between the image-bearing member and the charging method, a potential difference (lowering) $\Delta$Vd (volts) between the initial stage and after 50,000 sheets of the continuous image formation was measured.

After the copying on 50,000 sheets, an adhesive tape was applied onto a surface on the charging roller to recover the attached powder which was found to uniformly cover the roller and recognized to almost comprise white zinc oxide particles (Electroconductive fine powder 3) while a slight amount of transfer residual toner was recognized. The electroconductive fine powder was measured to be present at a density of ca. $2\times10$ particles/mm$^2$. As a result of observation through a scanning electron microscope, the transfer residual toner particles were free from electroconductive fine powder sticking thereonto.

The results of performance evaluation in this Example are summarized in Table 4 together with those of the following Examples.

In each of the following Examples, Electroconductive fine powder contained in each Magnetic toner used was applied onto the charging member in advance of the continuous image formation.

EXAMPLES 27–31

Image formation and evaluation were performed in the same manner as in Example 26 except for using Magnetic toners 2–6, respectively, instead of Magnetic toner 1.

EXAMPLE 32

Image formation and evaluation were performed in the same manner as in Example 7 except for using an image forming apparatus formed by removing the cleaner and the electroconductive fine powder application mechanism.

EXAMPLES 33–42

Image formation and evaluation were performed in the same manner as in Example 26 except for using Magnetic toners 8–17, respectively, instead of Magnetic toner 1.

EXAMPLES 43–49

Image formation and evaluation were performed in the same manner as in Example 26 except for operating the image forming apparatus of Example 26 under the conditions specified in Examples 18–24, respectively.

Comparative Examples 10–14

Image formation and evaluation were performed in the same manner as in Example 26 except for using Comparative Magnetic toners 1–5, respectively, instead of Magnetic toner 1.

In Comparative Example 11, charging failure occurred after copying on 1000 sheets, so that the image formation was terminated thereafter.

The evaluation results in the above Examples and Comparative Examples are summarized in the following Table 4.

As a result of toner consumption measurement (per sheet during continuous copying on first 20,000 sheets, performed in the same manner as in Example 1. Examples 26–49 exhibited toner consumptions (mg/A4-sheet) which were approximately 10% less than those of the corresponding Examples 1–25 respectively.

TABLE 4

| | | Image forming performances | | | | | | | | | | | |
|---|---|---|---|---|---|---|---|---|---|---|---|---|---|
| | | NT/NH (25° C./50% RH) | | | | | | | | | NT/NH | | Toner |
| | Magnetic | | | After 50000 sheets | | | | | | | (After 50000 sheets) | | consumption |
| | toner | Initial | | | | Transfer- | Halftone image roughening | | | | Δv | Conductive powder | (mg/sheet) |
| Example | (used) | I.D. | Fog | I.D. | Fog | ability | HT/HH | NT/NH | NT/LH | LT/LH | (−volts) | density (/mm$^2$) | NT/NH |
| 26 | 1 | A | A | A | A | A | A | A | A | A | 5 | $2 \times 10^5$ | 34 |
| 27 | 2 | A | A | A | A | A | A | A | A | A | 5 | $2 \times 10^5$ | 35 |
| 28 | 3 | A | A | A | A | A | A | A | A | A | 5 | $2 \times 10^5$ | 34 |
| 29 | 4 | B | B | B | C | B | B | C | C | C | 5 | $2 \times 10^5$ | 38 |
| 30 | 5 | C | C | C | C | C | C | C | C | C | 15 | $2 \times 10^6$ | 40 |
| 31 | 6 | A | A | A | B | C | A | A | B | B | 15 | $7 \times 10^5$ | 36 |
| 32 | 7 | A | A | A | A | B | A | A | A | A | 10 | $5 \times 10^5$ | 36 |
| 33 | 8 | A | A | A | A | B | A | A | A | A | 5 | $2 \times 10^5$ | 36 |
| 34 | 9 | B | B | B | C | C | B | B | C | B | 15 | $9 \times 10^5$ | 42 |
| 35 | 10 | B | A | A | C | B | B | B | C | B | 5 | $8 \times 10^4$ | 38 |
| 36 | 11 | B | B | B | C | C | B | B | C | B | 10 | $7 \times 10^4$ | 40 |
| 37 | 12 | B | B | B | B | C | C | C | C | C | 10 | $9 \times 10^3$ | 42 |
| 38 | 13 | B | B | A | C | C | C | C | C | C | 15 | $6 \times 10^3$ | 42 |
| 39 | 14 | A | B | A | C | C | B | B | C | C | 10 | $4 \times 10^4$ | 37 |
| 40 | 15 | A | A | A | A | B | A | A | A | A | 0 | $8 \times 10^4$ | 34 |
| 41 | 16 | A | A | A | A | B | A | A | A | A | 5 | $5 \times 10^5$ | 34 |
| 42 | 17 | A | A | A | A | B | A | A | A | A | 5 | $7 \times 10^5$ | 34 |
| 43 | 1 | A | B | A | B | B | A | A | B | B | 5 | $9 \times 10^5$ | 36 |
| 44 | 1 | A | A | A | A | B | A | A | B | A | 5 | $6 \times 10^5$ | 34 |
| 45 | 1 | A | A | A | A | B | A | A | A | A | 5 | $4 \times 10^5$ | 34 |
| 46 | 1 | A | B | B | B | B | A | A | A | A | 5 | $9 \times 10^4$ | 35 |
| 47 | 1 | B | B | B | C | B | A | B | B | A | 5 | $6 \times 10^4$ | 33 |
| 48 | 1 | A | A | A | A | C | A | A | A | A | 5 | $3 \times 10^4$ | 36 |
| 49 | 1 | A | A | A | A | B | A | A | A | A | 10 | $1 \times 10^3$ | 36 |
| Comp. 10 | Comp. 1 | C | C | C | C | D | C | C | D | C | 25 | $1 \times 10^3$ | 46 |
| Comp. 11 | Comp. 2 | C | C | — | — | — | — | — | — | — | — | — | — |
| Comp. 12 | Comp. 3 | C | C | C | D | C | C | C | D | C | 15 | $1 \times 10^7$ | 46 |
| Comp. 13 | Comp. 4 | C | C | C | C | C | C | C | D | D | 5 | $6 \times 10^2$ | 45 |
| Comp. 14 | Comp. 5 | C | C | B | D | D | C | C | D | D | 15 | $2 \times 10^3$ | 44 |

What is claimed is:

1. An image forming apparatus, comprising: an image-bearing member, a charging means for charging the image-bearing member, an electrostatic latent-image forming means forming an electrostatic latent image on the charged image-bearing member, a developing means including a magnetic toner and a toner-carrying member for transferring the magnetic toner carried on the toner-carrying member onto the electrostatic latent image to form a toner image thereon, and a transfer means for electrostatically transferring the toner image on the image-bearing member onto a transfer material via or without via an intermediate transfer member, wherein the charging means comprises a charging member supplied with a voltage and abutted against the image-bearing member to form a contact nip with the image-bearing member, the charging member is a roller member having a volume resistivity of $10^3$–$10^8$ ohm.cm, the image-bearing member comprises an electroconductive support and a photoconductor layer comprising a silicon-based non-single crystal material and disposed on the electroconductive support, and is charged to a potential of 250 to 600 volts in terms of an absolute value via the charging member abutted against it, the magnetic toner includes magnetic toner particles comprising at least a binder resin, a wax and a magnetic iron oxide, and inorganic fine powder and electroconductive fine powder present at the surface of the magnetic toner particles, the magnetic toner has a weight-average particle size of 4–8 μm, the magnetic toner has an average circularity of 0.950 to 0.995, and the magnetic toner contains 0.10 to 1.50% of isolated iron-containing particles, the electroconductive fine powder has a volume-average particle size of 0.8 to 3.6 μm, the wax is present in the magnetic toner in a proportion of 0.1 to 20 wt. % based on the total weight of the magnetic toner, a surfacemost layer of the image bearing member comprises a non-single crystal carbon hydride film, and the roller member has a surface provided with minute cells providing an average spherical cell diameter of 5–300 μm and a void areal percentage at the surface of 15–90 %.

2. The apparatus according to claim 1, wherein the developing means also functions as a means for recovering a portion of the magnetic toner remaining on the image-bearing member after transferring the toner image onto the transfer material.

3. The apparatus according to claim 1, wherein by the charging means, the image-bearing member is charged to a potential of 250 to 500 volts in terms of an absolute value.

4. The apparatus according to claim 1, wherein the charging means is a means for charging the image-bearing member by abutting the charging member against the image-bearing member via electroconductive fine powder.

5. The apparatus according to claim 4, wherein the electroconductive fine powder is present at a density of at least $10^3$ particles/$mm^2$.

6. The apparatus according to claim 1, wherein the image-bearing member is charged while moving the image-bearing member and the charging member so as to provide a relative speed difference between surface moving speeds of these members at the contact position.

7. The apparatus according to claim 6, wherein the image-bearing member and the charging member are moved in mutually opposite surface moving directions at the contact position.

8. The apparatus according to claim 1, wherein the charging member is supplied with a DC voltage alone or in superposition with an AC voltage having a peak-to-peak voltage of below 2×Vth relative to a discharge initiation voltage Vth in DC voltage application.

9. The apparatus according to claim 1, wherein the charging member is supplied with a DC voltage alone or in superposition with an AC voltage having a peak-to-peak voltage of below Vth relative to a discharge initiation voltage Vth in DC voltage application.

10. The apparatus according to claim 1, wherein in the developing means, the magnetic toner is carried in a layer at a density of 5–50 g/$m^2$ on the toner-carrying member to develop the electrostatic latent image on the image-bearing member.

11. The apparatus according to claim 1, wherein in the developing means, the magnetic toner is carried on the toner-carrying member in an amount regulated by a ferromagnetic metal blade disposed opposite to and with a small gap from the toner-carrying member.

12. The apparatus according to claim 1, wherein in the developing means, the toner-carrying member is disposed opposite to and with a gap of 100–1000 μm from the image-bearing member.

13. The apparatus according to claim 1, wherein in the developing means, the magnetic toner is disposed on the toner-carrying member in a layer thickness smaller than a closest gap between the toner-carrying member and the image-bearing member, and is transferred onto the image-bearing member to develop the electrostatic latent image thereon.

14. The apparatus according to claim 1, wherein in the developing means, a developing bias voltage comprising at least an AC voltage is applied so as to form an alternating electric field between the toner-carrying member and the image-bearing member, wherein the alternating electric field has a peak-to-peak intensity of $3\times10^6$–$1\times10^7$ V/m and a frequency of 100–5000 Hz.

15. The apparatus according to claim 1, wherein the transfer means includes a transfer member abutted against the image-bearing member via the transfer material to transfer the toner image from the image bearing member onto the transfer material.

* * * * *

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

ON THE TITLE PAGE [56] REFERENCES CITED:

U.S. Patent Documents, "5,840,755 A 11/1998 Liedtke" should read --5,480,755 A 1/1996 Uchiyama et al.--.

ON THE TITLE PAGE [56] REFERENCES CITED:

Foreign Patent Documents, "FOREIGN PATENT DOCUMENTS" should read

| | | |
|---|---|---|
| --JP | 54-086341 | 7/1979 |
| JP | 55-18656 | 2/1980 |
| JP | 56-142540 | 11/1981 |
| JP | 57-151952 | 9/1982 |
| JP | 59-168458 | 9/1984 |
| JP | 59-200254 | 11/1984 |
| JP | 59-200256 | 11/1984 |
| JP | 59-200257 | 11/1984 |
| JP | 59-224102 | 12/1984 |
| JP | 60-3181 | 1/1985 |
| JP | 60-12554 | 1/1985 |
| JP | 60-69660 | 4/1985 |
| JP | 61-141452 | 6/1986 |
| JP | 61-249059 | 11/1986 |
| JP | 61-275864 | 12/1986 |
| JP | 62-258472 | 11/1987 |
| JP | 63-149669 | 6/1988 |
| JP | 63-250660 | 10/1988 |
| JP | 2-111962 | 4/1990 |
| JP | 2-120865 | 5/1990 |
| JP | 4-9860 | 1/1992 |
| JP | 4-264453 | 9/1992 |
| JP | 5-66608 | 3/1993 |
| JP | 5-150539 | 6/1993 |
| JP | 5-346682 | 12/1993 |
| JP | 7-99442 | 10/1995 |
| JP | 10-239897 | 9/1998 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998--. |

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 2:

Line 10 “uses,” should read --use,--.

COLUMN 3:

Line 62, “mechanism” should read --mechanisms--.

COLUMN 5:

Line 41, “to” should read --to be--.

COLUMN 10:

Line 36, “then” should read --than--; and
Line 47, “bond’s” should read --bonds--.

COLUMN 11:

Line 25, “member,” should read --member--; and
Line 31, “image-bearing” should read --image-bearing--.

COLUMN 13:

Line 7, “particles),” should read --particles,--.

COLUMN 20:

Line 32, “Fischer-Tiropsch” should read --Fischer-Tropsch--.

COLUMN 21:

Line 57, “3-28 $m^1/g$,” should read --3-28 $m^2/g$,--.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 24:

Line 27, “photographic” should read --photographed--;
Line 49, “is” should read --is from the--;
Line 50, “apparatus” should read --apparatus and--;
Line 51, “avid” should read --avoid--; and
Line 64, “recover” should read --recovery--.

COLUMN 30:

Line 21, “due” should read --due to--.

COLUMN 31:

Line 6, “it” should read --it is--;
Line 18, “10-200,000 mm $^2$/d,” should read --10-200,000mm$^2$/sec,--;
Line 19, “S.” should read --sec.--; and
Line 22, “200,000 mm/sec,” should read --200,000mm$^2$/sec,--.

COLUMN 32:

Line 44, “a” should read --an--.

COLUMN 33:

Line 45, “using a” should read --using--; and
Line 56, “an” should read --and--.

COLUMN 35:

Line 35, “image-baring” should read --image-bearing--; and
Line 63, “image-baring” should read --image-bearing--.

COLUMN 36:

Line 19, “image bearing” should read --image-bearing--; and
Line 66, “react” should read --react to--.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 39:

Line 13, “sing” should read --using--;
Line 17, “added” should read --added with--;
Line 24, “Coulter counter” should read --COULTER COUNTER--;
Line 47, “Preferring” should read --Referring--; and
Line 51, “30b” should read --308b--.

COLUMN 42:

Line 13, “charting” should read --charging--.

COLUMN 44:

Line 10, “a” should be deleted.

COLUMN 46:

Line 66, “voltage, wave-” should read --voltage wave- --.

COLUMN 47:

Line 22, “constraint” should read --constrained--; and
Line 48, “saturatio” should read --saturation--.

COLUMN 48:

Line 15, “preferred” should read --preferred to--; and
Line 51, “an” should read --a--.

COLUMN 49:

Line 23, “polychloroifluoroethylene,” should read --polychlorofluoroethylene,--;
Line 28, “ironically” should read --ionically--; and
Line 65, “injection-barier” should read --injection-barrier--.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 52:

Line 42, “bismuth,” should read --bismuth (Bi),--; and
Line 65, “PI3;” should read --$PI_3$;--.

COLUMN 53:

Line 41, “halogen (X” should read --halogen (X)--.

COLUMN 54:

Line 3, “becomes possible” should read --becomes--; and
Line 46, “possible” should read --possible to--.

COLUMN 56:

Line 25, “may” should read --may be--;
Line 52, “may be” should read --may--; and
Line 63, “point” should read --points--.

COLUMN 57:

Line 40, “2” should be deleted; and
Line 53, “at center line” should read --as center line--.

COLUMN 58:

Line 22, “vinyl resin” should read --vinyl resin,--;
Line 27, “an” should read --and--;
Line 41, “$10^{-6}$ ohm.cm,” should read --$10^{6}$ ohm.cm,--; and
Line 42, “$10^{-6}$ ohm.cm.” should read --$10^{6}$ ohm.cm.--.

COLUMN 59:

Line 6, “formula]” should read --formula:--;
Line 29, “power” should read --powder--;
Line 38, “fol-” should be deleted;
Line 39, “lowability” should read --flowability--; and
Line 51, “be” should be deleted.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 60:

Line 1, “collapsion” should read --the collapse--; and
Line 63, “(clearless” should read --(cleanerless--.

COLUMN 62:

Line 47, “member 1,” should read --member 1,--.

COLUMN 63:

Line 52, “ozonless-type” should read --ozoneless-type--.

COLUMN 64:

Line 64, “causitic” should read --caustic--.

COLUMN 65:

Line 5, “power 1.” should read --powder 1.--;
Line 56, “wax” should read --was--; and
Line 61, “power 1.” should read --powder 1.--.

COLUMN 66:

Line 46, “(≧5μm)” should read --(D≧ 5 μm)--; and
Line 47, “Rs 100 ohm.cm,” should read --Rs=100 ohm.cm,--.

COLUMN 68:

Line 15, “(monoazodye” should read --(monoazo dye--; and
Line 38, “Toner 13)” should read --Toner 13>--.

COLUMN 71:

Line 22, “1pm” should read --lμm--; and
Line 60, “(105 14Hz)” should read --(105 MHz)--.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 74:

Line 14, "-400 vols" should read -- -400 volts--;
Line 37, "bis" should read --bias--; and
Line 58, "aral" should read --areal--.

COLUMN 75:

Line 6, "≧<1.00" should read --< 1.00--.

COLUMN 77:

Line 47 "$VA_C$=0.5, "" should read --Vac=0.5--.

COLUMN 78:

Table 3, "Intial" should read --Initial--.

COLUMN 79:

Table 3, "Intial" should read --Initial--; "46" (in Example 13) should read --45--; and "O" (in comp. g) should read --D--..

COLUMN 82:

Table 4, "$Px10^3$" should read --$Px10^4$--.

UNITED STATES PATENT AND TRADEMARK OFFICE

CERTIFICATE OF CORRECTION

PATENT NO. : 7,043,175 B2
APPLICATION NO. : 09/987490
DATED : May 9, 2006
INVENTOR(S) : Keiji Komoto et al.

It is certified that error appears in the above-identified patent and that said Letters Patent is hereby corrected as shown below:

COLUMN 84:

Line 33, "image bearing" should read --image-bearing--.

Signed and Sealed this

Fifth Day of December, 2006

JON W. DUDAS
*Director of the United States Patent and Trademark Office*